US008013876B2

(12) United States Patent
Chung et al.

(10) Patent No.: US 8,013,876 B2
(45) **Date of Patent: *Sep. 6, 2011**

(54) FLAT PANEL DISPLAY AND METHOD OF CONTROLLING PICTURE QUALITY THEREOF

(75) Inventors: In Jae Chung, Gyeonggi-do (KR); Deuk Su Lee, Gyeonggi-do (KR); Jong Hee Hwang, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 1103 days.

This patent is subject to a terminal disclaimer.

(21) Appl. No.: 11/819,752

(22) Filed: Jun. 28, 2007

(65) Prior Publication Data

US 2008/0068324 A1 Mar. 20, 2008

(30) Foreign Application Priority Data

Jun. 29, 2006 (KR) ..... 10-2006-0059333

(51) Int. Cl.
*G09G 5/10* (2006.01)

(52) U.S. Cl. ..... 345/690; 345/89; 345/694; 349/192; 348/246

(58) Field of Classification Search ..... 345/87–100, 345/204, 214, 690, 698, 63, 72, 77, 78, 83; 348/180–194, 246–280, 658, 745; 349/54, 349/192

See application file for complete search history.

(56) References Cited

U.S. PATENT DOCUMENTS

| | | | | |
|---|---|---|---|---|
| 6,154,561 | A * | 11/2000 | Pratt et al. | 382/141 |
| 7,292,024 | B2 * | 11/2007 | Zhang et al. | 324/158.1 |
| 7,786,971 | B2 * | 8/2010 | Chung et al. | 345/98 |
| 7,791,572 | B2 * | 9/2010 | Hwang | 345/87 |
| 7,889,188 | B2 * | 2/2011 | Hwang | 345/204 |
| 2002/0097395 | A1 * | 7/2002 | Smith et al. | 356/239.2 |
| 2003/0168601 | A1 * | 9/2003 | Kita | 250/341.1 |
| 2005/0219390 | A1 * | 10/2005 | Tajima et al. | 348/246 |
| 2006/0061248 | A1 * | 3/2006 | Cok et al. | 313/110 |
| 2006/0092329 | A1 * | 5/2006 | Noji | 348/607 |
| 2006/0244476 | A1 * | 11/2006 | Zhang et al. | 324/770 |
| 2007/0165119 | A1 * | 7/2007 | Ikeda | 348/246 |
| 2007/0182441 | A1 * | 8/2007 | Hwang | 324/770 |
| 2007/0182914 | A1 * | 8/2007 | Hwang | 349/192 |
| 2007/0229420 | A1 * | 10/2007 | Hwang | 345/87 |
| 2008/0001869 | A1 * | 1/2008 | Chung et al. | 345/87 |
| 2008/0036797 | A1 * | 2/2008 | Whang | 345/698 |
| 2008/0068324 | A1 * | 3/2008 | Chung et al. | 345/98 |

* cited by examiner

*Primary Examiner* — Amare Mengistu
*Assistant Examiner* — Dmitriy Bolotin
(74) *Attorney, Agent, or Firm* — Morgan, Lewis & Bockius LLP

(57) ABSTRACT

This invention relates to a flat panel display device that is adaptive for optimizing data, which are to be displayed in a panel defect area, in used of a compensation value of a compensation circuit as well as compensating defect pixels by a repair process, and a method of controlling a picture quality thereof. A flat panel display device according to an embodiment of the present invention includes a display panel; a memory which stores a first compensation data, a second compensation data and a third compensation data; a first compensation part; a second compensation part; a third compensation part; and a driver for driving the display panel in use of the data modulated by the first to third compensation parts.

29 Claims, 53 Drawing Sheets

FLAT PANEL DISPLAY AND METHOD OF CONTROLLING PICTURE QUALITY THEREOF

This application claims the benefit of the Korean Patent Application No. P2006-059333 filed in Korea on Jun. 29, 2007, which is hereby incorporated by reference.

BACKGROUND OF THE INVENTION

1. Field of the Invention

The present invention relates to a flat panel display device, and more particularly to a flat panel display device that is adaptive for optimizing data, which are to be displayed in a panel defect area, in used of a compensation value of a compensation circuit as well as compensating defect pixels by a repair process, and a method of controlling a picture quality thereof.

2. Description of the Related Art

Recently, there has been paid attention to various flat panel display devices which can reduce their weight and size that are a disadvantage of a cathode ray tube. The flat panel display devices include a liquid crystal display device, a field emission display device, a plasma display panel, an organic light emitting diode and the like.

The flat panel display device includes a display panel for displaying a picture, and there might be a case that a picture quality defect is found in a test process of the display panel.

The cause of the picture quality defect occurring in the test process of the display panel results from a defect in a process, and the picture quality defect is generated because there is a defect in the display panel. The panel defect can be, for example, an exposure deviation in an overlapping exposure process, a lens aberration of an exposure device and the like. The panel defect caused by the process deviation might be generated in a fixed form such as dot, line, belt, circle, polygon and the like or in an indeterminate form, as in FIGS. 1 to 5.

In order to recover the panel defect, a repair process inclusive of a thin film forming process, a patterning process and the like is carried out, but it is limited to the recover of the panel defect even though the repair process is carried out. And, the panel is disposed as a waste in case that the panel defect is heavy. Further, in most cases, the brightness or chromaticity of an area where there was the panel defect is shown differently from that of a non-defect area even though the repair process was carried out.

The repair process for a pixel defect shown in a dot shape among the panel defects includes a method of turning the defect pixel into a dark point. But, in the method of making the dark point, the dark point is almost not perceived in a black gray level, as shown in FIG. 6A, but the dark point is clearly perceived in the display screen of an intermediate gray level and a white gray level, as shown in FIGS. 6B and 6C.

As a result, there is a limit in improving the picture quality deterioration, which is caused by the panel defect, only by the repair process for recovering the panel defect.

SUMMARY OF THE INVENTION

Accordingly, it is an object of the present invention to provide a flat panel display device that is adaptive for optimizing data to be displayed in a panel defect area, in use of a compensation value of a compensation circuit as well as compensating defect pixels by a repair process, and a method of controlling a picture quality thereof.

In order to achieve these and other objects of the invention, a flat panel display device according to an aspect of the present invention includes a display panel which has a non-defect area and a panel defect area and has at least one link pixel where adjacent pixels are linked to each other; a memory which stores a first compensation data for compensating data to be displayed at the panel defect area, a second compensation data for compensating data to be displayed at a boundary part between the panel defect area and the non-defect area, and a third compensation data for compensating data to be displayed at the link pixel; a first compensation part which calculates brightness information from red, green and blue data included in the data to be displayed at the panel defect area, and modulates the brightness information with the first compensation data, thereby modulating the data to be displayed at the panel defect area; a second compensation part which disperses the second compensation data to the boundary part to modulate the data to be displayed at the boundary part; a third compensation part which modulates data to be displayed at the link pixel with the third compensation data; and a driver for driving the display panel in use of the data modulated by the first to third compensation parts.

A picture quality controlling method of a flat panel display device according to an aspect of the present invention includes: determining a first compensation data for compensating data to be displayed at a panel defect area of a display panel, a second compensation data for compensating data to be displayed at a boundary part between the panel defect area and the non-defect area of the display panel, and a third compensation data for compensating data to be displayed at a link pixel where adjacent pixels are linked to each other in the display panel, by an inspection process and a repair process of the display panel; storing the first to third compensation data on a memory; modulating brightness information calculated from red, green and blue data to be displayed at the panel defect area, with the first compensation data, thereby modulating data to be displayed at the panel defect area; dispersing the second compensation data to the boundary part to modulate the data to be displayed at the boundary part, with the second compensation data; modulating the data to be displayed at the link pixel, with the third compensation data; and driving the display panel in use of the data modulated by the compensation data.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

With reference to FIGS. 7A to 28, embodiments of the present invention will be explained as follows. The following embodiments will be explained centering on a liquid crystal display device among flat panel display devices.

Figure 7A:
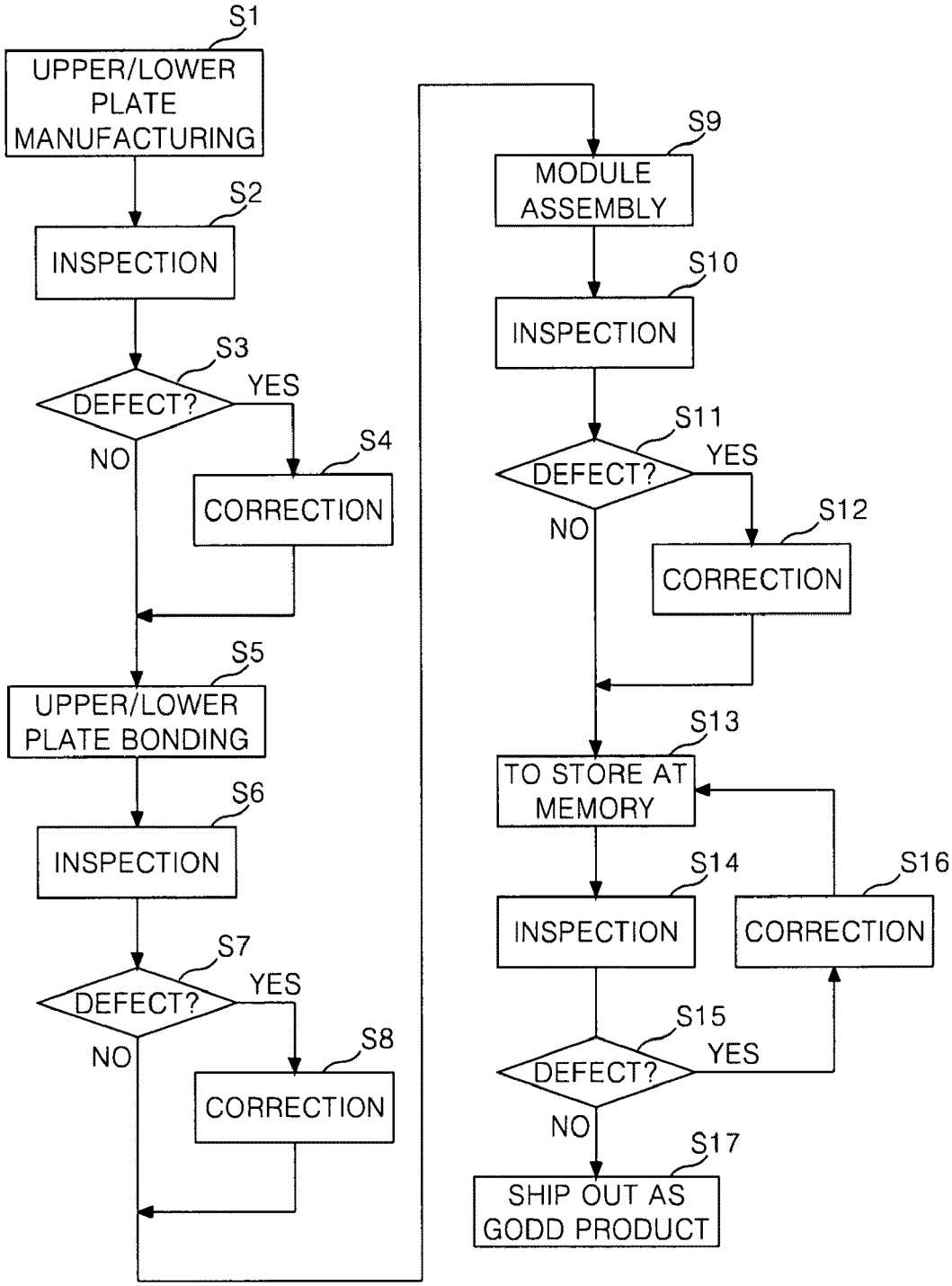
FIGS. 7A and 7B are diagrams representing a fabricating method of a flat panel display device according to the present invention.
Figure 7B:
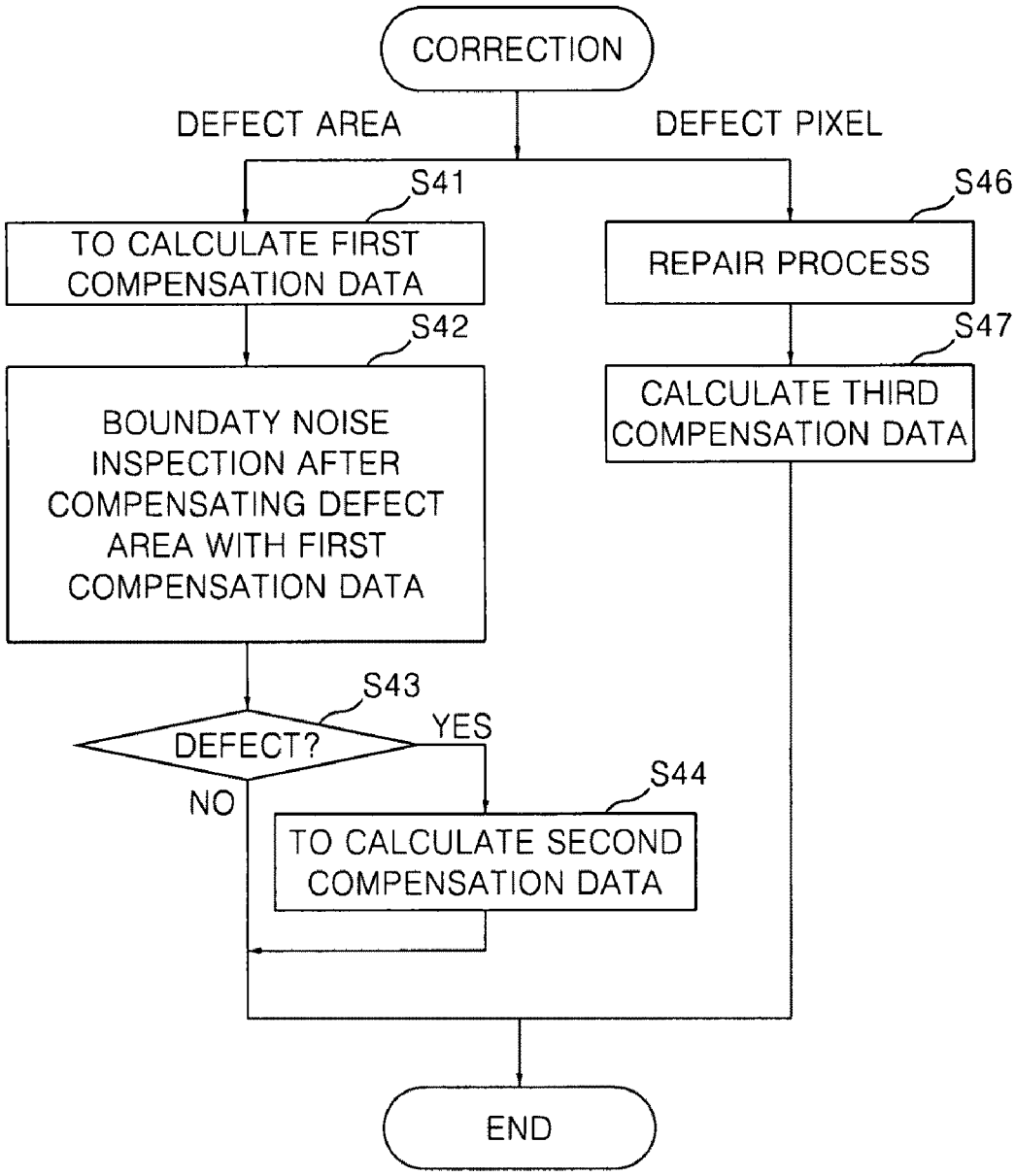

First of all, in reference to FIGS. 7A and 7B, a fabricating method of a liquid crystal display device according to an embodiment of the present invention will be described. FIGS. 7A and 7B are flow charts representing a fabricating method of a flat panel display device according to the present invention, step by step.

Referring to FIG. 7A, an upper substrate (color filter substrate) and a lower substrate (TFT array substrate) of a liquid crystal display panel are made respectively (S1). The step S1 includes a substrate cleaning process, a substrate patterning process, an alignment film forming/rubbing process and the like. In the substrate cleaning process, impurities on the surfaces of the upper and lower substrates are removed with a cleaning solution. In the upper substrate patterning process, there are formed a color filter, a common electrode, a black matrix and the like. In the lower substrate patterning process, signal lines such as a data line and a gate line are formed, a TFT is formed at the crossing part of the data line and the gate line, and a pixel electrode is formed at a pixel area defined by the crossing of the data line and the gate line. On the other hand, the lower substrate patterning process might include a process of forming an aperture pattern, in which a gate metal is removed from the gate line, or a dummy pattern used in the repair process to be described later.

Next, test data of each gray level are applied to the lower substrate of the display panel to display a test picture, and the panel defect is inspected by an electric/magnetic inspection for the picture (S2).

As the inspection result of the step S2, if the panel defect is not detected (NO of a step S3), the process advances to a step S5, and if the panel defect is detected (YES of the step S3), the presence or absence of the panel defect and the location information for a location or area where the panel defect appears are stored on an inspection computer and a correction for compensation the panel defect is carried out (S4).

Figure 8:
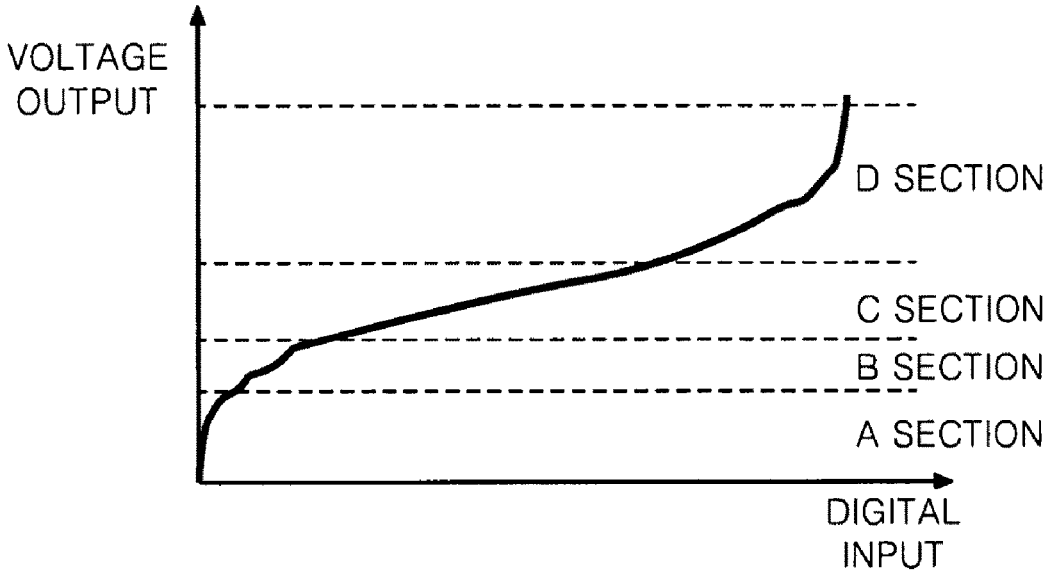
FIG. 8 is a diagram representing a gamma characteristic curve.

The correction of the step S4 is illustrated in more detail in FIG. 7B. Referring to FIG. 7B, in order to correct the brightness or chromaticity of the panel defect area, which is shown differently from that of the non-defect area, in the correction step S4, a first compensation data is calculated (S41). The first compensation data are different from a brightness difference or chromaticity difference between the panel defect area and the non-defect area in accordance with the display location of the panel defect area, thus the first compensation data should be optimized for each location. Further, the first compensation data should be optimized for each gray level in consideration of a gamma characteristic. FIG. 8 is a diagram representing a gamma characteristic curve inclusive of a plurality of gray level section. The compensation value might be determined for each gray level at each R, G, B pixel, or might be determined for each gray level section (A, B, C, D) inclusive of a plurality of gray levels, as shown in FIG. 8. For example, the compensation value might be determined to be an optimized value for each location such as '+1' at 'location 1', '−1' at 'location 2' and '0' at 'location 3', and might also be determined to be an optimized value for each gray level section such as '0' at 'gray level section A', '0' at 'gray level section B', '1' at 'gray level section C' and '1' at 'gray level section D'. Accordingly, the compensation value can be made different for each gray level at the same location, and can be made different for each location at the same gray level. The compensation value like this is determined to be the same value for each of R, G, B data when correcting the brightness, and is determined to be different for each of R, B data when correcting the color difference. For example, if red is seen more prominently in the panel defect area of a specific location than in the non-defect area, an R compensation value becomes lower than G, B compensation values.

Figure 9A:
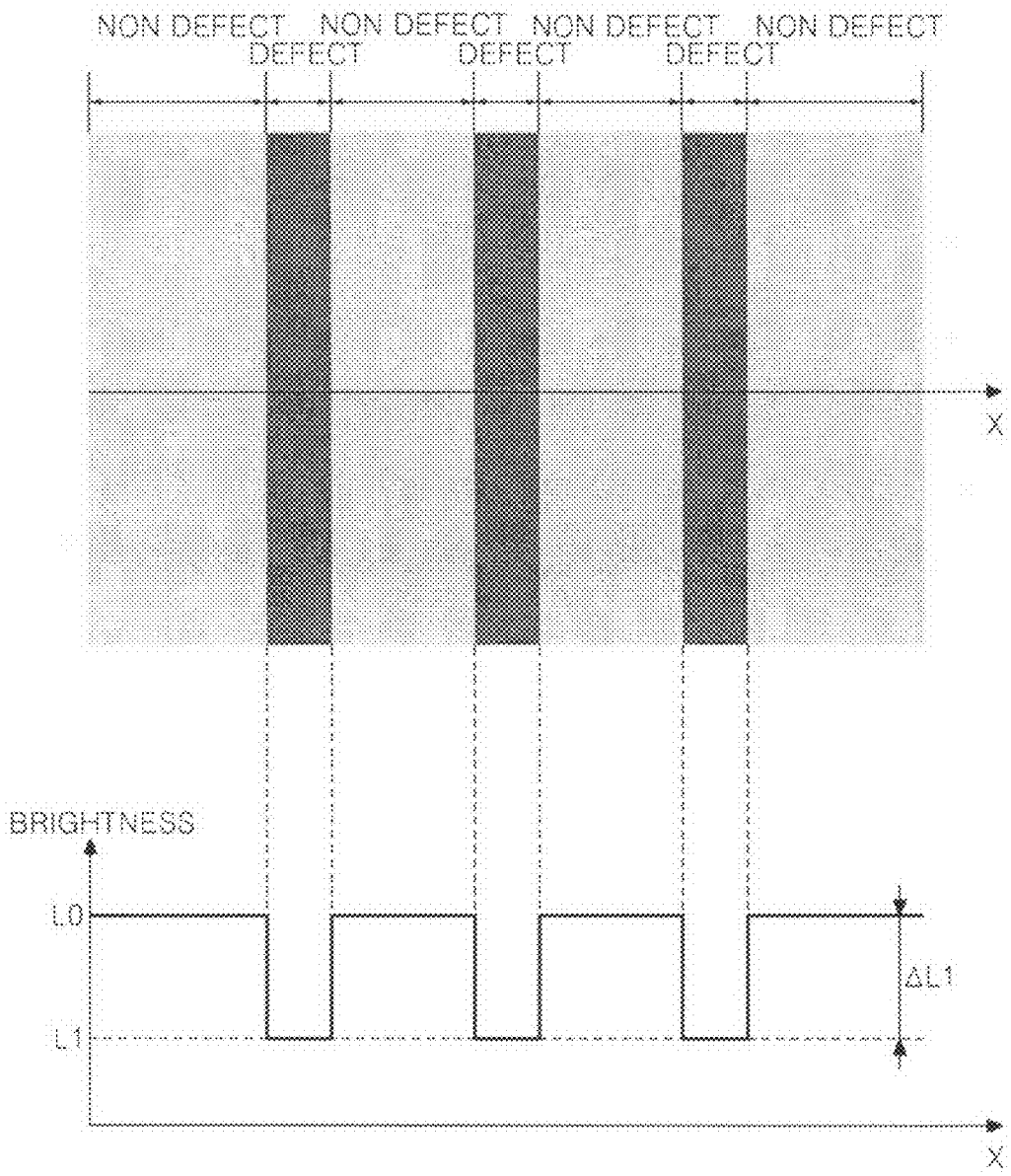
FIGS. 9A to 9E are diagrams for explaining a brightness characteristic which appears in a boundary part of a panel defect area and a non-defect area of the display panel.
Figure 9B:
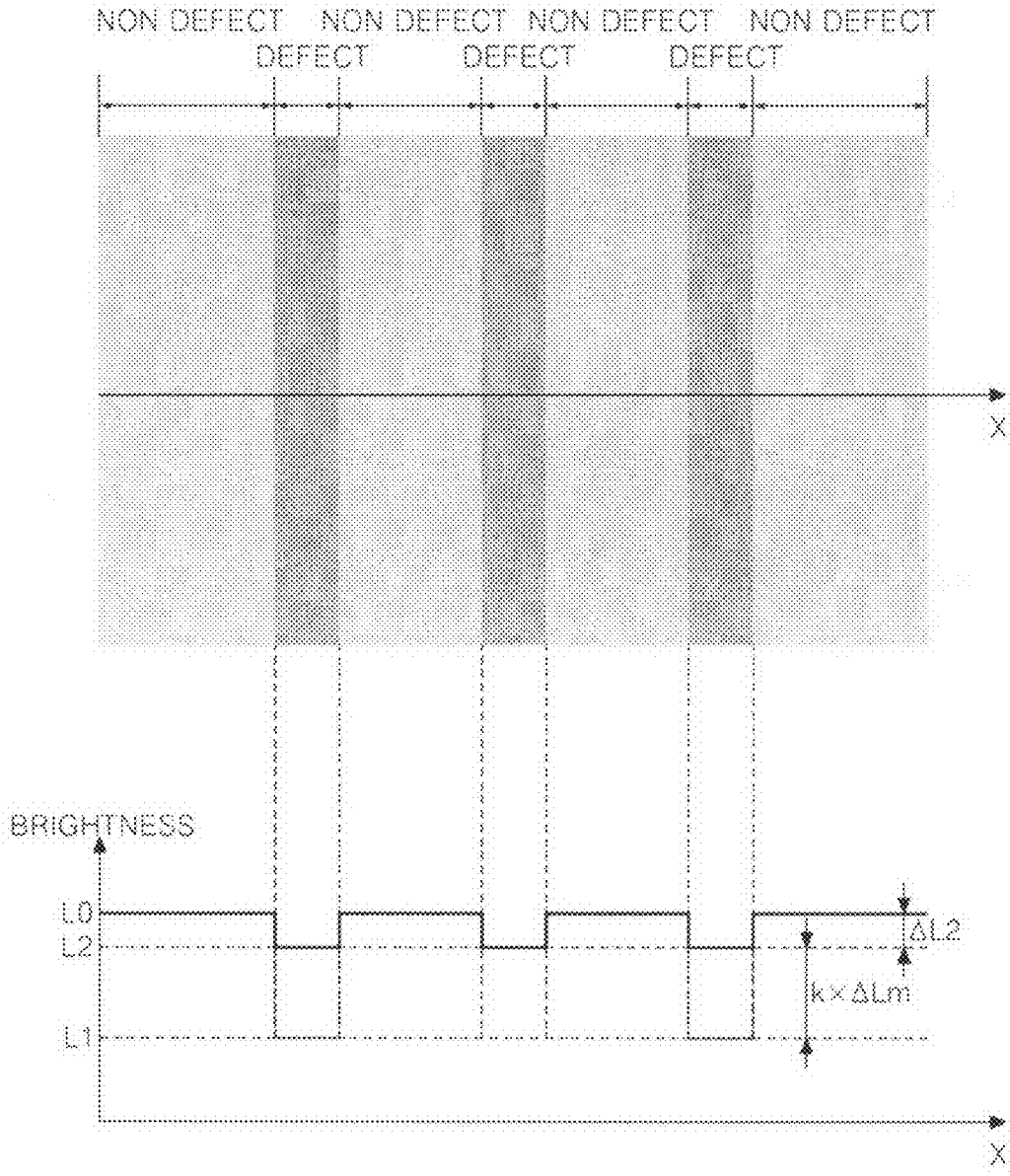
Figure 9C:
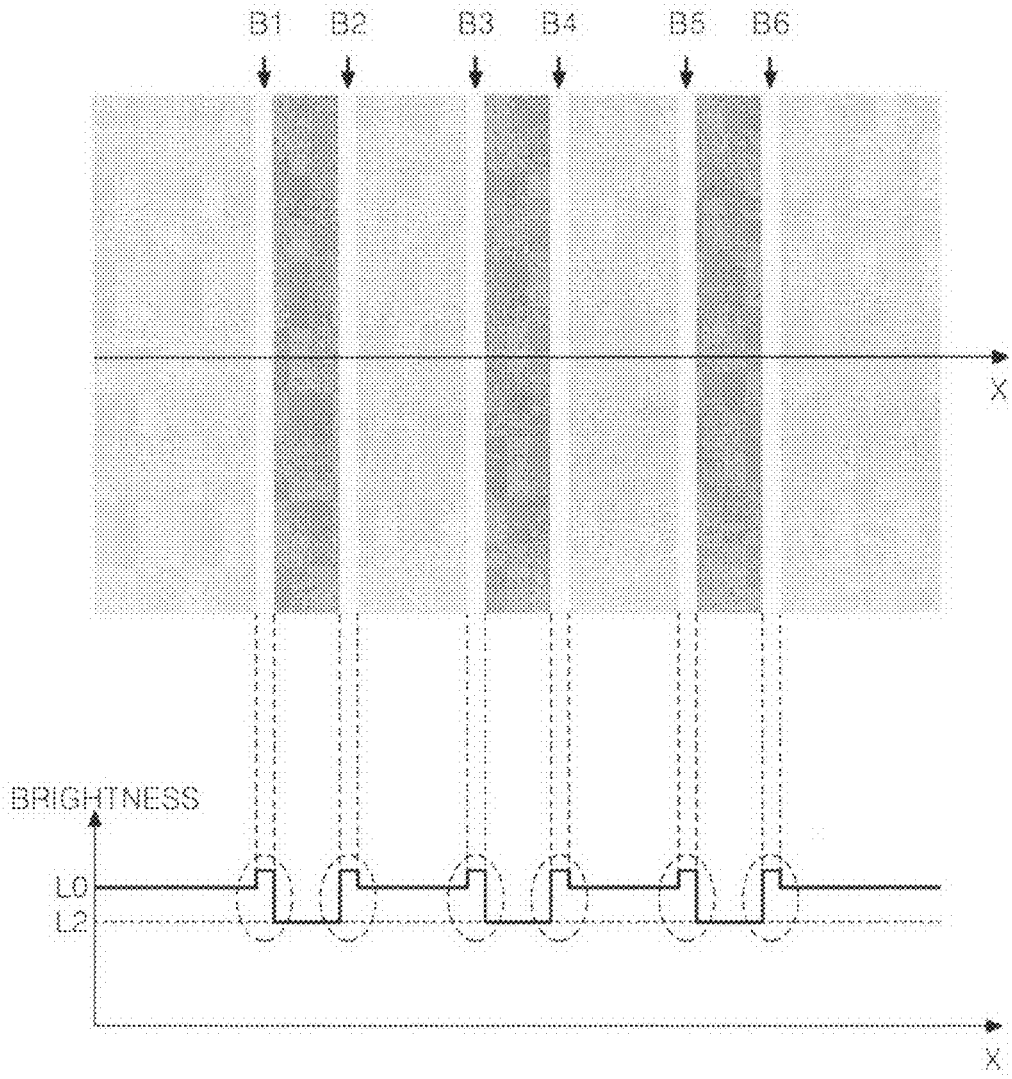
Figure 9D:
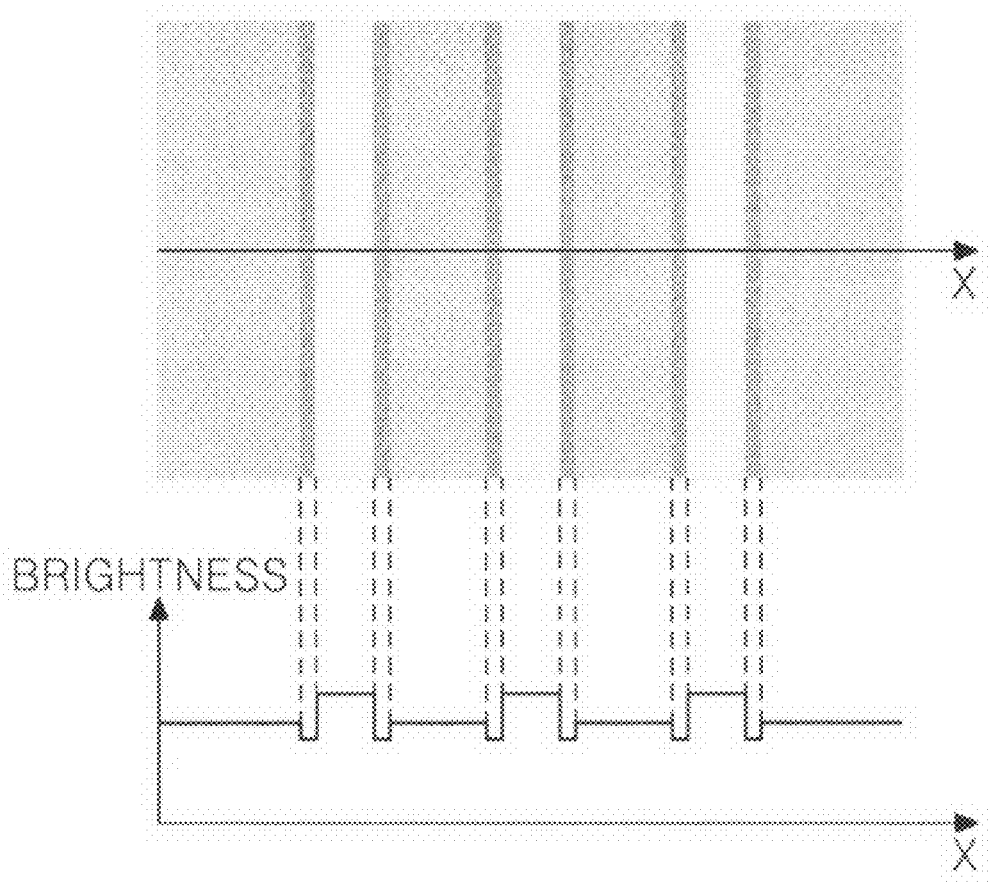
Figure 9E:
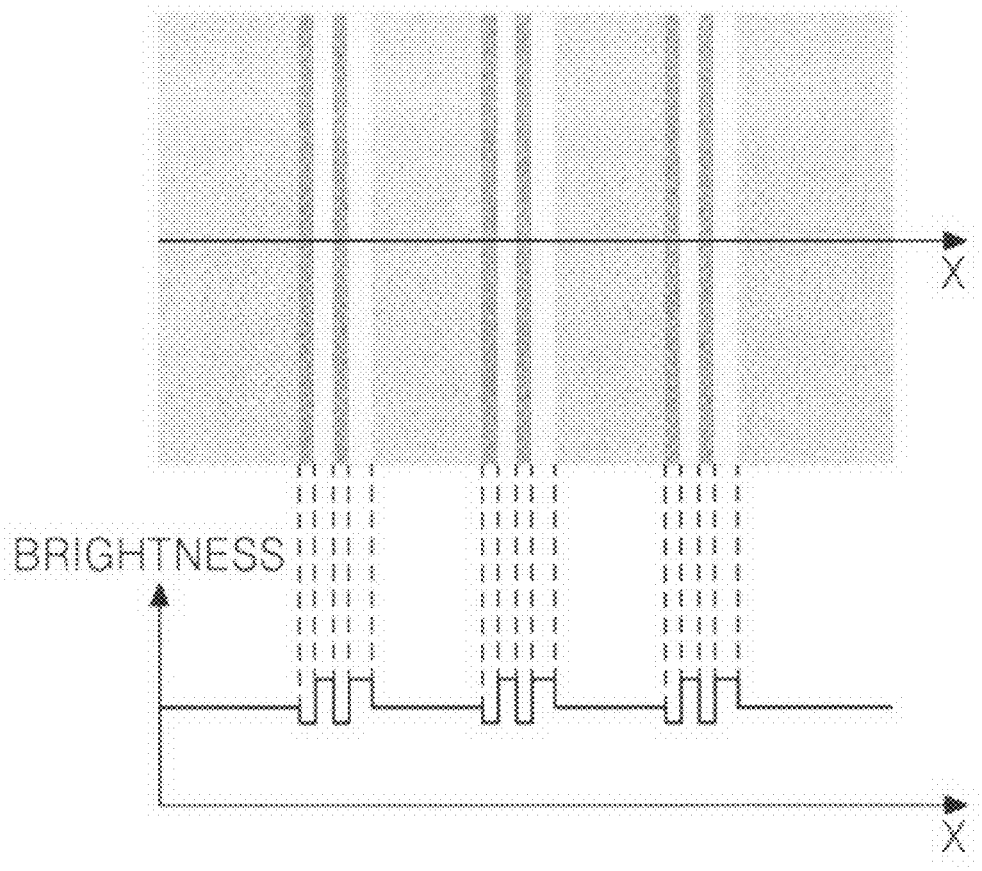

Subsequently, the test data are modulated in use of the first compensation data determined in the step S41, and the modulated test data are applied to the lower substrate to inspect a boundary noise by the electric/magnetic inspection (S42). That is to say, the test data to be supplied to the panel defect area are modulated in use of the first compensation data to correct the brightness or color difference of the panel defect area, and the boundary noise inspection is performed for the boundary part of the non-defect area and the panel defect area of which the brightness or color difference is corrected (S42). Herein, the boundary part is defined to include a boundary line between the panel defect area and the non-defect area, and a designated area inclusive of the vicinity of the boundary line. The boundary noise is that in the boundary part appears a different brightness from the brightness of the non-defect area and the brightness of the panel defect area when the data of the same gray level is supplied to the panel. For example, as shown in FIG. 9A, it is assumed that there is a panel defect area having a brightness difference as much as ΔL1 in comparison with a non-defect area when the brightness measured in the non-defect area of the display panel is L0. In this case, if a minimum brightness gap between gray levels which can be displayed by the liquid crystal display device on the basis of the gray level value of the data or a minimum increase or decrease amount of brightness by a circuit compensation made by the data modulation is assumed to be 'ΔLm', as shown in FIG. 9B, the brightness of the panel defect area becomes close to L0 by as much as k×ΔLm (k is an arbitrary integer) by the data modulation in use of the first compensation data, thus the brightness difference between the panel defect area and the non-defect area is reduced to ΔL2 (but, $0 \leqq \Delta L2 \leqq \Delta Lm$). However, even though the first compensation data is almost perfectly determined to be the compensation value so as for the brightness of the panel defect area to be as close as possible or identical to the brightness of the non-defect area, as shown in FIGS. 9C and 9D, there might be a phenomenon that the brightness is abnormally increased or decreased in the boundary part B1 to B6 of the panel defect area and the non-defect area, i.e., a case that the boundary noise is generated. Accordingly, as an inspection result of the boundary part by the step S42, if the boundary noise is not detected (YES of the step S43), the correction operation is ended. But, if the boundary noise is detected (NO of the step S43), the presence or absence of the boundary noise and the location information for the area where the boundary noise appears are stored on an inspection computer, and a second compensation data for compensating the boundary noise is calculated (S44). At this moment, the second compensation data is also desirable to be optimized for each gray level and for each location in the same manner as the first compensation data. On the other hand, the boundary noise can be shown in a complex noise pattern, as shown in FIG. 9E, other than the noise pattern shown in FIGS. 9C and 9D. On the other hand, ΔLm might have a different value for each liquid crystal display device in accordance with various picture processing techniques or a data processing capacity of a drive circuit of the liquid crystal display device. For example, ΔLm in the liquid crystal display device having a drive circuit of 6-bit processing capacity has a different value from ΔLm in the flat panel display device having a drive circuit of 8-bit processing capacity, and ΔLm values might be different even between the flat panel display devices in accordance with whether or not the picture processing technique is applied.

Figure 10:
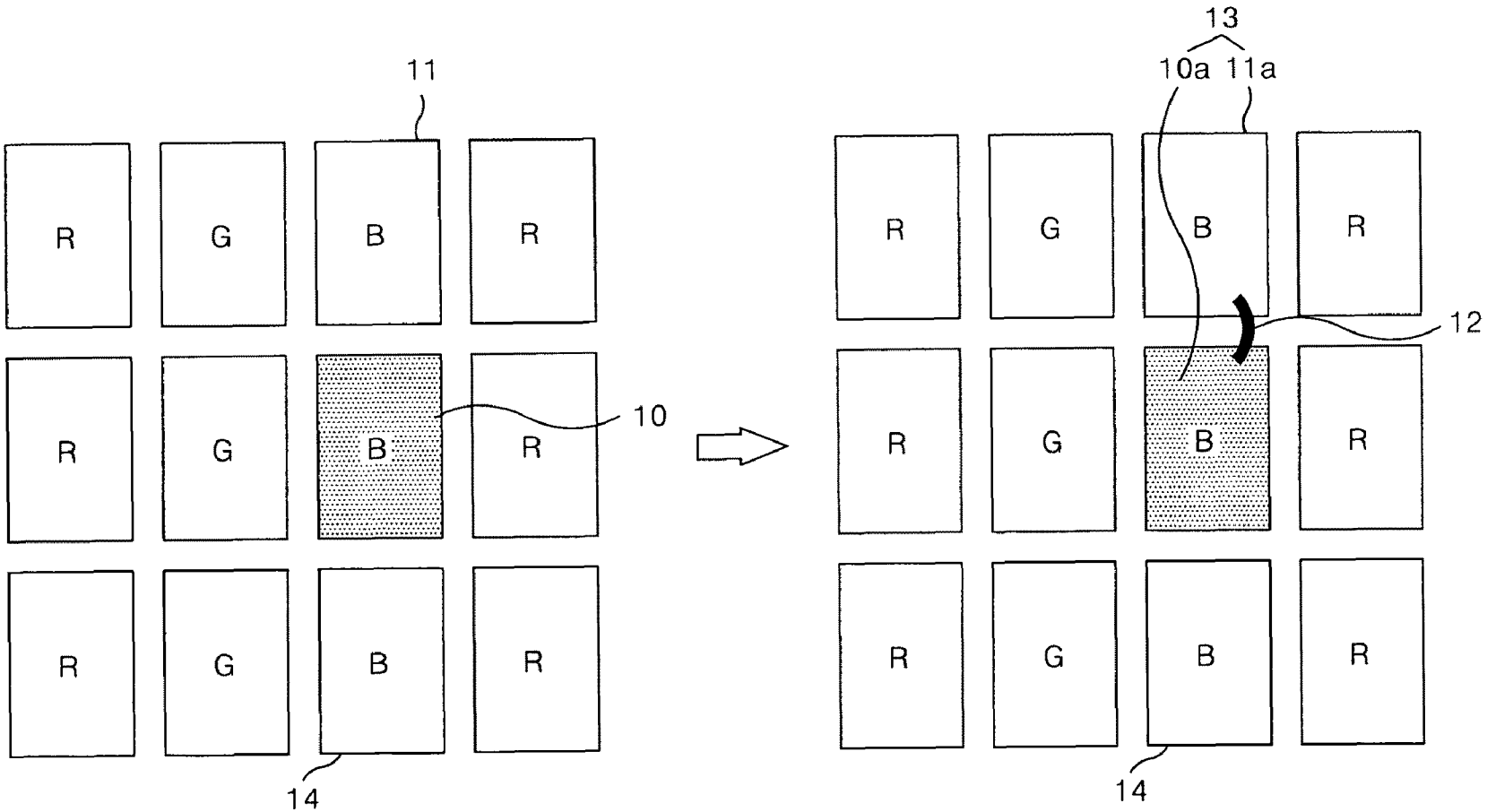
FIG. 10 is a diagram for briefly explaining a repair process according to an embodiment of the present invention.

Subsequently, at the same time as the steps S41 to S44 or before or after the steps S41 to S44, a repair process is carried out for the pixel defect (S46). FIG. 10 is a diagram illustrating an example of a repair process according to the present invention. From the repair process shown in FIG. 10, it can be known that a defect pixel 10 and a normal pixel 11 are electrically connected through a conductive link pattern 12 to form a link pixel 13, thereby performing the repair process. After the repair process, a third compensation data for compensating a charge characteristic of the link pixel 13 is calculated (S47).

As described above, the repair process S46 is performed by a method of electrically shorting or linking the defect pixel 10 and the normal pixel 11 which is adjacent thereto and has the same color as the defect pixel 10. The repair process S46 includes a process of blocking a path through which a data voltage is supplied to a pixel electrode of the defect pixel 10 and a process of electrically shorting or linking the normal pixel 11 and the defect pixel 10 in use of the conductive link pattern 12. A detail description for the repair process S46 will be made later. On the other hand, the linked defect pixel 10A in the link pixel 13 where the defect pixel 10 and the normal pixel 11 are electrically connected is charged with the same data voltage as the linked normal pixel 11A, when the data voltage is charged. But, the link pixel 13 has a different charge characteristic from the normal pixel 14 which is not linked, because the charges are supplied to the pixel electrodes included in two pixels 10A, 11A through one thin film transistor TFT. For example, assuming that the same data voltage is supplied to the link pixel 13 and the normal pixel 14 which is not linked, the charges are divided into the two pixels 10A, 11A in the link pixel 13, thus the amount of charge thereof becomes less than the normal pixel 14 which is not linked. As a result thereof, if the same data voltage is applied to the link pixel 13 and the unlinked normal pixel 14, the link pixel 13 is made to appear brighter than the unlinked normal pixel 14 in a normally white mode. On the other hand, the link pixel 13 is made to appear darker than the unlinked normal pixel 14 in a normally black mode. In the normally white mode, the transmittance or gray level is increased as the data voltage becomes lower. And, in the normally black mode, the transmittance or gray level is increased as the data voltage becomes higher.

Generally, a liquid crystal display device of a twisted nematic mode (hereinafter, referred to as "TN mode") is driven in a in a normally white mode. In the TN mode liquid crystal display device, a pixel electrode and a common electrode of the liquid crystal cell are separately formed on two substrates which face each other with a liquid crystal therebetween and a vertical electric field is applied between the pixel electrode and the common electrode, on the contrary, a liquid crystal display device of an in-plane switching mode (hereinafter, referred to as "IPS mode") is driven in a normally black mode. In the IPS mode liquid crystal display device, the pixel electrode and the common electrode of the liquid crystal cell are formed on the same substrate and a horizontal electric field is applied between the pixel electrode and the common electrode.

After the repair process S46, the presence or absence of the link pixel 13 and the location information thereof are stored on an inspection computer, and a third compensation data for compensating the charge characteristic of the link pixel 13 is calculated S47. At this moment, the charge characteristic of the link pixel 13 is different from the unlinked normal pixel 14 in the extent of the brightness difference or color difference in accordance with the location of the link pixel 13, thus the third compensation data is also desirable to be optimized for each location and for each gray level in the same manner as the first and second compensation data.

Hereinafter, in reference to FIGS. 11A to 14, various embodiments of a repair process according to the present invention will be explained.

Figure 11A:
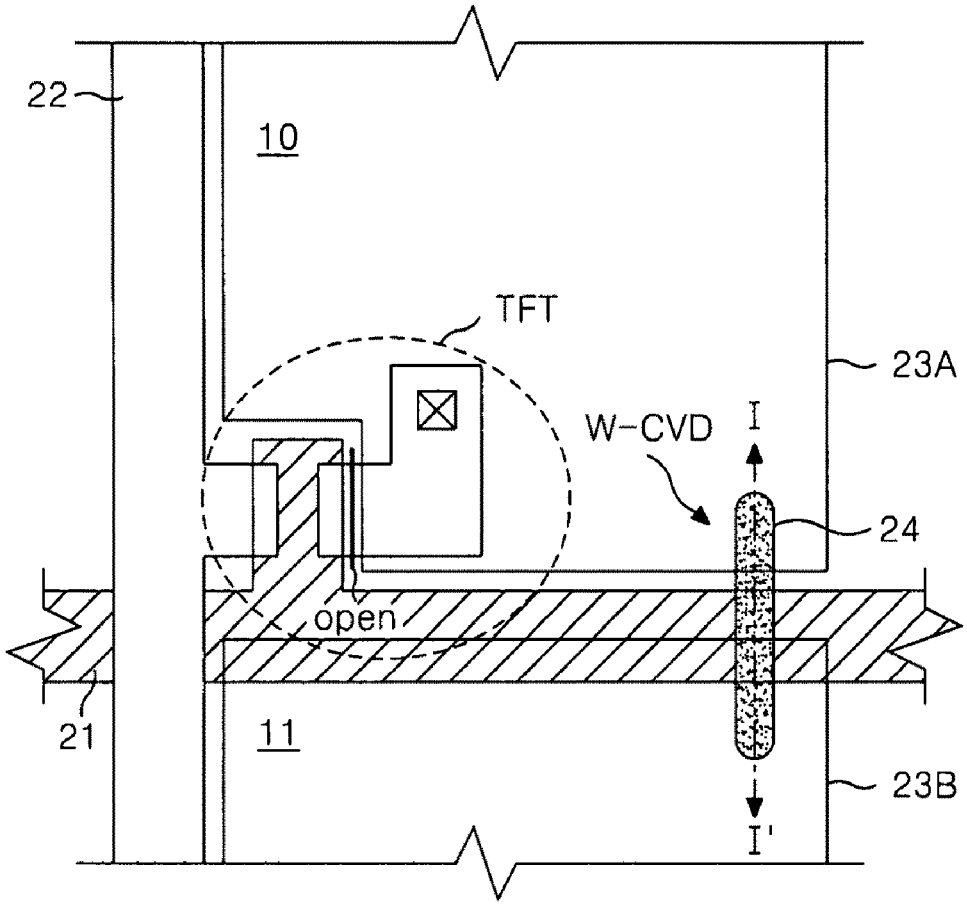
FIGS. 11A to 11C are diagrams illustrating an example of a repair process of a liquid crystal display device of a TN mode according to the present invention.
Figure 11B:
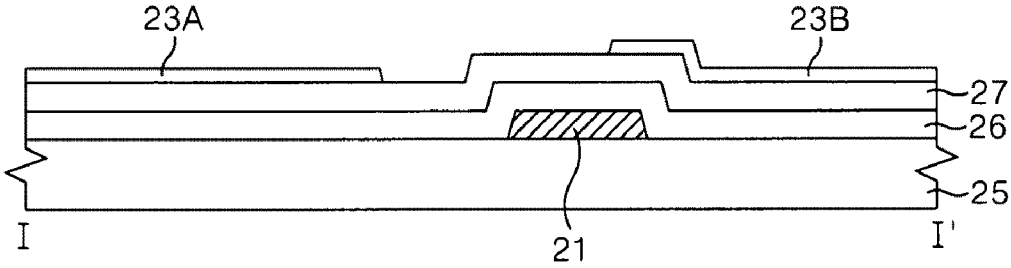
Figure 11C:
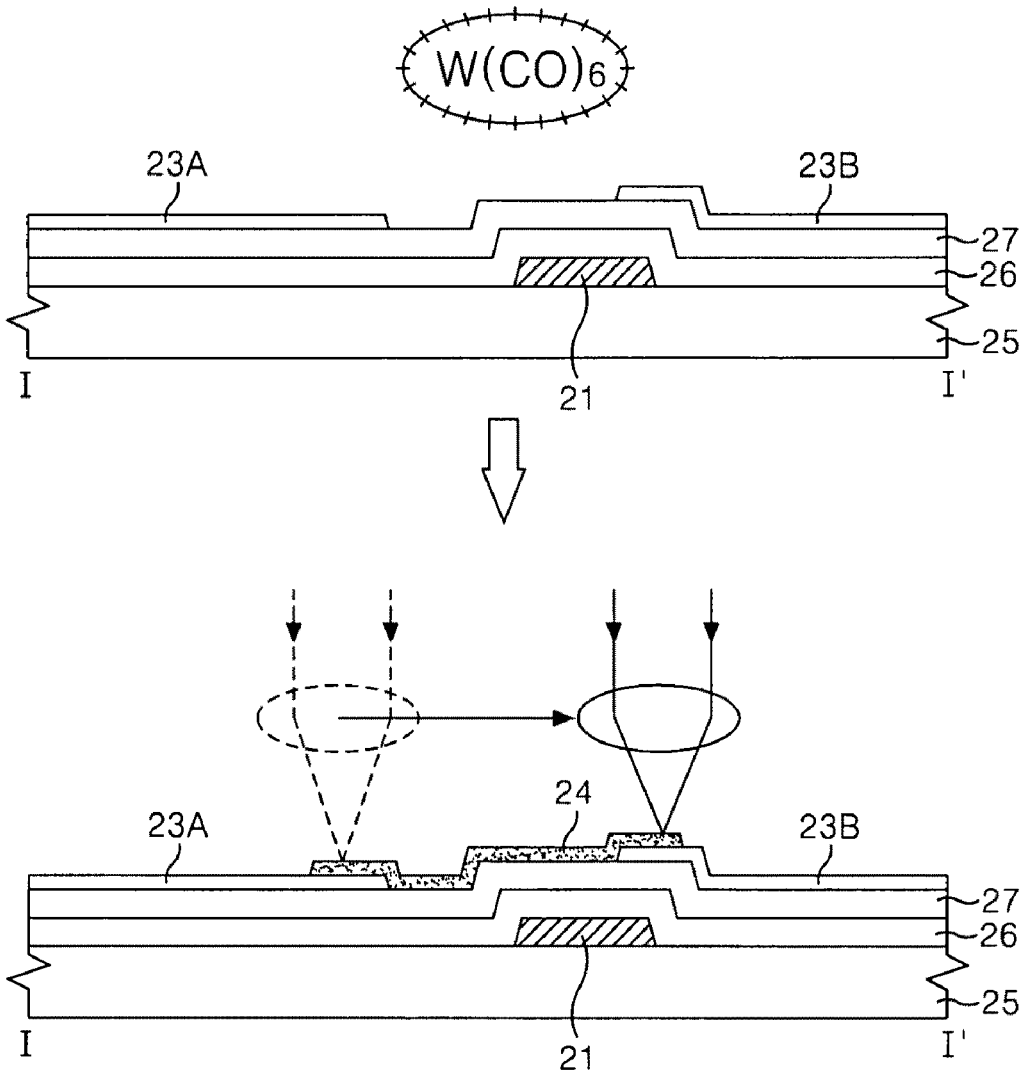

FIGS. 11A to 11C represent an example of a repair process of a liquid crystal display device of a TN mode according to the present invention.

Referring to FIGS. 11A and 11B, the repair process according to the present invention directly forms a link pattern 24 in a pixel electrode 23A of the defect pixel 10 and a pixel electrode 23B of the normal pixel 11, which are adjacent to each other, by a W-CVD (tungsten-chemical vapor deposition) process.

On a lower substrate 25, a gate line 21 and a data line 22 cross each other and a thin film transistor TFT is formed at the crossing part thereof. A gate electrode of the TFT is electrically connected to the gate line 21 and a source electrode thereof is electrically connected to the data line 22. And, a drain electrode of the TFT is electrically connected to the pixel electrodes 23A, 23B through a contact hole.

A gate metal pattern inclusive of the gate line 21, the gate electrode of the TFT and the like is formed on the lower substrate 25 by a deposition process of a gate metal such as aluminum Al, aluminum neodymium AlNd and the like, a photolithography process and an etching process.

A source/drain metal pattern inclusive of the data line 22, the source and drain electrodes of the TFT and the like is formed on a gate insulating film 26 by a deposition process of a source/drain metal such as chrome Cr, molybdenum Mo, titanium Ti and the like, a photolithography process and an etching process.

The gate insulating film 26 for electrically insulating the gate metal pattern from the source/drain metal pattern is formed of an inorganic insulating film such as silicon nitride SiNx, silicon oxide SiOx or the like. And, a passivation film covering the TFT, the gate line 21 and the data line 22 is formed of an inorganic insulating film or an organic insulating film.

The pixel electrodes 23A, 23B are formed on the passivation film 27 by a process of depositing a transparent conductive metal such as ITO (indium tin oxide), TO (tin oxide), IZO (indium zinc oxide), ITZO (indium tin zinc oxide) or the like, a photolithography process and an etching process. A data voltage from the data line 22 is supplied to the pixel electrodes 23A, 23B through the TFT for a scan period when the TFT is turned on.

The repair process is performed for the lower substrate before the substrate bonding/liquid crystal injecting process. The repair process firstly includes a step of opening a current path between the source electrode of the TFT and the data line 22 or between the drain electrode of the TFT and the pixel electrode 23A by a laser cutting process in order to block the current path between the pixel electrode 23A of the defect pixel 10 and the data line 22. Further, the repair process includes a step of forming a link pattern 24 between the pixel electrode 23A of the defect pixel 10 and the pixel electrode 23B of the normal pixel 11, which is adjacent thereto and has a color identical thereto, by directly depositing tungsten W on the passivation film 27 between the pixel electrodes 23A, 23B in use of the W-CVD process. On the other hand, the order of the wire breaking process and the W-CVD process can be interchanged.

The W-CVD process includes a step of condensing a laser light on any one of the pixel electrodes 23A and 23B under an atmosphere of $W(CO)_6$ and moving or scanning the condensed laser light to another pixel electrode, as shown in FIG. 11C. The tungsten W is separated from the $W(CO)_6$ by the laser light and the tungsten W is deposited on one end of the pixel electrode 23A, an exposure part of the passivation film 27 and one end of the pixel electrode 23B along a scan direction of the laser light.

Figure 12A:
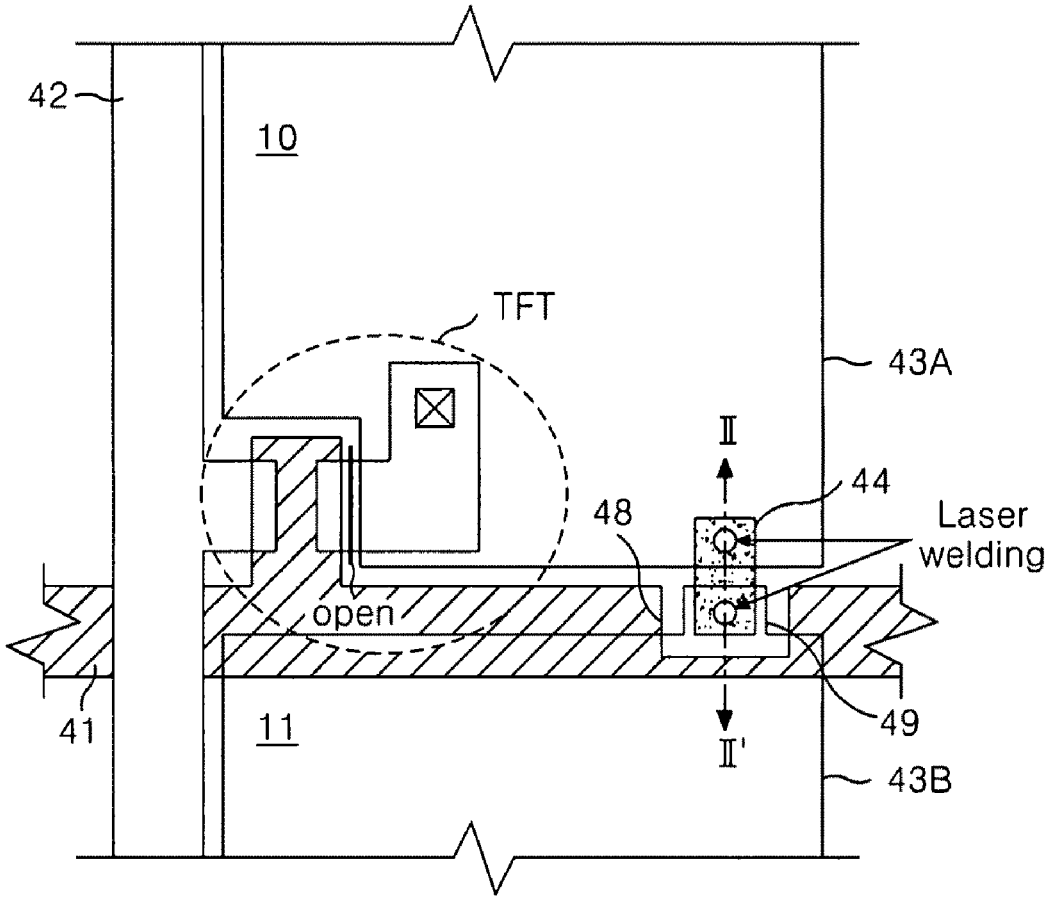
FIGS. 12A to 12C are diagrams illustrating another example of the repair process of the liquid crystal display device of the TN mode according to the present invention.
Figure 12B:
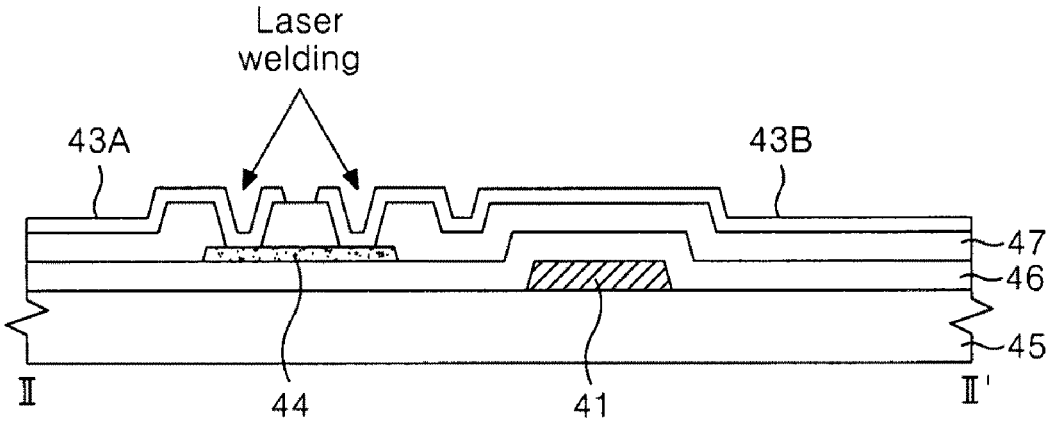
Figure 12C:
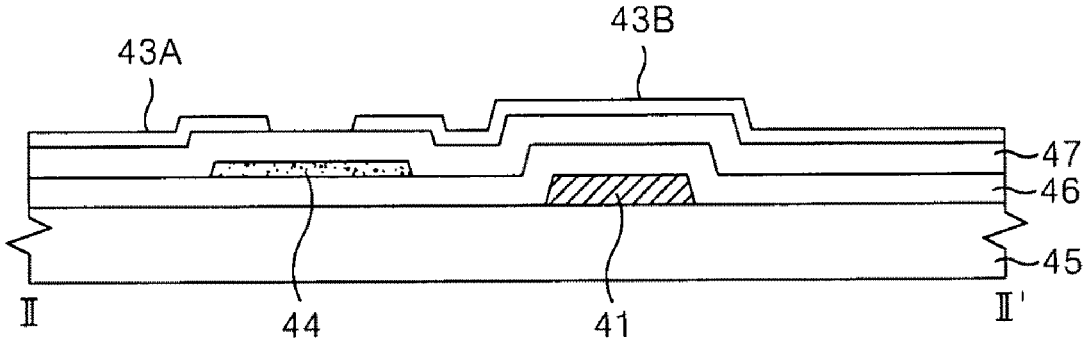

FIGS. 12A to 12C represent another example of a repair process of a liquid crystal display device of a TN mode according to the present invention.

Referring to FIGS. 12A and 12B, the lower substrate 45 of the liquid crystal display device according to the present invention includes a conductive dummy pattern 44 that overlaps a part of a pixel electrode 43A of the defect pixel 10 and a part of a pixel electrode 43B of the normal pixel 11, which are adjacent thereto, with a passivation film 47 therebetween.

On a lower substrate 45, a gate line 41 and a data line 42 cross each other and a thin film transistor TFT is formed at the crossing part thereof. A gate electrode of the TFT is electrically connected to the gate line 41 and a source electrode is electrically connected to the data line 42. And, a drain electrode of the TFT is electrically connected to the pixel electrodes 43A and 43B through a contact hole.

A gate metal pattern inclusive of the gate line 41, the gate electrode of the TFT and the like is formed on the lower substrate 45 by a gate metal deposition process, a photolithography process and an etching process.

The gate line 41 includes a concave pattern 48 which is not overlapped with the dummy pattern to be formed in the following process, but can encompass the dummy pattern 44.

A source/drain metal pattern inclusive of the data line 42, the source and drain electrodes of the TFT, the dummy pattern 44 and the like is formed on a gate insulating film 46 by a source/drain metal deposition process, a photolithography process and an etching process.

The dummy pattern 44 is formed to be an island pattern, which is not connected to the gate line 41, the data line 42 and the pixel electrodes 43A and 43B, before the repair process. Both ends of the dummy pattern 44 are connected to the pixel electrodes 43A and 43B respectively by a laser welding process so as to overlap the adjacent pixel electrodes 43A and 43B.

The gate insulating film 46 electrically insulates the gate metal pattern from the source/drain metal pattern, and the passivation film 47 electrically insulates the source/drain metal pattern from the pixel electrodes 43A and 43B.

The pixel electrodes 43A and 43B are formed on the passivation film 47 by a process of depositing a transparent conductive metal, a photolithography process and an etching process. The pixel electrodes 43A and 43B each include an extension part 49 which is extended from one side of an upper part. The pixel electrodes 43A and 43B are sufficiently overlapped with one end of the dummy pattern 44 by the extension part 49. A data voltage from the data line 42 is supplied to the pixel electrodes 43A and 43B through the TFT for a scan period while the TFT is turned on.

The repair process is performed for the lower substrate before the substrate bonding/liquid crystal injecting process or for a panel after the substrate bonding/liquid crystal injecting process. The repair process firstly includes a step of opening a current path between the source electrode of the TFT and the data line 42 or between the drain electrode of the TFT and the pixel electrode 43A by a laser cutting process in order to block the current path between the pixel electrode 43A of the defect pixel 10 and the data line 42. Further, the repair process includes a step of irradiating a laser beam onto the pixel electrodes 43A and 43B which are adjacent to both ends of the dummy pattern 44 in use of the laser welding process, as shown in FIG. 12B. Then, the pixel electrodes 43A and 43B and the passivation film 47 are melted by the laser light, and as a result, the pixel electrodes 43A and 43B are connected to the dummy pattern 44. On the other hand, the order of the wire breaking process and the laser welding process can be interchanged. FIG. 12C shows the pixel electrodes 43A and 43B and the dummy pattern 44 which are electrically separated by the passivation film 47 before the laser welding process.

Figure 13A:
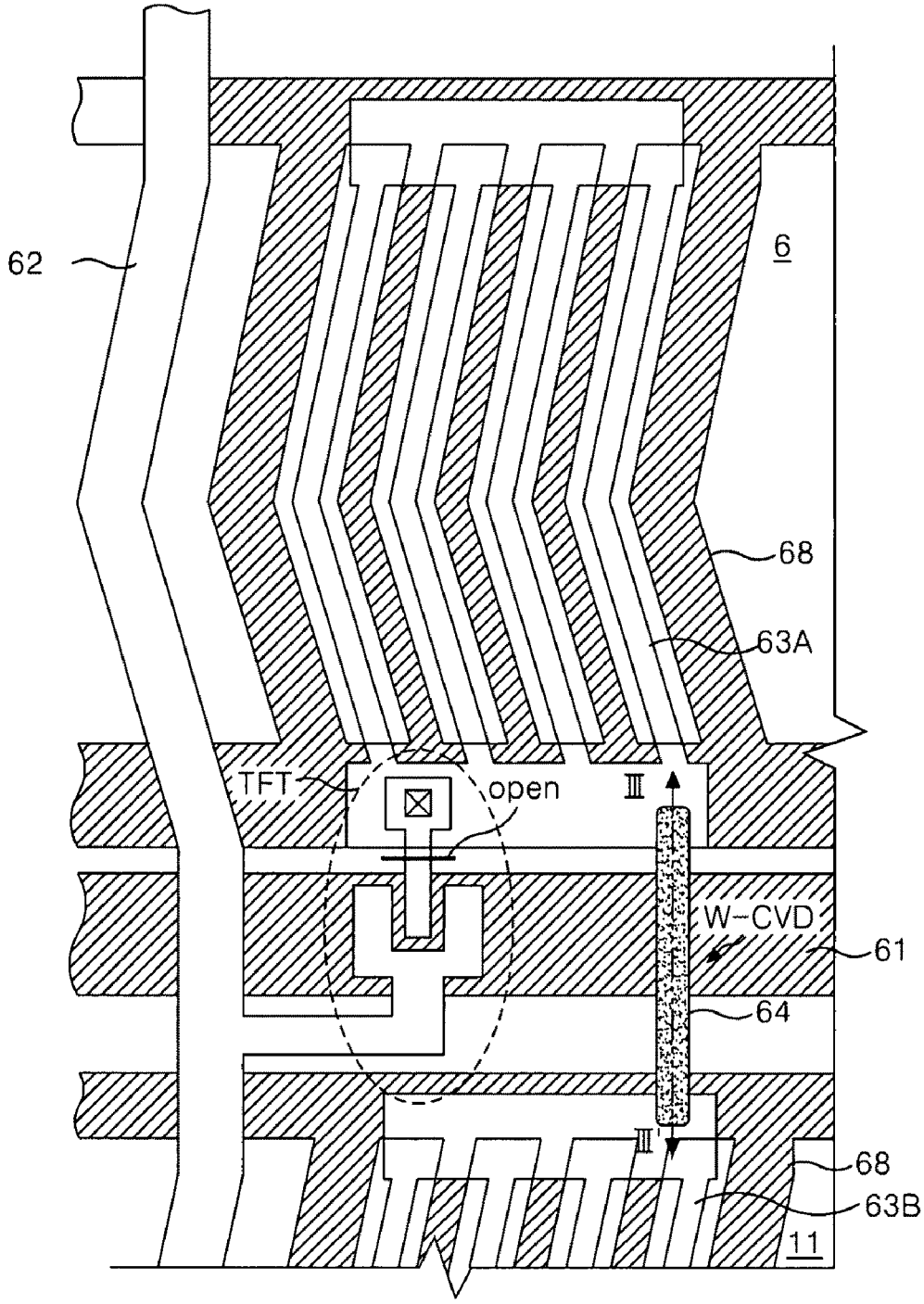
FIGS. 13A to 13B are diagrams illustrating an example of a repair process of a liquid crystal display device of an IPS mode according to the present invention.
Figure 13B:
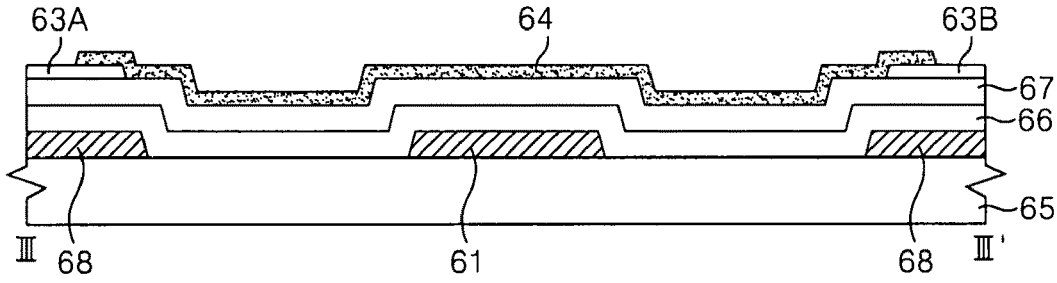

FIGS. 13A and 13B represent an example of a repair process of a liquid crystal display device of an IPS mode according to the present invention.

Referring to FIGS. 13A and 13B, a repair process according to the present invention includes a step of directly forming a link pattern 64 on a pixel electrode 63A of the defect pixel 10 and a pixel electrode 63B of the normal pixel 11, which are adjacent thereto, in use of a W-CVD process.

On a lower substrate 65, a gate line 61 and a data line 62 cross each other and a thin film transistor TFT is formed at the crossing part thereof. A gate electrode of the TFT is electrically connected to the gate line 61 and a source electrode thereof is electrically connected to the data line 62. And, a drain electrode of the TFT is electrically connected to the pixel electrodes 63A and 63B through a contact hole.

A gate metal pattern inclusive of the gate line 61, the gate electrode of the TFT, a common electrode 68 and the like is formed on the lower substrate 65 by a gate metal deposition process, a photolithography process and an etching process. The common electrode 68 is connected all liquid crystal cells to apply common voltages Vcom to the liquid crystal cells. A horizontal electric field is applied to the liquid crystal cells by the common voltage Vcom applied to the common electrode 68 and the data voltage applied to the pixel electrodes 63A and 63B.

A source/drain metal pattern inclusive of the data line 62, the source and drain electrodes of the TFT and the like is formed on a gate insulating film 66 by a source/drain metal deposition process, a photolithography process and an etching process.

The pixel electrodes 63A and 63B are formed on a passivation film 67 by a process of depositing a transparent conductive metal, a photolithography process and an etching process. A data voltage from the data line 62 is supplied to the pixel electrodes 63A and 63B through the TFT for a scan period when the TFT is turned on.

The repair process is performed for the lower substrate before the substrate bonding/liquid crystal injecting process. The repair process firstly includes a step of opening a current path between the source electrode of the TFT and the data line 62 or between the drain electrode of the TFT and the pixel electrode 63A by a laser cutting process in order to block the current path between the pixel electrode 63A of the defect pixel 10 and the data line 62. Subsequently, the repair process includes a step of forming a link pattern 64 between the pixel electrode 63A of the defect pixel 10 and the pixel electrode 63B of the normal pixel 11, which is adjacent thereto and has a color identical thereto, by directly depositing tungsten W on the passivation film 67 between the pixel electrodes 63A and 63B in use of the W-CVD process. On the other hand, the order of the wire breaking process and the W-CVD process can be interchanged.

Figure 14A:
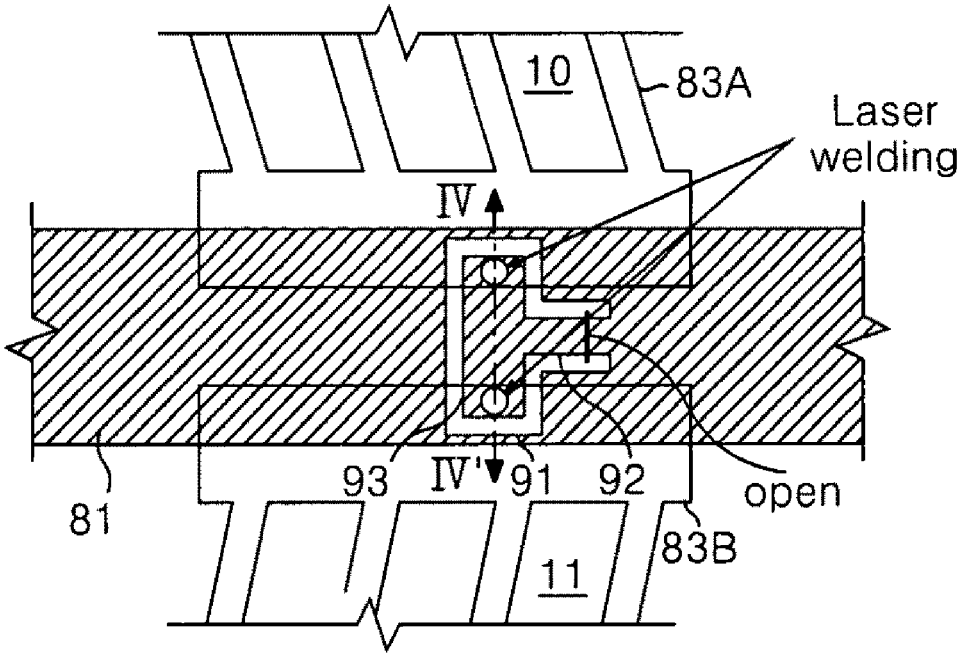
FIGS. 14A to 14C are diagrams illustrating another example of the repair process of the liquid crystal display device of the IPS mode according to the present invention.
Figure 14B:
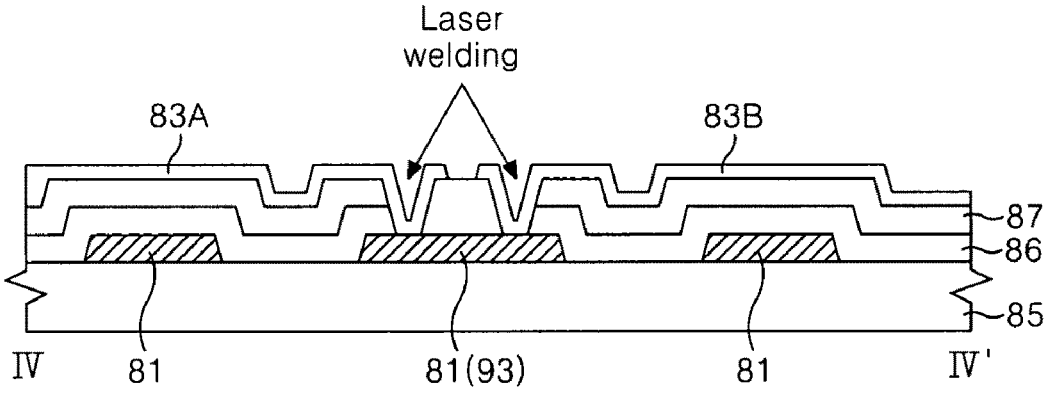
Figure 14C:
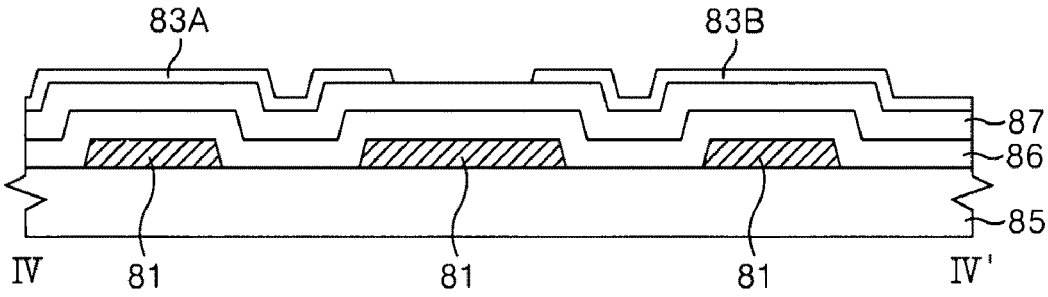

FIGS. 14A to 14C represent another example of a repair process of a liquid crystal display device of an IPS mode according to the present invention. In FIGS. 14A to 14C, the data metal pattern such as the data line and the like; the TFT; the common electrode for applying the horizontal electric field to the liquid crystal cells together with the pixel electrode; and the like are omitted.

Referring to FIGS. 14A and 14B, a gate line 81 of the liquid crystal display device according to the present invention includes a neck part 92; a head part 93 which is connected to the neck part 92 and of which the area is expanded; and an aperture pattern 91 which is removed in a 'C' shape around the neck part 92 and the head part 93.

A gate metal pattern inclusive of the gate line 81, the gate electrode of the TFT (not shown), a common electrode and the like is formed on a glass substrate 85 by a gate metal deposition process, a photolithography process and an etching process.

The pixel electrodes 83A and 83B are formed on a passivation film 87 by a process of depositing a transparent conductive metal, a photolithography process and an etching process.

In the gate line 81, the neck part 92 is opened by the laser cutting process in the repair process. One end of the head part 93 overlaps the pixel electrode 83A of the defect pixel 10 with a gate insulating film 86 and a passivation film 87 therebetween, and the other end of the head part 93 overlaps the pixel electrode 83B of the normal pixel 11, which is adjacent to the defect pixel 10, with the gate insulating film 86 and the passivation film 87 therebetween.

The repair process is performed for the lower substrate before the substrate bonding/liquid crystal injecting process or a panel after the substrate bonding/liquid crystal injecting process. The repair process includes a step of opening a current path between the source electrode of the TFT and the data line or between the drain electrode of the TFT and the pixel electrode 83A by a laser cutting process in order to block the current path between the pixel electrode 83A of the defect pixel and the data line, and a step of opening the neck part of the gate line 81. Further, the repair process includes a step of irradiating a laser beam onto the pixel electrodes 83A and 83B which are adjacent to both ends of the head part 93 in use of the laser welding process, as shown in FIG. 14B. Then, the pixel electrodes 83A and 83B, the passivation film 87 and the gate insulating film 86 are melted by the laser light, and as a result, the head part 93 becomes an independent pattern to be separated from the gate line 81 and the pixel electrodes 83A and 83B are connected to the head part 93. On the other hand, the order of the wire breaking process and the laser welding process can be interchanged. FIG. 14C shows the pixel electrodes 83A and 83B and the head part 93 which are electrically separated by the passivation film 87 and the gate insulating film 86 before the laser welding process.

The repair process according to the present invention removes the neck part 93 in advance in the patterning process of the gate line 81 to form the independent pattern such as the dummy pattern 44 of FIG. 12A, thereby making it possible to omit the cutting process of the neck part 93 in the repair process.

On the other hand, the dummy pattern 44 of FIG. 12A, or the head part 93, the neck part 92 and the aperture pattern 91 of FIG. 14A can be formed by one per pixel as in the foregoing embodiments, or they can be formed by a plural number per pixel for reducing the electrical contact characteristic, i.e., the contact resistance, of the link pixels.

Referring to FIG. 7, subsequently to the foregoing step S3 or S4, the upper/lower substrates are bonded together in use of a sealant or frit glass (S5). The step S5 includes an alignment film forming/rubbing process and a substrate bonding/liquid crystal injecting process. In the alignment film forming/rubbing process, an alignment film is spread over each of the upper and lower substrates of the display panel and the alignment film is rubbed with a rubbing cloth and the like. In the substrate bonding/liquid crystal injecting process, the upper substrate and the lower substrate are bonded together in use of the sealant, and a liquid crystal and a spacer are injected through a liquid crystal injection hole and then the liquid crystal injection hole is sealed off.

Subsequently, a test picture is displayed by applying test data of each gray level to the display panel of after the substrate bonding/liquid crystal injecting process, and the panel defect is inspected by an electric/magnetic inspection and/or a visual inspection for the picture (S6). Herein, the visual inspection includes an inspection which is carried out in use of optical equipment such as a camera and the like.

In case that the panel defect is detected as the inspection result of the step S6 (YES of S7), the fabricating method of the liquid crystal display device according to the embodiment of the present invention stores the presence or absence of the panel defect and the location information for the location or area, where the panel defect appears, at an inspection computer, and performs correction for compensating the panel defect (S8). The step S8 is the same as the foregoing step S4 except for the W-CVD process among the embodiments of the foregoing repair process.

Subsequently to the step S7 or S8, a drive circuit is mounted on the display panel of after the substrate bonding/liquid crystal injecting process, and the display panel on which the drive circuit is mounted, a backlight and the like are put into a case to perform a module assembly process of the display panel (S9). In the mounting process of the drive circuit, an output terminal of a tape carrier package (hereinafter, referred to as 'TCP') on which ICs such as a gate drive IC and a data drive IC are mounted is connected to a pad part on a substrate, and an input terminal of a tape carrier package is connected to a printed circuit board (hereinafter, referred to as 'PCB') on which a timing controller is mounted. A memory at which the compensation data are to be stored and a compensation circuit which modulates the data that are to be supplied to the display panel in use of the data stored on the memory and which supplies the modulated data to the drive circuit are mounted on the PCB. The memory is a non volatile memory such as EEPROM (electrically erasable programmable read only memory) where the data can be renewed and erased. On the other hand, the compensation circuit can be embedded in the timing controller by being made into one chip with the timing controller. And, the drive ICs can also be mounted directly on the substrate by a COG (chip-on-glass) method other than a TAB (tape automated bonding) method in use of the tape carrier package.

Subsequently, the test picture is displayed by applying the test data of each gray level to the display panel and the panel defect is detected by the electric/magnetic inspection and/or the visual inspection for the picture (S10). Herein, the visual inspection includes an inspection which is carried out in use of optical equipment such as a camera and the like.

In case that the panel defect is detected as the inspection result of the step S10 (YES of S11), the presence or absence of the panel defect and the location information for the location or area, where the panel defect appears, are stored on an inspection computer, and a correction for compensating the panel defect is carried out (S12). The step S12 is the same as the foregoing step S4 except for the W-CVD process among the embodiments of the foregoing repair process.

After the steps S11 and S12, the location data and the compensation data of the panel defect determined by the foregoing inspection and correction steps are stored on the EEPROM (S13). Herein, the inspection computer supplies the location data and the compensation data to the EEPROM in use of a ROM recorder. At this moment, the ROM recorder might transmit the location data and the compensation data to the EEPROM through a user connector. The compensation data are transmitted in series through the user connector, and serial clocks, power sources, ground power sources and the like are transmitted to the EEPROM through the user connector.

On the other hand, the memory, at which the location data and the compensation data are stored in order to modulate data for the panel defect, can be EDID ROM (extended display identification data ROM) instead of EEPROM. The EDID ROM stores a monitor information data such as a seller/buyer identification information, the variables and characteristic of the basic display device and the like. And, the EDIP ROM stores the location data and the compensation data on a storage space separated from the storage space on which the monitor information data are stored. In case of storing the compensation data on the EDID ROM instead of EEPROM, the ROM recorder transmits the compensation data through a DDC (data display channel). Accordingly, the EEPROM and the user connector can be removed if the EDID ROM is used, thus there is an effect that an additional development cost is reduced as much. Hereinafter, an explanation will be made assuming that the memory on which the location data and the compensation data are stored is the EEPROM. Of course, the EEPROM and the user connector can be replaced with EDID ROM and DDC. On the other hand, the memory for storing the location data and the compensation data can be another type of non volatile memory which can renew and erase the data as well as the EEPROM and the EDID ROM.

After the step S13, the test data are modulated in use of the first to third compensation data which are stored on the EEPROM, and the panel defect is inspected by the electric/magnetic inspection and/or the visual inspection by applying the modulated test data to the display panel (S14). Herein, the visual inspection includes an inspection which is carried out in use of optical equipment such as a camera and the like.

In case of detecting the panel defect which exceeds a good product reference tolerance as the inspection result of the step S14, a correction for this is performed (S16). The correction object of this moment includes the panel defect which is not found in the above-mentioned inspections, and the panel defect which is not recovered due to the non optimization of the compensation value calculated in the above-mentioned correction steps. For example, in case that the compensation data are not optimized, the compensation data are re-calculated to renew the compensation data stored on the EEPROM. And, in case that the defect pixel is newly detected, a repair process is performed for this to form a link pixel, and the compensation data for this are calculated to be stored on the EEPROM. At this moment, the W-CVD process is excluded from the repair process. On the other hand, there is a case that a bright line appears on a display screen because the light from a backlight is not uniformly incident to the entire incidence surface of the liquid crystal display panel, and the liquid crystal display device can recover the defect by the data modulation in use of the compensation data in the same manner as the foregoing panel defect even in case of the bright line caused by the backlight.

In case that the picture quality defect is not found as the inspection result of the step S14 (NO of S15), i.e., if the degree of the picture quality defect is found to be not higher than the good product tolerance reference value, the liquid crystal display device is judged as the good product to be shipped out (S17).

On the other hand, the foregoing inspection steps and correction steps can have a process simplified or a designated step thereof omitted for a rational process such as a simplification of the fabrication process and the like.

Hereinafter, a picture quality controlling method of a liquid crystal display device according to the embodiment of the present invention will be explained.

The picture quality controlling method of the liquid crystal display device according to the present invention includes a compensation step of modulating the video data, which are to be displayed in the liquid crystal display panel, in use of the first to third compensation data calculated by the fabricating method of the foregoing liquid crystal display device, and a step of driving the liquid crystal display panel with the modulated data. Herein, the compensation step includes a first compensation step of calculating the brightness information Y and the color difference information UV from the R, G, B digital video data, modulating the brightness value of the data with the compensation value of the compensation data by expanding the number of bits of the brightness information, and then calculating the R, G, B data modulated from the un-modulated color difference information and the modulated brightness information and simultaneously restoring the number of bits of the data; a second compensation step of modulating the data, which are to be displayed in the boundary part, with the second compensation data by dispersing the second compensation data to the boundary part; and a third compensation step of modulating the data, which are to be displayed in the link pixel, with the third compensation data.

Hereinafter, the first to third compensation steps of the picture quality controlling method according to the present invention will be explained in detail through the following embodiments.

The first compensation step according to the present invention converts m/m/m bits R/G/B input data inclusive of red R, green G and blue B information into n/n/n bits Y/U/V data (herein, n is an integer larger than m) inclusive of brightness Y and color difference U/V information; modulates the Y data to be displayed in the panel defect area, among the converted Y/U/V data with the first compensation data by increasing or decreasing the Y data; and then converts the n/n/n bits Y/U/V data, where the Y data are modulated, into the m/m/m bits R/G/B data. For example, in case that the first compensation data for each location and for each gray level in relation to the panel defect area are determined, as in the following TABLE 1, the R/G/B data of 8/8/8 bits are converted into the Y/U/V data of 10/10/10 bits; '10(2)' is added to the lower 2 bits of the Y data to modulate the Y data if the upper 8 bits of the Y data, which are to be displayed in 'location 1' among the converted Y/U/V data, is '01000000(64)' corresponding to a 'gray level section 2'; and then the Y/U/V data inclusive of the modulated Y data are converted again into the R/G/B data of 8/8/8 bits, thereby compensating the brightness of the panel defect area. And, the R/G/B data of 8/8/8/bits are converted into the Y/U/V data of 10/10/10 bits; '11(3)' is added to the lower 2 bits of the Y data to modulate the Y data if the upper 8 bits of the Y data, which are to be displayed in a 'location 4' among the converted Y/U/V data, is '10000000(128)' corresponding to a 'gray level section 3'; and then the Y/U/V data inclusive of the modulated Y data are converted again into the R/G/B data of 8/8/8 bits, thereby compensating the brightness of the panel defect area. On the other hand, a conversion method between the R/G/B data and the Y/U/V data will be described in detail in the explanation for the picture quality controlling method of the liquid crystal display device according to the present invention, which is to be described later.

TABLE 1

| Classification | Gray level area | Location 1 | Location 2 | Location 3 | Location 4 |
|---|---|---|---|---|---|
| Gray level section 1 | 00000000(0) ~00110010(50) | 01(1) | 00(0) | 01(1) | 01(1) |
| Gray level section 2 | 00110011(51) ~01110000(112) | 10(2) | 00(0) | 01(1) | 10(2) |
| Gray level section 3 | 01110001(113) ~10111110(190) | 11(3) | 01(1) | 10(2) | 11(3) |
| Gray level section 4 | 10111111(191) ~11111010(250) | 00(0) | 01(1) | 10(2) | 11(3) |

Figure 15A:
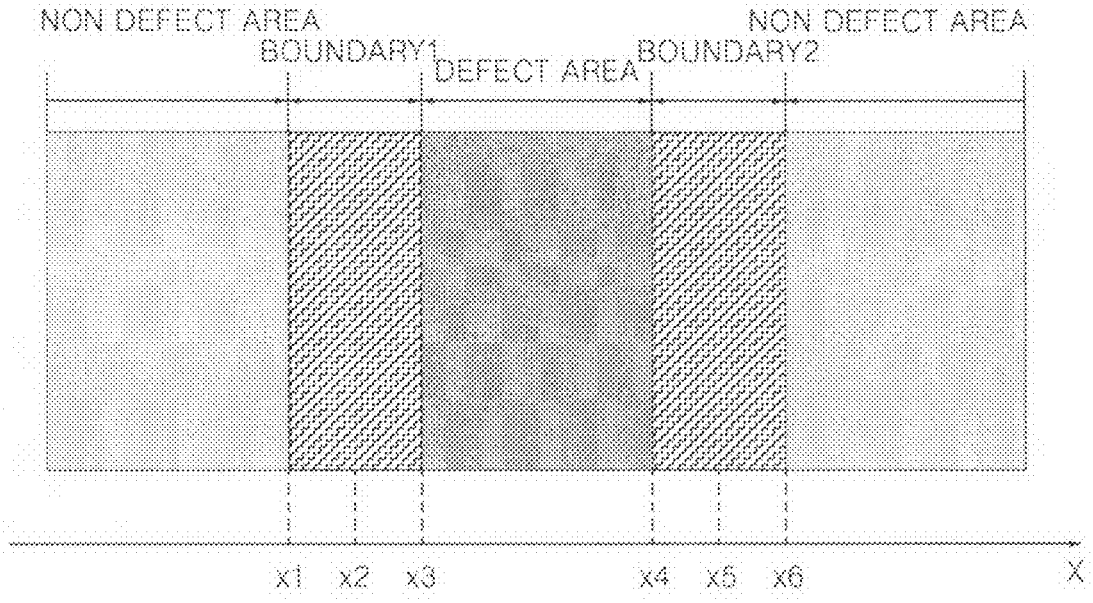
FIGS. 15A to 15D are diagrams representing an example of applying various dither patterns thereto in accordance with the brightness characteristic in the boundary part of the panel defect area and the non-defect area of the display panel.
Figure 15A:
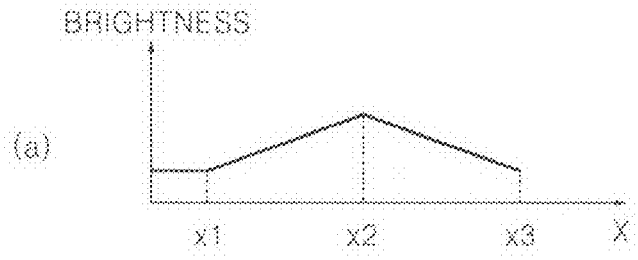
Figure 15A:
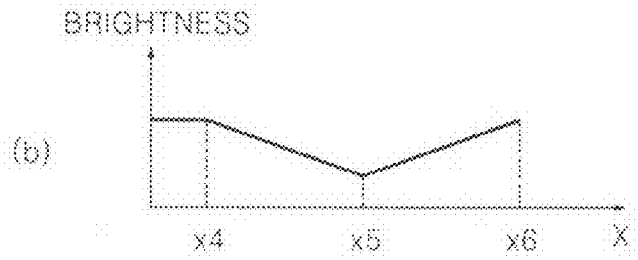
Figure 15B:
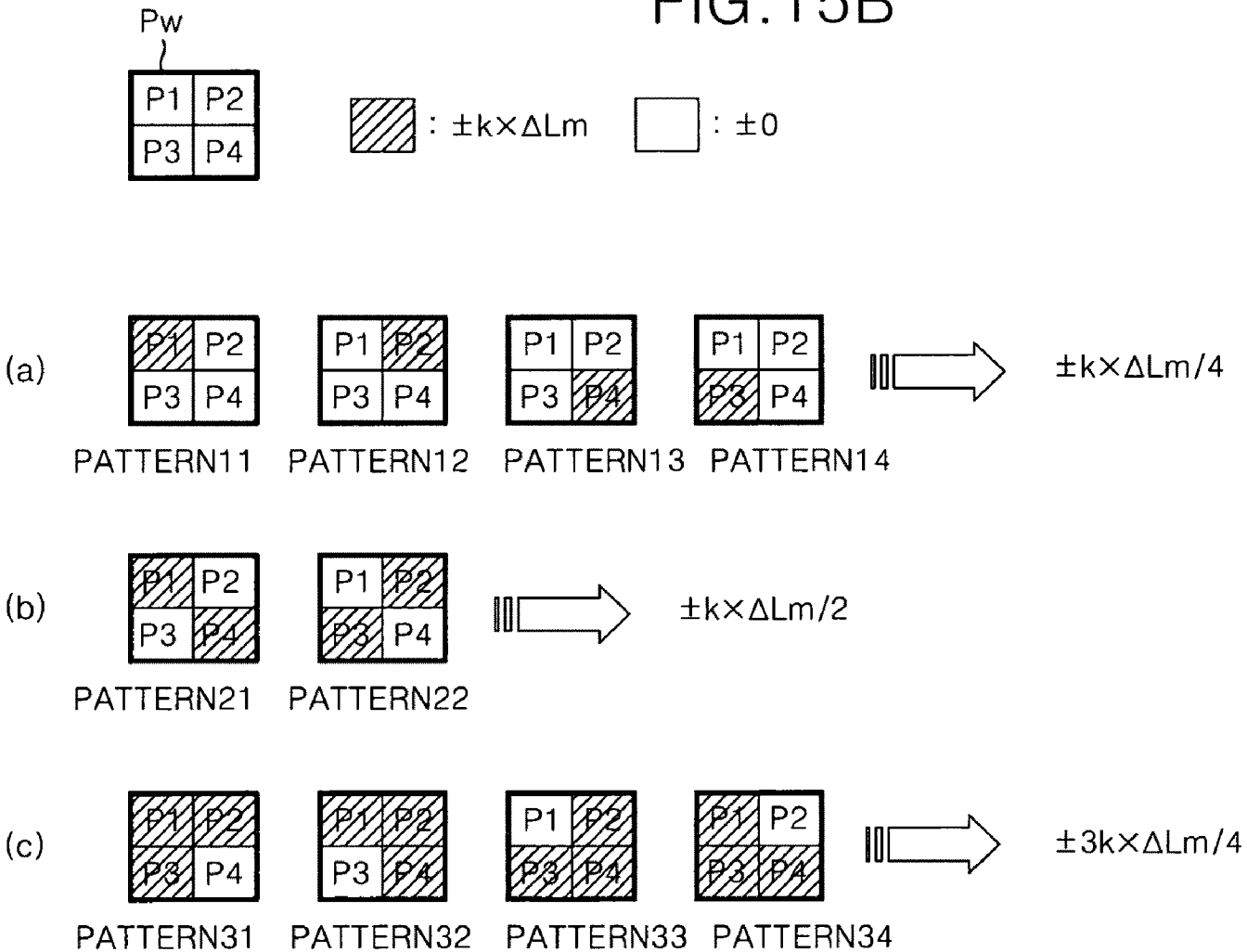
Figure 15C:
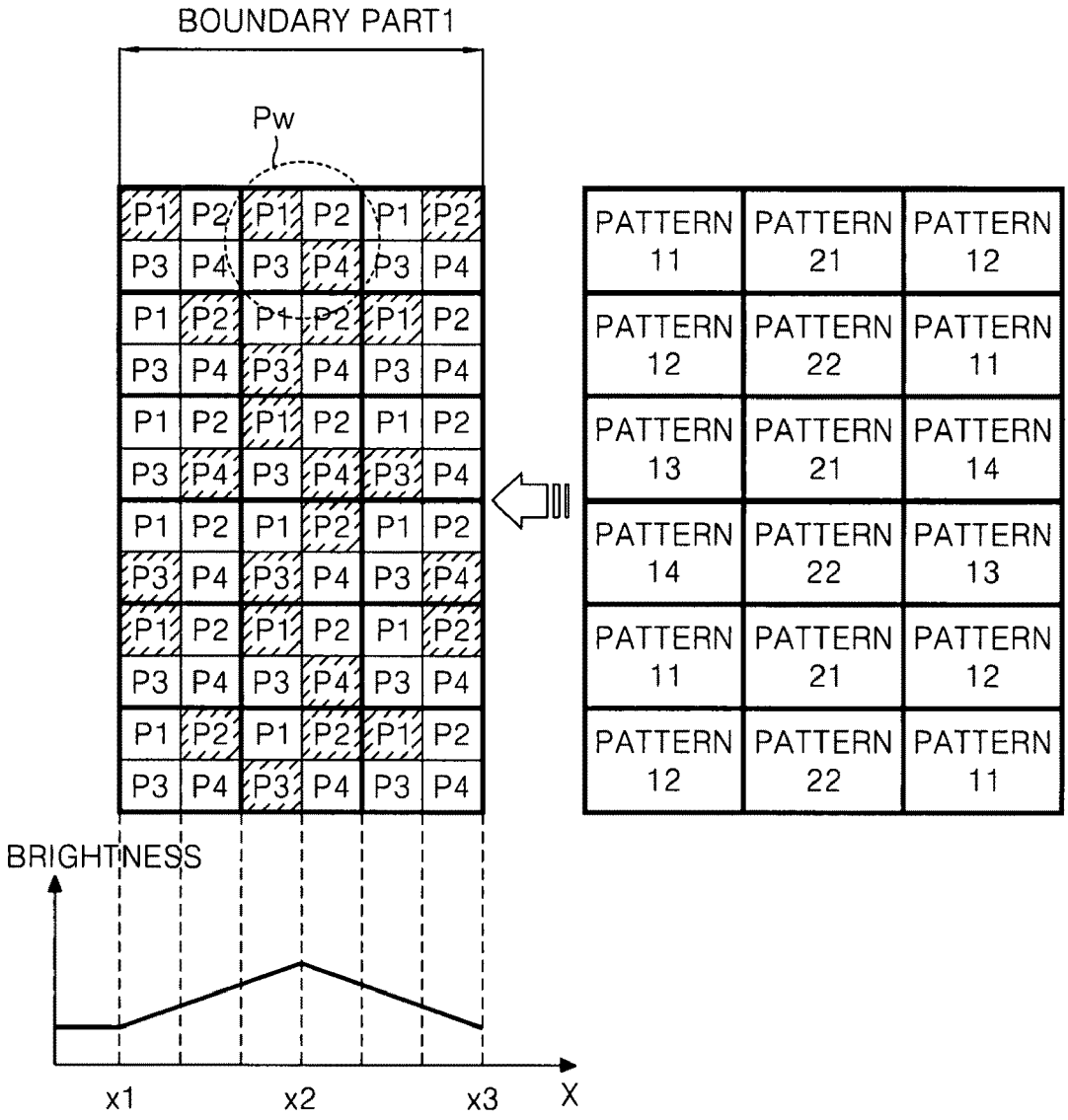
Figure 15D:
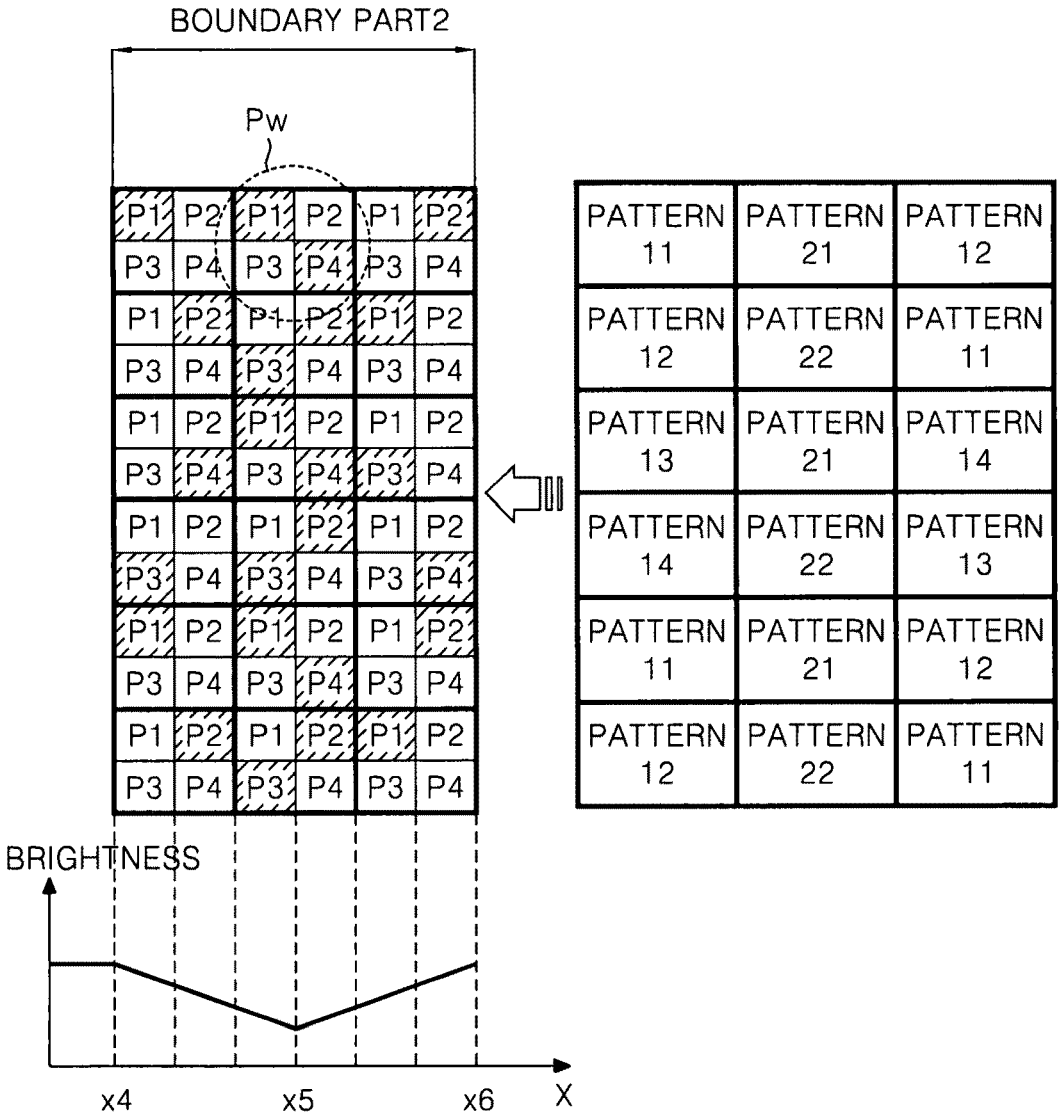

As described above, the first compensation step according to the present invention converts the red, green and blue video data into the brightness and color difference data by noticing a fact that the human eyes are more sensitive to the brightness difference than to the hue difference; extends the number of bits of the brightness and hue data; and modulates the brightness data which can express a more detailed gray level because the number of bits thereof is extended, thus there is an advantage in that the brightness of the panel defect area can be adjusted in detail Further, the second compensation step according to the present invention determines a dither pattern inclusive of a plurality of pixels in the boundary part; disperses the second compensation data to the dither pattern where pixels to which the second compensation data are dispersed are differently designated between the dither patterns which are adjacent to each other vertically or horizontally; and then increases or decreases the data, which are to be supplied to the boundary part, with the dispersed second compensation data. For example, as shown in FIG. 15A, it is assumed that there are boundary part 1 and boundary part 2 located at both ends of the panel defect area in the display panel; that in boundary part 1, the brightness difference is highest at x2 in a positive direction and there appears a boundary noise having an aspect that the brightness difference is decreased in directions from x2 to x1 and x3; and that in boundary part 2, the brightness difference is highest at x5 in a negative direction and there appears a boundary noise having an aspect that the brightness difference is increased in directions from x5 to x4 and x6. Herein, it is assumed that in boundary part 1 and boundary part 2, the brightness is uniform in a direction perpendicular to an X-axis. In such a case, the second compensation step according to the present invention compensates the noise by applying a dither pattern, which is higher in the extent of brightness compensation than a dither pattern adjacent to x1 and x3, for the dither pattern adjacent to x2, and by applying a dither pattern, which is higher in the extent of brightness compensation than a dither pattern adjacent to x4 and x6, for the dither pattern adjacent to x5. On the other hand, there might be various patterns that locations designating pixels where the brightness is to be compensated are different from each other even though the extent of brightness compensation is identical for one dither pattern. For example, as shown in FIG. 15B, in a dither pattern Pw inclusive of 4 pixels arranged in a 2×2 matrix, pattern 11 to pattern 14 of (A) of FIG. 15B are dither patterns for increasing and decreasing brightness by as much as $k \times \Delta Lm/4$; pattern 21 to pattern 22 of (B) of FIG. 15B are dither patterns for increasing and decreasing brightness by as much as $k \times \Delta Lm/2$; and pattern 31 to pattern 34 of (C) of FIG. 15B are dither patterns for increasing and decreasing brightness by as much as $3k \times \Delta Lm/4$. k and $\Delta Lm$ has already been mentioned. But, if the locations of the pixels where the brightness is to be compensated are identical for the dither patterns which are arranged in parallel, there might be generated a problem in that the brightness jumps between the dither patterns. In order to prevent this, the second compensation step according to the present invention applies a dither pattern, in which the location of the pixel where the brightness is to be compensated is made different, to the dither pattern Pw which is vertically or horizontally adjacent for the dither patterns Pw where the noise of the same brightness difference appears in the boundary part and which are arranged vertically in parallel. FIG. 15C illustrates an example of applying the foregoing method to the dither patterns Pw located at x1 to x3 in boundary part 1. As illustrated in FIG. 15C, in x2 where the brightness noise is highest, a dither pattern in which the location of the pixel where the brightness is to be compensated is made different from patterns 21 and 22 is applied to the dither patterns Pw which are vertically adjacent to patterns 21 and 22. Further, in x1 and x3 which are lower in brightness noise than x2, a dither pattern in which the location of the pixel where the brightness is to be compensated is made different from patterns 11 to 14 is applied to the dither patterns Pw which are vertically adjacent to patterns 11 to 14 which are lower in the extent of brightness compensation than patterns 21 and 22. At this moment, in x1 to x3, the compensation should be made in a direction of reducing the brightness. To this end, there might be used a method that the second compensation data having a negative compensation value are dispersed to a designated dither pattern and the dispersed second compensation data are added to the data which are to be supplied to the boundary part, or a method that the second compensation data having a positive compensation value are dispersed to a designated dither pattern and the dispersed second compensation data are added to the data which are to be supplied to the boundary part. Subsequently, FIG. 15D represents an example of applying the location of the pixel, where the brightness is to be compensated by the foregoing method, differently from each other to the dither patterns Pw located at x4 to x6 in boundary part 2. Referring to FIG. 15D, in x5 where the brightness noise is highest, a dither pattern in which the location of the pixel where the brightness is to be compensated is made different from patterns 21 and 22 is applied to the dither patterns Pw which are vertically adjacent to patterns 21 and 22. Further, in x4 and x6, a dither pattern in which the location of the pixel where the brightness is to be compensated is made different from patterns 11 to 14 is applied to the dither patterns Pw which are vertically adjacent to patterns 11 to 14 which are lower in the extent of brightness compensation than patterns 21 and 22. At this moment, in x4 to x6, the compensation should be made in a direction of increasing the brightness. To this end, there might be used a method that the second compensation data having a positive compensation value are dispersed to a designated dither pattern and the dispersed second compensation data are added to the data which are to be supplied to the boundary part, or a method that the second compensation data having a negative compensation value are dispersed to a designated dither pattern and the dispersed second compensation data are added to the data which are to be supplied to the boundary part. In the foregoing embodiment for the second compensation step, it is assumed that there is a dither pattern Pw inclusive of 4 pixels arranged in a 2×2 matrix, but the number of pixels constituting the dither pattern Pw and the dither pattern designating the pixel to which the data are dispersed can be adjusted in various ways. On the other hand, the second compensation step can be made by a method of differently applying the locations of the pixels, where the brightness is to be compensated, for each frame for a unit frame to the dither pattern Pw by way of adding a frame rate control FRC mode to the foregoing dithering method. For example, in case of having 4 frames as a unit, the locations of the pixels, where the brightness is to be compensated, of patterns 11 to 14 are applied differently from each other for each frame to each of the dither patterns Pw in x1 and x3. The second compensation step can minutely adjust the brightness with a detailed gray level express, and can prevent the brightness jump caused by the regular application of the dither pattern, thereby enabling more natural picture quality compensation.

Figure 16A:
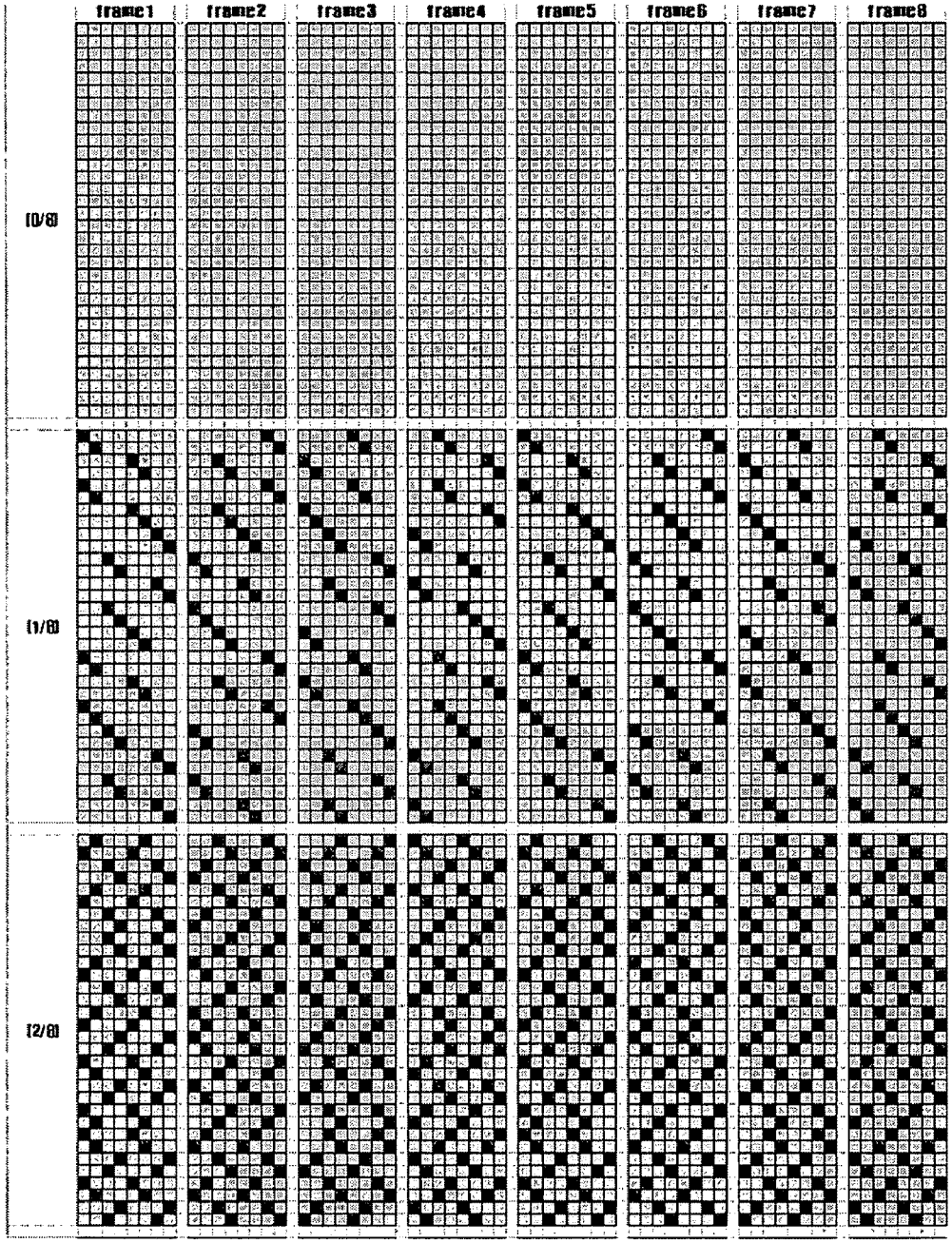
FIGS. 16A to 16C are diagrams representing dither patterns of a frame rate control according to another embodiment of the present invention.
Figure 16B:
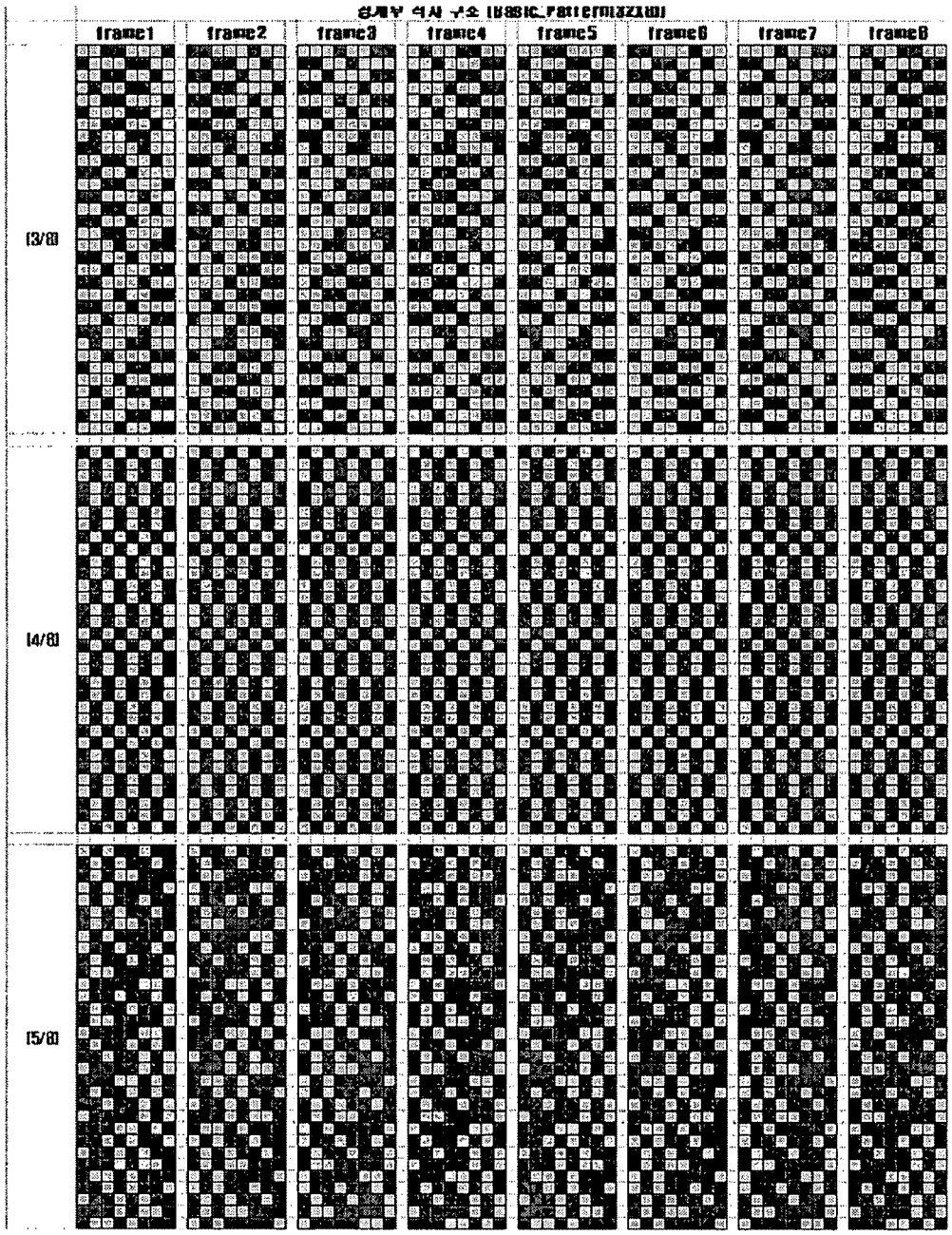
Figure 16C:
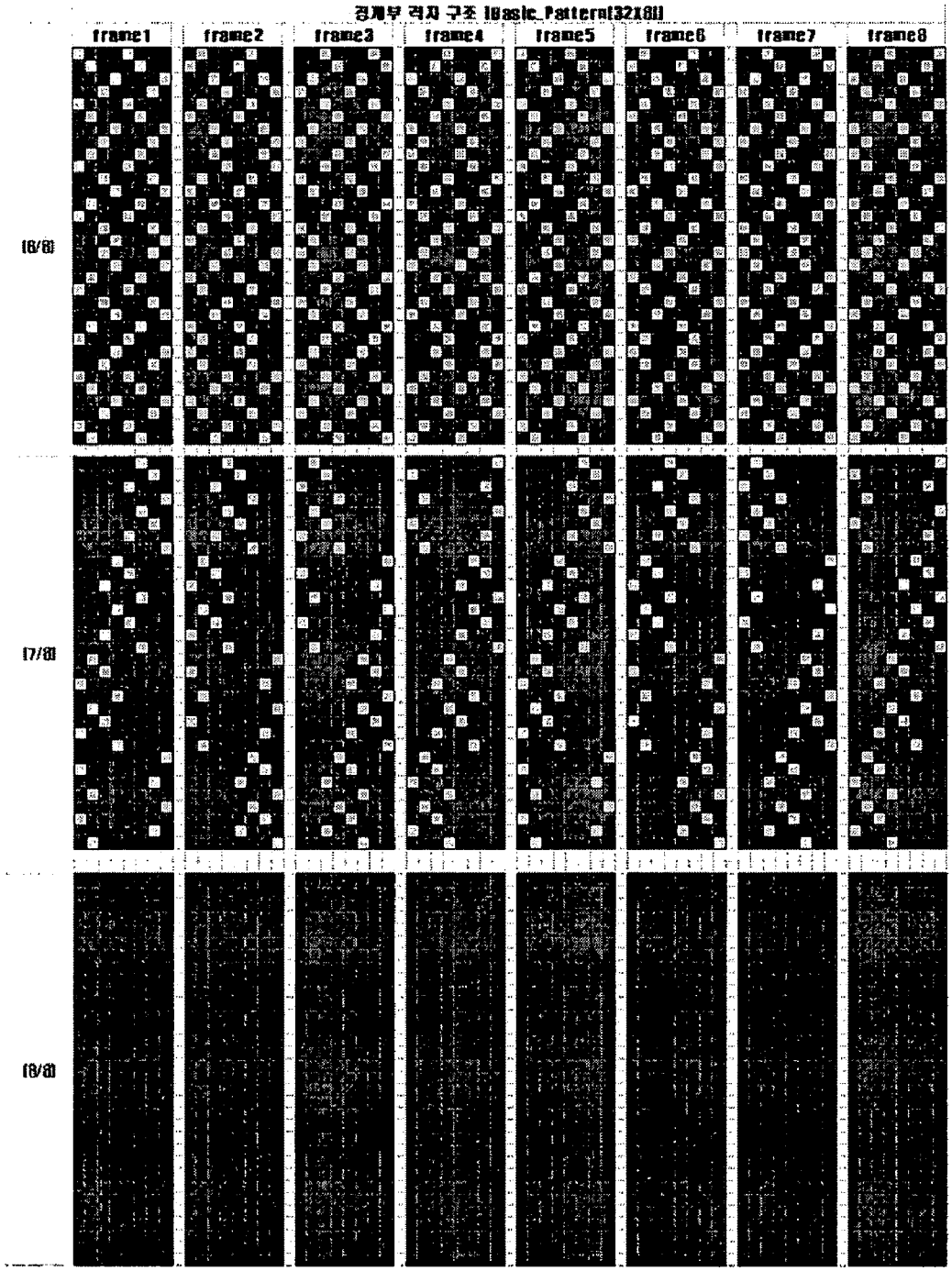

FIGS. 16A to 16C represent an example of dither patterns having no brightness jump between dither patterns of FRC of which the compensation values are different and which are adjacent thereto. The dither patterns of the FRC can be applied as the first or second compensation data for compensation the boundary part or the panel defect area.

Referring to FIGS. 16A to 16C, the FRC dither pattern of the present invention has a size of 8(pixels)×32(pixels), and adds or subtracts the compensation values ⅛, ⅜, ⅜, ⅜, ⅝, ⅝, ⅞ and 1 to or from input digital video data. A black part in each dither pattern is pixels to or from which '1' is added or subtracted, and a gray part is pixels to or from which '0' is added or subtracted. The size 8×32 of each dither pattern is determined for an observer not to perceive a repeat cycle even though the same patterns are repeated through many experiments and for a boundary not to appear between the dither patterns which express different compensation values from each other. Accordingly, the dither patterns of the present invention can be applied to the dither pattern which expresses each compensation value and of which the size is larger than 8×32, e.g., the dither patterns of sizes 16×32, 24×32, 32×32, 16×40 and 16×44.

Figure 17A:
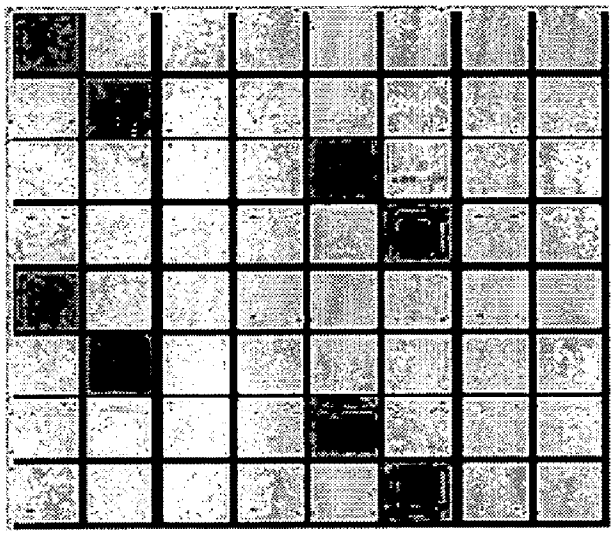
FIGS. 17A to 17D are diagrams representing sub-dither patterns disposed within a ⅛ dither pattern shown in FIG. 16A.
Figure 17B:
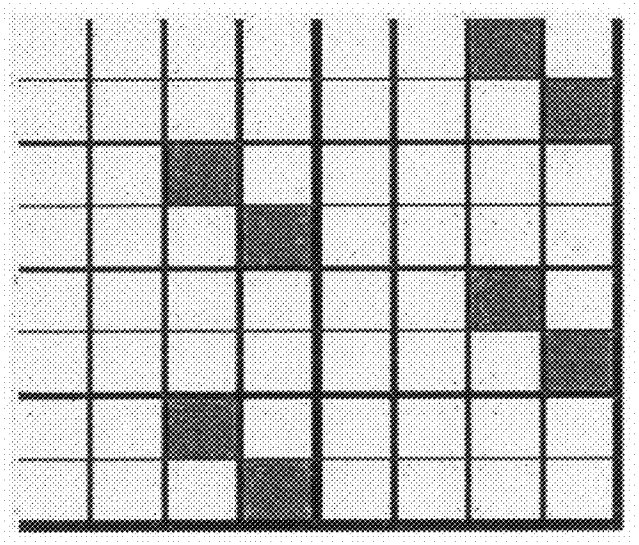
Figure 17C:
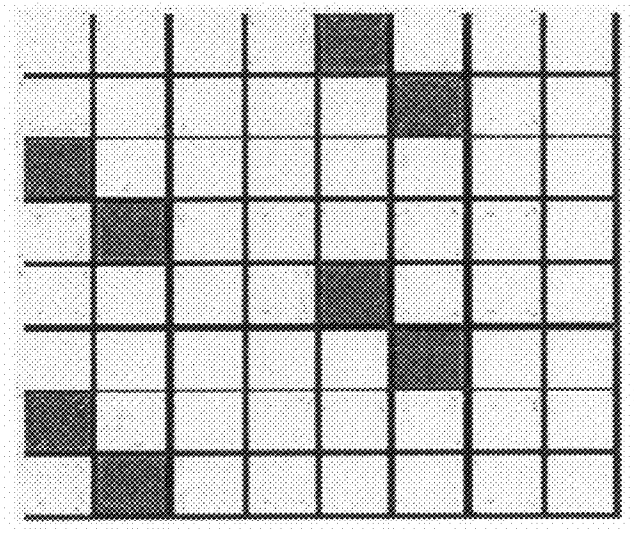
Figure 17D:
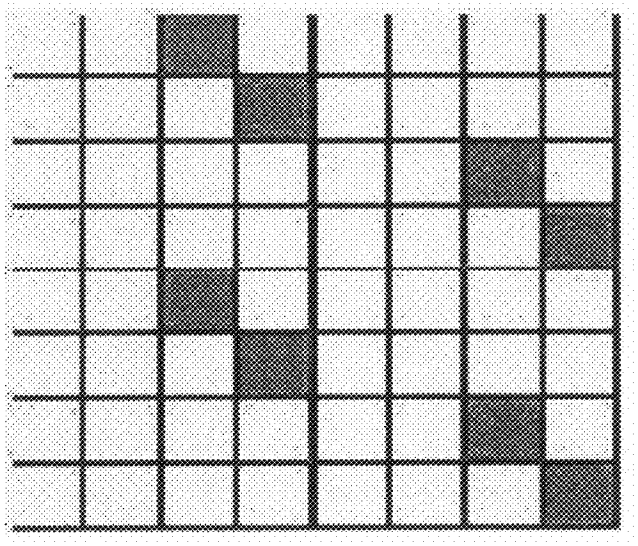

Each dither pattern includes 4 sub-dither patterns of which the compensation values are the same as its own compensation value and where the locations of the compensation pixels, in which the compensation values are added to or from each other, are differently determined. FIGS. 17A to 17D are diagrams illustrating sub-dither patterns arranged within a ⅛ dither pattern shown in FIG. 16A. For example, the dither pattern of the compensation value ⅛ includes a first sub-dither pattern of a compensation value ⅛, as shown in FIG. 17A; a second sub-dither pattern of the compensation value ⅛, as shown in FIG. 17B; a third sub-dither pattern of the compensation value ⅛, as shown in FIG. 17C; and a fourth sub-dither pattern of the compensation value ⅛, as shown in FIG. 17D.

Assuming that 'x' is a horizontal direction increasing by 1 from left to right, 'y' is a vertical direction increasing by 1 from top to bottom, and 'P[x,y]' is a pixel to which a compensation value is applied; the pixels to or from which the compensation value '1' is added or subtracted in the first sub-dither pattern are P[1,1], P[1,5], P[2,2], P[2,6], P[5,3], P[5,7], P[6,4] and P[6,8], as shown in FIG. 17A. The pixels to or from which the compensation value '1' is added or subtracted in the second sub-dither pattern are P[3,3], P[3,7], P[4,4], P[4,8], P[7,1], P[7,5], P[8,2] and P[8,6], as shown in FIG. 17B. The pixels to or from which the compensation value '1' is added or subtracted in the third sub-dither pattern are P[1,3], P[1,7], P[2,4], P[2,8], P[5,1], P[5,5], P[6,2] and P[6,6], as shown in FIG. 17C. The pixels to or from which the compensation value '1' is added or subtracted in the fourth sub-dither pattern are P[3,1], P[3,5], P[4,2], P[4,6], P[7,3], P[7,7], P[8,4] and P[8,8], as shown in FIG. 17D.

The dither pattern of the compensation value ⅛ has the first sub-dither pattern, the second sub-dither pattern, the third sub-dither pattern and the fourth sub-dither pattern arranged from top to bottom in the first frame period; and the locations of the pixels to or from which the compensation value is added or subtracted in each sub-dither pattern are shifted left and right or up and down such that the pattern of the pixels to or from which the compensation value is added or subtracted is not identically repeated at the left, right, top and bottom. The arrangement of the sub-dither patterns are made different for each frame period, as shown in FIG. 16A. That is to say, in the second frame period, the dither pattern of the compensation value ⅛ has the second sub-dither pattern, the third sub-dither pattern, the fourth sub-dither pattern and the first sub-dither pattern arranged from top to bottom; and the locations of the pixels to or from which the compensation value is added or subtracted in each sub-dither pattern are shifted left and right or up and down. In the third frame period, the dither pattern of the compensation value ⅛ has the third sub-dither pattern, the fourth sub-dither pattern, the first sub-dither pattern and the second sub-dither pattern arranged from top to bottom; and the locations of the pixels to or from which the compensation value is added or subtracted in each sub-dither pattern are shifted left and right or up and down. In the fourth frame period, the dither pattern of the compensation value ⅛ has the fourth sub-dither pattern, the first sub-dither pattern, the second sub-dither pattern and the third sub-dither pattern arranged from top to bottom; and the locations of the pixels to or from which the compensation value is added or subtracted in each sub-dither pattern are shifted left and right or up and down. For fifth to sixth frame periods, the dither pattern of the compensation value ⅛ is repeated in the same manner as the first to fourth frame periods.

In the same manner as the dither pattern of the compensation value ⅛, as shown in FIGS. 16A to 16C, the ⅜ dither pattern, the ⅜ dither pattern, the ⅜ dither pattern, the ⅝ dither pattern, the ⅝ dither pattern and the ⅞ dither pattern include J number of sub-dither patterns in which the compensation value is I and the patterns of the pixels to or from the compensation value is added or subtracted are different from each other, when assuming that the compensation value is 'I' and the number of sub-dither patterns is 'J'. The dither patterns have the sub-dither patterns arranged differently in each of the J number of frames, and the dither pattern of which the number of compensation pixels and the location are the same appears for each J+1 number of frame periods.

Figure 18:
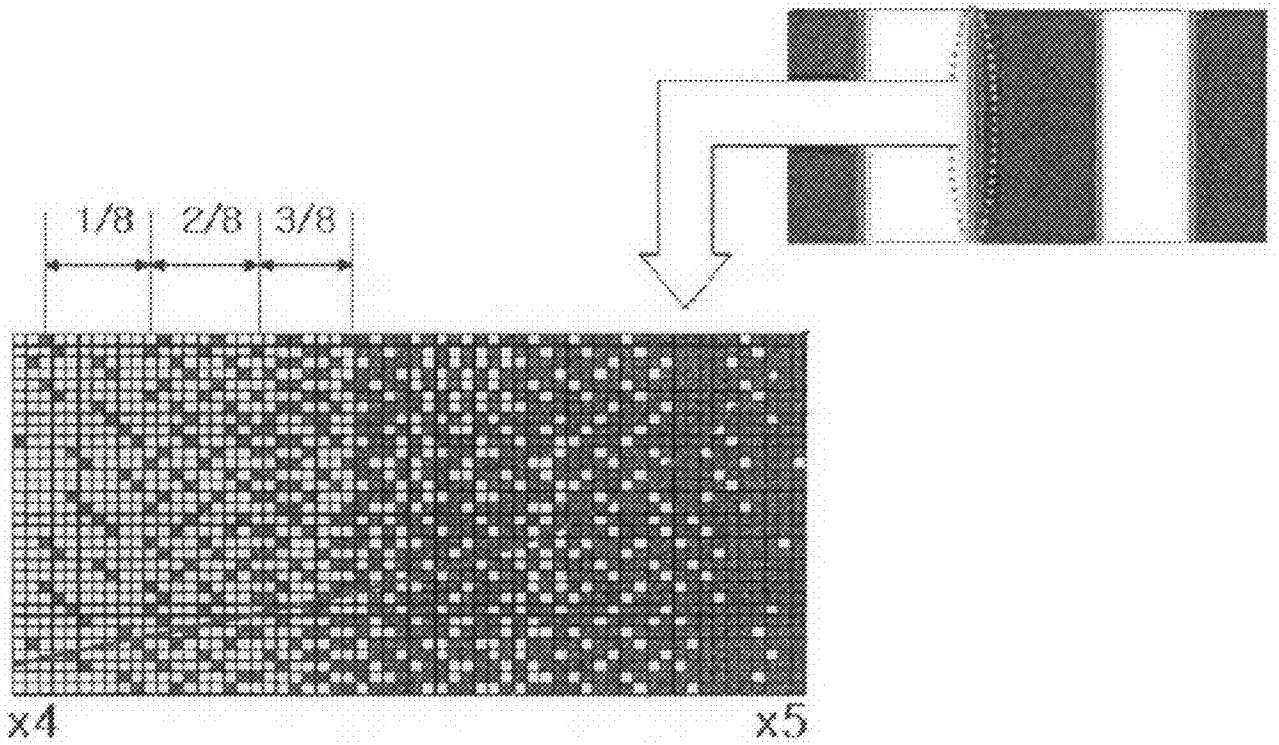
FIG. 18 is a diagram representing an example of the dither patterns mapped to the boundary part 'x4-x5' shown in FIG. 15A.
Figure 19A:
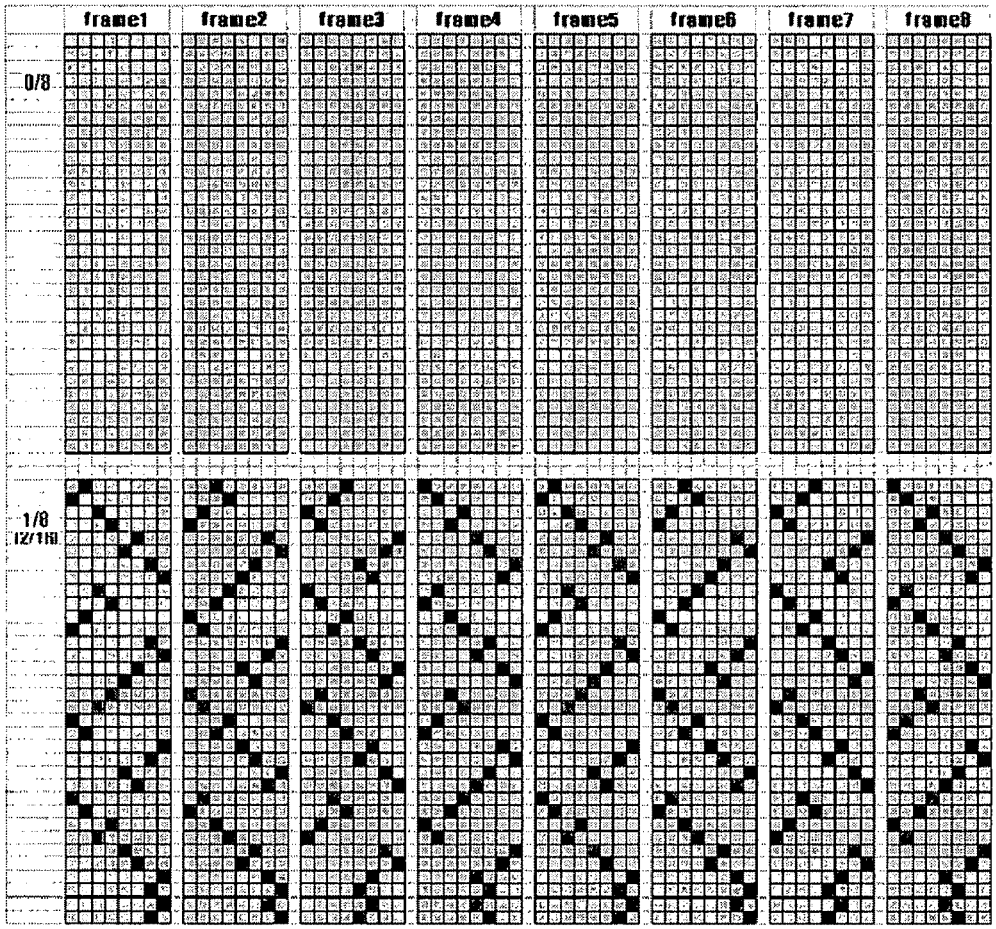
FIGS. 19A to 19D are diagrams representing dither patterns of a frame rate control according to still another embodiment of the present invention.
Figure 19B:
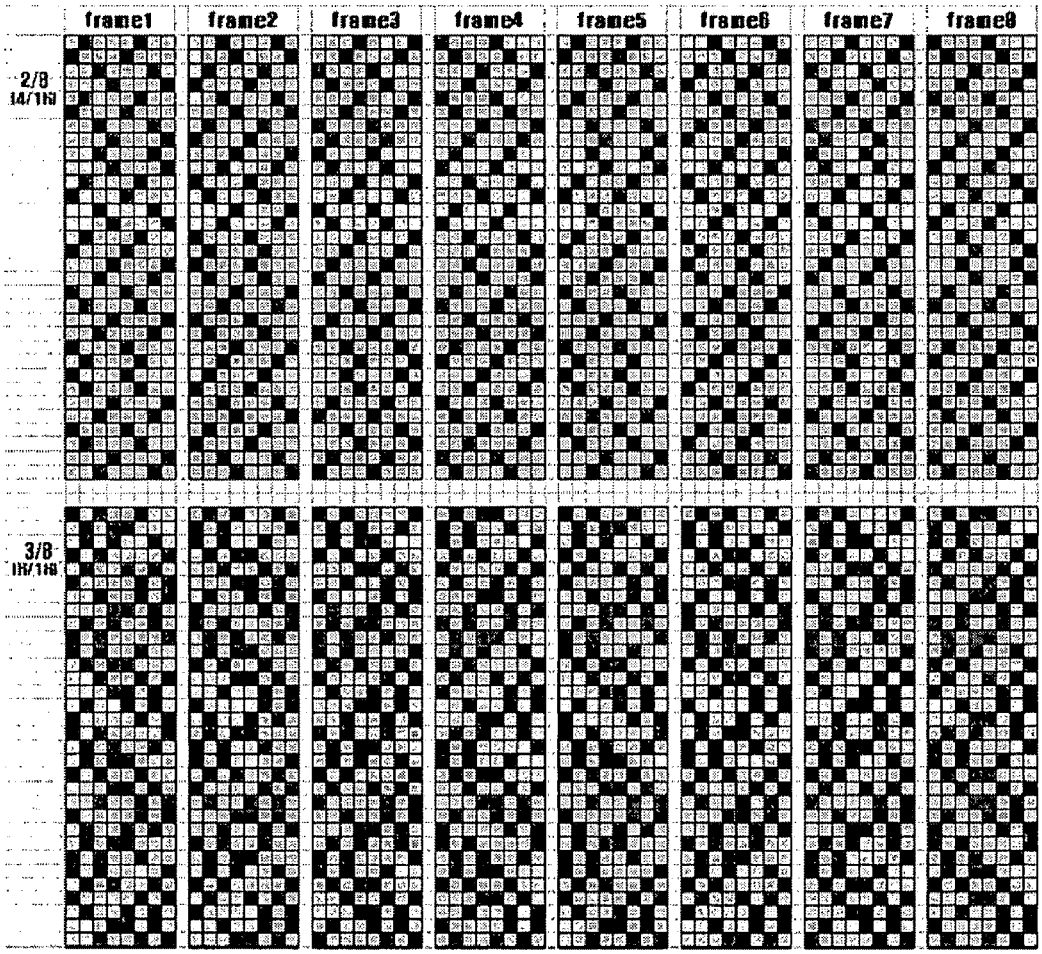
Figure 19C:
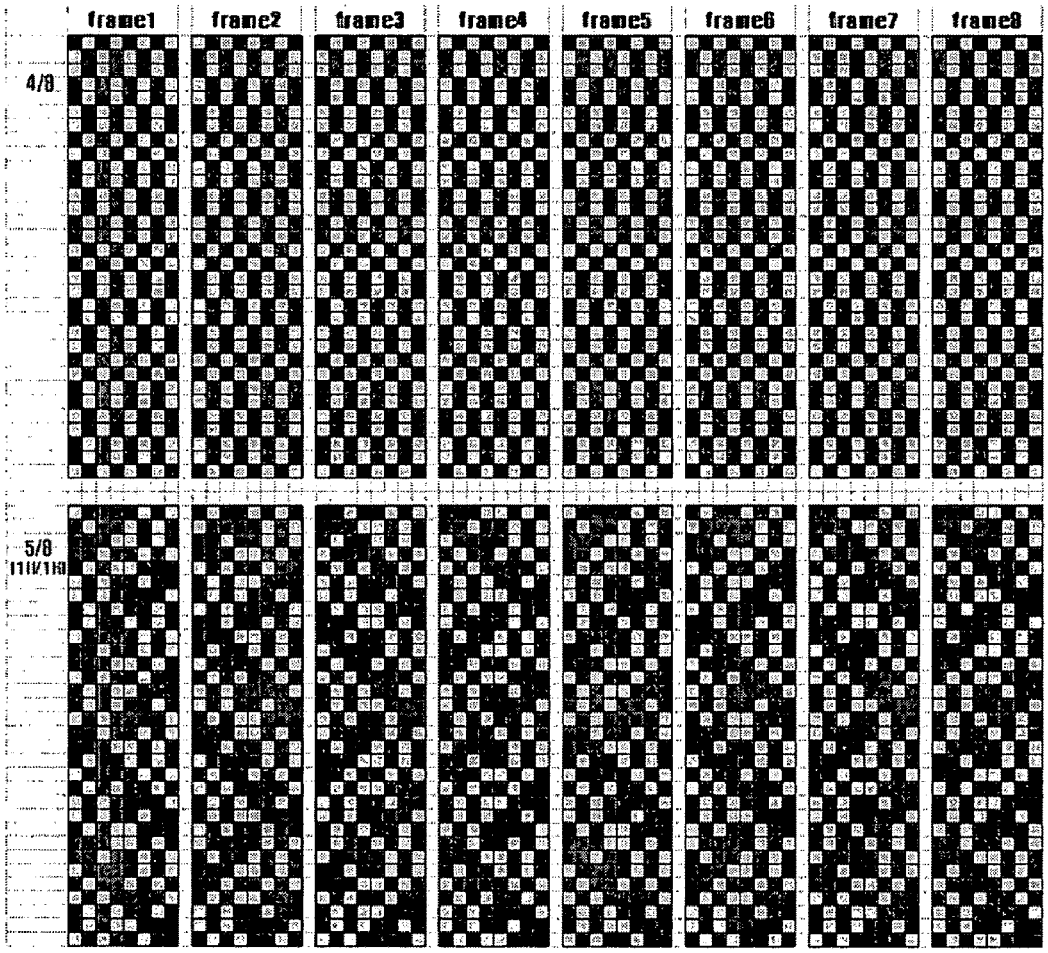
Figure 19D:
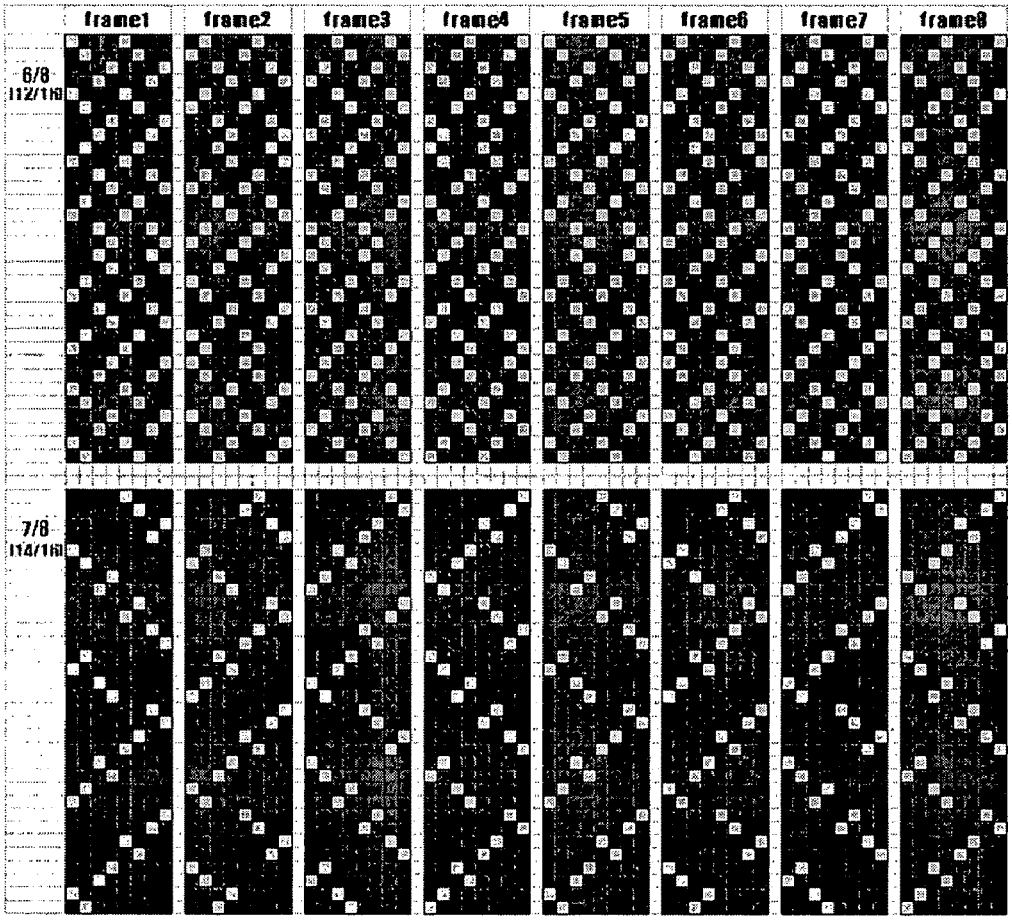

FIG. 18 represents an example of the dither patterns mapped to the boundary part between x4 and x5 where the brightness decreases as it goes from boundary part 2 of the non-defect area and the panel defect area of FIG. 15A to the non-defect area in use of the FRC dither patterns of FIGS. 16A to 16C in the first frame period.

The FRC dither patterns mapped as shown in FIG. 18 shows an example of compensating the brightness of the boundary part in the same manner as the non-defect area by adding the compensation value to the digital video data which are to be displayed at the boundary part between x4 and x5. As can be known in the brightness curve of blue color in FIG. 18, in the FRC of the present invention, the compensation value is different and the brightness change is not generated rapidly in the boundary between the adjacent dither patterns.

FIGS. 19A to 19D represent FRC dither patterns according to another embodiment of the present invention. The dither patterns has a size of 8×32, and the compensation values ⅛, ⅜, ⅜, ⅜, ⅝, ⅝, ⅞ and 1 are added to or subtracted from the input digital video data in accordance with the number of pixels to which the compensation value is applied. In each of the dither patterns, a black part is pixels to or from which '1' is added or subtracted, and a gray part is pixels to or from which '0' is added or subtracted. The dither pattern of the compensation value '1' is a dither pattern that the compensation value 1 is compensated to each of pixels included in the dither pattern of the size 8×32, and the dither pattern of the compensation value '1' is omitted in the drawings. The dither patterns are designed in the same design condition as the dither patterns of FIGS. 16A to 16C described above. That is to say, as shown in FIGS. 19A to 19D, the dither pattern of the compensation value 'I' has the compensation value being 'I' and includes J number of sub-dither patterns where the patterns of the pixels, to or from which the compensation value is added or subtracted, are different from each other. And, the dither patterns have the sub-dither patterns arranged differently in each J frame periods, and the dither patterns of the same compensation value appear for each J+1 number of frame periods.

Further, the third compensation step according to the present invention increases or decreases the data, which are to be supplied to the link pixel, with the third compensation data, thereby compensating the charge characteristic of the link pixel. For example, in case that the third compensation data are determined for each location and for each gray level in relation to the link pixel, as in TABLE 2 below, the third compensation step according to the embodiment of the present invention adds '00000100(4)' to ' 01000000(64)' to modulate the digital video data, which are to be supplied to 'location 1', to '01000100(68)' if the digital video data, which are to be supplied to 'location 1', is '01000000(64)' corresponding to 'gray level section 1'; and adds '00000110(6)' to '10000000(128)' to modulate the digital video data, which are to be supplied in 'location 2', to '10000110(134)' if the digital video data, which are to be supplied to 'location 2', is '10000000(128)' corresponding to 'gray level section 3'.

| classification | Gray level area | Location 1 | Location 2 |
|---|---|---|---|
| Gray level section 1 | 00000000(0) ~00110010(50) | 00000100(4) | 00000010(2) |
| Gray level section 2 | 00110011(51) ~01110000(112) | 00000110(6) | 00000100(4) |
| Gray level section 3 | 01110001(113) ~10111110(190) | 00001000(8) | 00000110(6) |

On the other hand, it is desirable to calculate the third compensation data in consideration of the first and second compensation data in case that the link pixel is included in the panel defect area or the boundary part. For example, it is assumed that there exist link pixel 1 included in the panel defect area or the boundary part and link pixel 2 included in the non-defect area except the boundary part, and two link pixels of link pixel 1 and link pixel 2 have the same charge characteristic and require a compensation of as much as '+3'. In this case, for link pixel 2, it is just fine to determine the third compensation data which are to compensate the charge characteristic by '+3', but in case of link pixel 1, if the charge characteristic is compensated by '+1' by the first or second compensation data, it is desirable to determine the third compensation data which are to compensate the charge characteristic by'+2'.

As described above, the third compensation step according to the present invention modulates the data, which are to be displayed at the link pixel linked to the normal pixel adjacent to the defect pixel, with the third compensation data which compensate the charge characteristic of the link pixel, thereby lowering the extent of perceiving the defect pixel.

Figure 20:
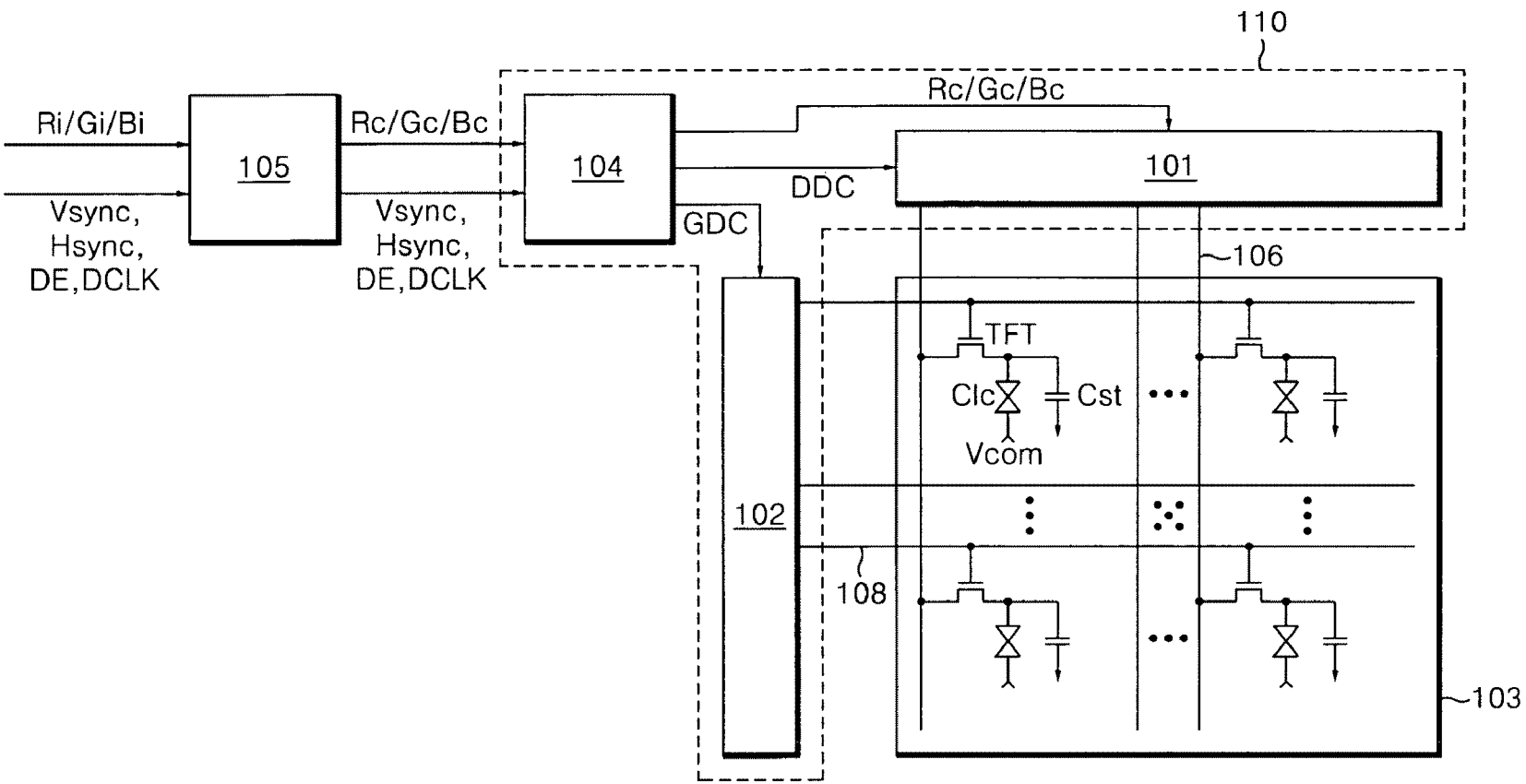
FIG. 20 is a block diagram representing a flat panel display device according to the present invention.

Hereinafter, an explanation will be made for a liquid crystal display device which realizes the above-mentioned picture quality controlling method of the present invention. FIG. 20 is a block diagram illustrating a flat display device according to the present invention. As shown in FIG. 20, the flat panel display device of the present invention includes a compensation circuit 105 which receives data and modulates the data to supply the modulated data to a driver 110 which drives a liquid crystal display panel 103.

Referring to FIG. 20, a liquid crystal display device according to an embodiment of the present invention includes a display panel 103 where data lines 106 and gate lines 108 cross each other and a thin film transistor TFT for driving a liquid crystal cell Clc is formed at each crossing part thereof; a compensation circuit 105 which modulates input data Ri, Gi, Bi, which are to be supplied to a panel defect location of the display panel 103, to generate the modulated data Rc/Gc/Bc; a data drive circuit 101 for supplying the corrected data Rc/Gc/Bc to the data lines 106; a gate drive circuit 102 for supplying scan signals to the gate lines 108; and a timing controller 104 for controlling the drive circuits 101 and 102.

The display panel 103 includes two substrates, i.e., TFT substrate and color filter substrate, and liquid crystal molecules injected between the two substrates. The data lines 106 and the gate lines 108 formed on the TFT substrate are at right angles to each other. The TFT formed at the crossing part of the data lines 106 and the gate lines 108 supplies the data voltages from the data line 106 to the pixel electrode of the liquid crystal cell Clc in response to the scan signals from the gate line 108. A black matrix, a color filter and a common electrode (not shown) are formed on the color filter substrate. On the other hand, the common electrode formed on the color filter substrate can be formed on the TFT substrate in accordance with an electric field application method. Polarizers having a vertical polarizing axis to each other are respectively adhered to the TFT substrate and the color filter substrate.

The compensation circuit 105 receives the input data Ri/Gi/Bi from a system interface to modulate the input data Ri/Gi/Bi, which are to be supplied to the panel defect area, the boundary part and the link pixel, thereby generating the corrected data Rc/Gc/Bc. And, the compensation circuit 305 will be explained in detail later.

The timing controller 104 supplies the corrected digital video data Rc/Gc/Bc, which are supplied through the compensation circuit 105, to the data drive circuit 101 in accordance with the dot clock DCLK and generates a gate control signal GDC for controlling the gate drive circuit 102 and a data control signal DDC for controlling the data drive circuit 101 in use of a vertical/horizontal synchronization signal Vsync, Hsync, a data enable signal DE and a dot clock DCLK.

The data drive circuit 101 receives the corrected data Rc/Gc/Bc as digital signals from timing controller 104 and converts the corrected data Rc/Gc/Bc into analog gamma compensation voltages (data voltage) to supply to the data lines 106.

The gate drive circuit 102 sequentially supplies scan signals, which select horizontal lines to which the data voltages are to be supplied, to the gate lines 108. The data voltages from the data lines 106 are supplied to liquid crystal cells Clc of one horizontal line in synchronization with the scan signals.

Hereinafter, in reference to FIGS. 21 to 33, a detail description on the compensation circuit 105 will be made.

Figure 21:
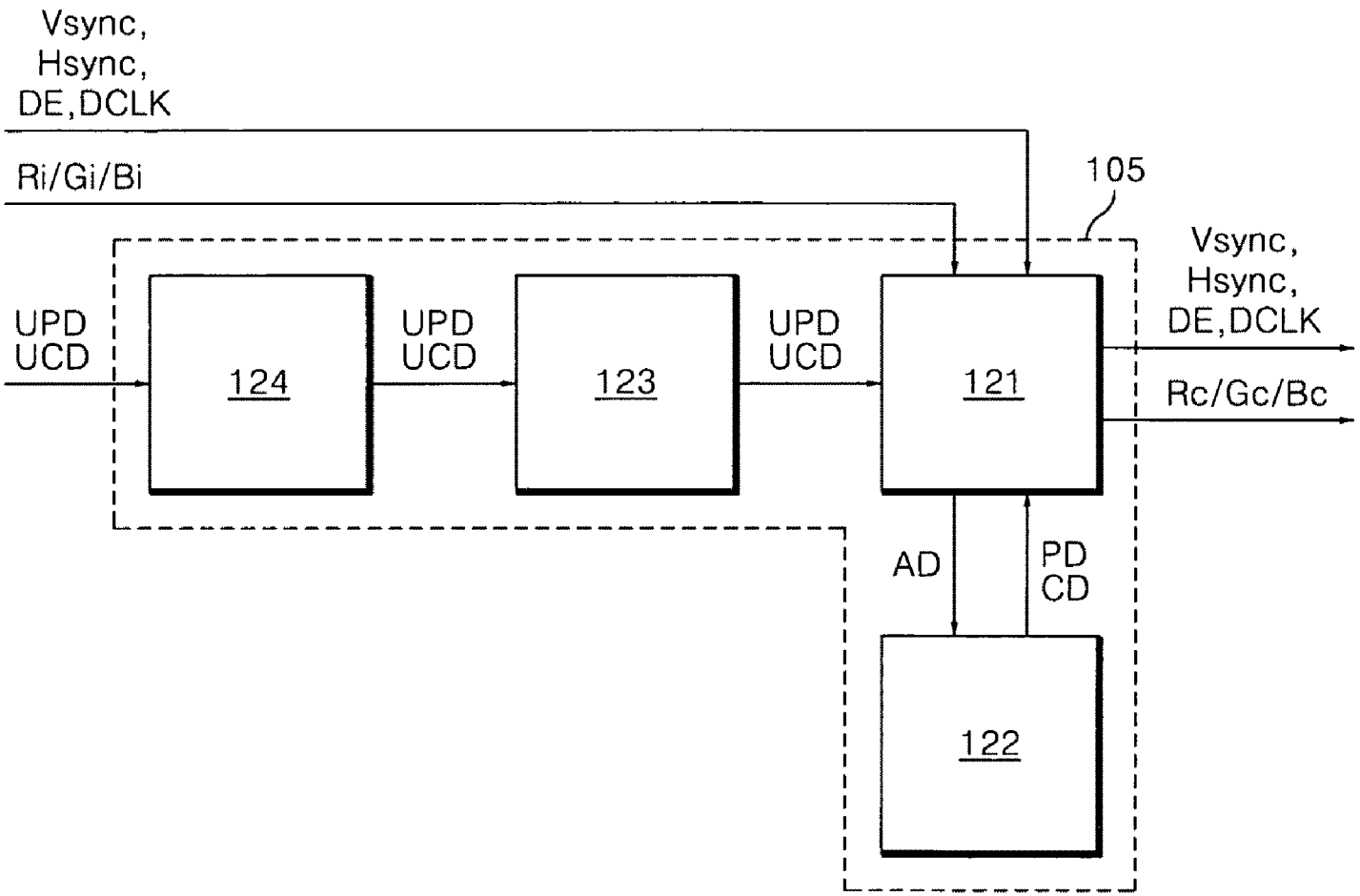
FIG. 21 is a block diagram more specifically illustrating the configuration of a compensation circuit shown in FIG. 20.

FIG. 21 is a block diagram more specifically illustrating the configuration of the compensation circuit shown in FIG. 20.

Referring to FIG. 21, the compensation circuit 105 includes an EEPROM 122 which stores location data PD and compensation data CD of the panel defect area, the boundary part and the defect pixel; a compensation part 121 for modulating the input data Ri/Gi/Bi, which are supplied from an external system, in use of the location data PD and the compensation data CD which are stored on the EEPROM 122, thereby generating the corrected data Rc/Gc/Bc; an interface circuit 124 for communicating between the compensation circuit 105 and the external system; and a register 123 for temporarily storing the data which are to be stored on the EEPROM 122 through the interface circuit 124.

The EEPROM 122 stores the location data PD which indicates each location of the panel defect area, the boundary part and the link pixel of the liquid crystal display panel 103, and the compensation data CD for each of the panel defect area, the boundary part and the link pixel. The compensation data CD includes the foregoing the first to third compensation data. The EEPROM 122 can renew the location data PD and the compensation data CD by electrical signals applied from the external system inclusive of a ROM recorder.

The interface circuit 124 is a configuration for communicating between the compensation circuit 105 and the external system, and the interface circuit 124 is designed according to a communication standard protocol of IIC (international institute of communication) and the like. The external system might read the data stored on the EEPROM 122 through the interface circuit 124 or might modify the data. That is to say, the location data PD and the compensation data CD stored on the EEPROM 122 are required to be renewed by reasons such as change in process, difference between application models and the like. And, the user might modify the data stored on the EEPROM 122 by supplying the location data UPD and the compensation data UCD, which he wants to renew, from the external system.

Register 123 temporarily stores the location data UPD and the compensation data UCD, which the user wants to renew and which are transmitted through the interface circuit 124, for renewing the location data PD and the compensation data CD stored on the EEPROM 122.

Figure 22:
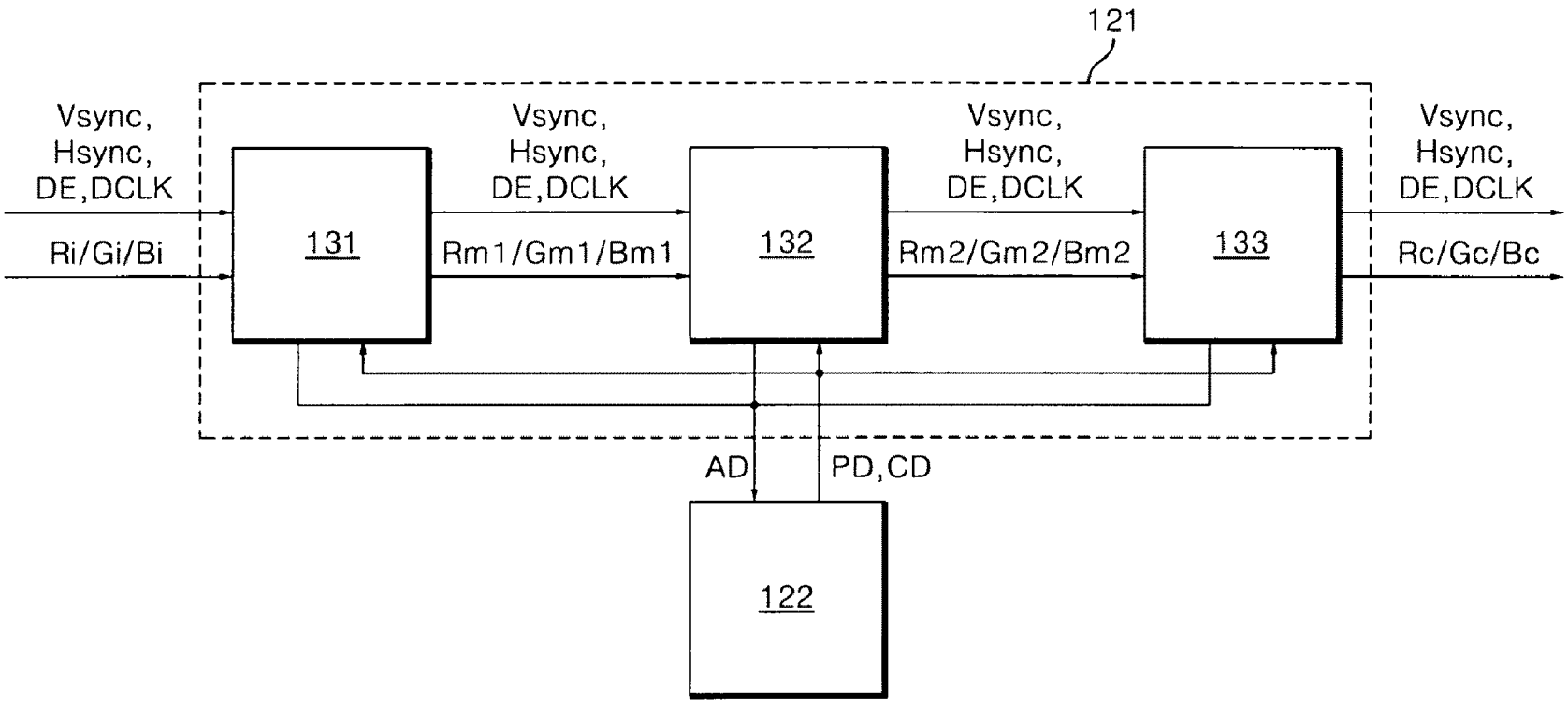
FIG. 22 is a block diagram more specifically illustrating the configuration of a compensation part shown in FIG. 21.

The compensation part 121 modulates the data, which are to be supplied to the panel defect area, the boundary part and the link pixel, in use of the location data PD and the compensation data CD stored on the EEPROM 122. FIG. 22 is a block diagram more specifically illustrating the configuration of the compensation part 121. As shown in FIG. 22, the compensation part 121 includes a first compensation part 131 which modulates the data, which are to be supplied to the panel defect area, in use of the first compensation data; a second compensation part 132 which modulates the data, which are to be supplied to the boundary part, in use of the second compensation data; and a third compensation part 133 which modulates the data, which are to be supplied to the link pixel, in use of the third compensation data.

Figure 23:
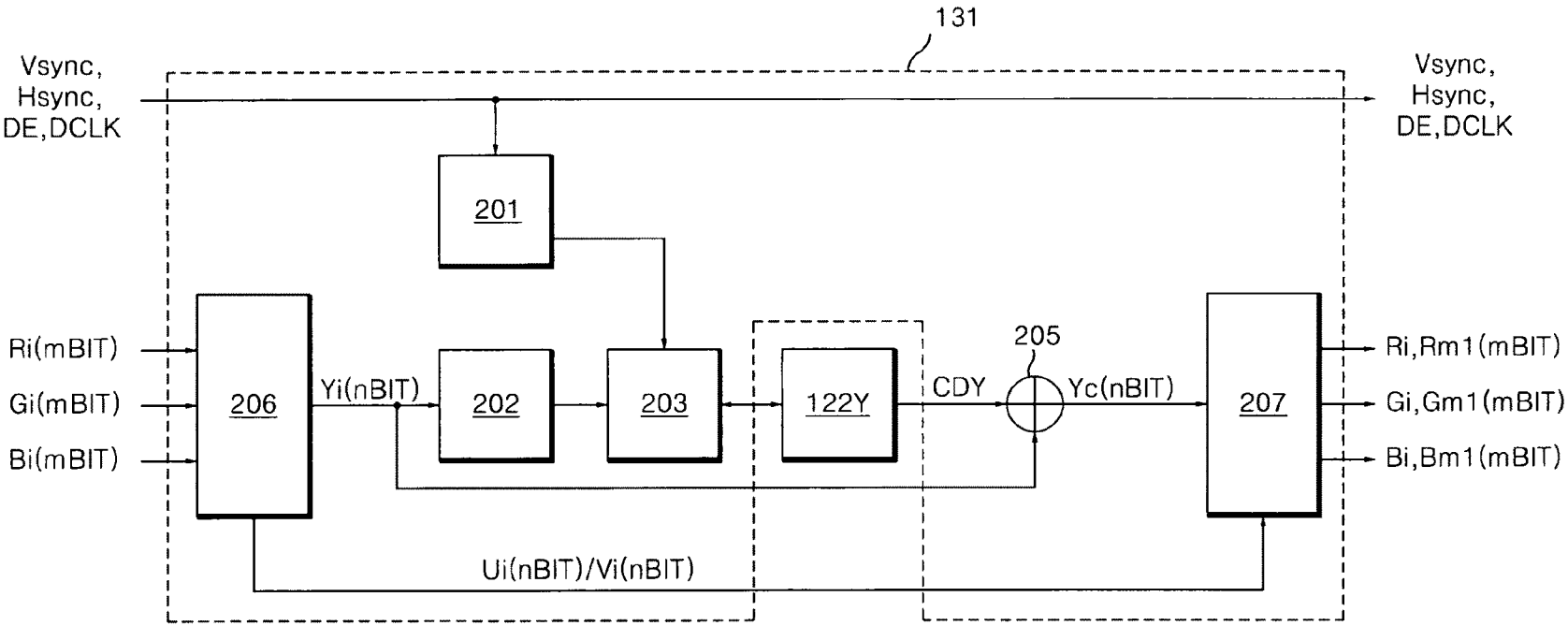
FIG. 23 is a block diagram more specifically illustrating the configuration of a first compensation part shown in FIG. 22.

FIG. 23 is a block diagram specifically illustrating the first compensation part 131 according to the present invention.

Referring to FIG. 23, the first compensation part 131 according to the present invention converts the m/m/m bits R/G/B input data Ri, Gi, Bi inclusive of red R, green G and blue B information into the n/n/n bit Y/U/V data Yi, Ui, Vi (n is an integer larger than m) inclusive of brightness (Y) and color difference (U, V) information. Further, the first compensation part 131 increases or decreases the n bits Y data Yi with the first compensation data CDY stored on the EEPROM 122Y to generate the corrected Y data Yc, and converts the corrected Y data Yc and the uncorrected U/V data Ui, Vi into the m/m/m bits first intermediate correction data Rm1, Gm1, Bm1 inclusive of red R, green G and blue B information. Herein, the first compensation part 131 outputs the un-modulated input data Ri, Gi, Bi, which are not modulated but are bypassed to be outputted, as well as the corrected first intermediate correction data Rm1, Gm1, Bm1. The first compensation part 131 includes an RGB to YUV converter 206, a location judging part 201, a gray level judging part 202, an address generating part 203, an operator 205, and a YUV to RGB converter 207.

The RGB to YUV converter 206 calculates the brightness information Yi and the n/n/n bits color difference information Ui/Vi in use of the following Mathematical Formula 1 to 3 which take the input data Ri/Gi/Bi having the m/m/m bits R/G/B data as a variable.

$$Yi=0.299Ri+0.587Gi+0.114Bi \quad \text{[Equation 1]}$$

$$Ui=-0.147Ri-0.289Gi+0.436Bi=0.492(Bi-Y) \quad \text{[Equation 2]}$$

$$Vi=0.615Ri-0.515Gi-0.100Bi=0.877(Ri-Y) \quad \text{[Equation 3]}$$

The location judging part 201 judges the display location of the input data Ri/Gi/Bi in use of a vertical/horizontal synchronization signal Vsync, Hsync, a data enable signal DE and a dot clock DCLK.

The gray level judging part 202 analyzes the gray level of the input data Ri/Gi/Bi on the basis of the brightness information Yi from the RGB to YUV converter 206.

The address generating part 203 generates a read address for reading the first compensation data CDY of the EEPROM 122Y from the location data of the panel defect area stored on the EEPROM 122Y, a location judgment result of the location judging part 201 and a gray level judgment result of the gray level judging part 202, and supplies the read address to the EEPROM 122Y. The first compensation data CDY outputted from the EEPROM 122Y in accordance with the read address are supplied to the operator 205.

The operator 205 adds the first compensation data CDY from the EEPROM 122Y to or subtract the first compensation data CDY from the brightness information Yi of n bits which is supplied from the RGB to YUV converter 206, thereby modulating the brightness of the input data Ri/Gi/Bi which are to be displayed at the panel defect location. Further, the operator 205 may include a multiplier or a divider for multiplying or dividing the brightness information Yi of n bits by the first compensation data besides the adder and subtractor.

The YUV to RGB converter 207 calculates the m/m/m bits first intermediate correction data Rm1, Gm1, Bm1 in use of the following Mathematical Formula 4 to 6 which take the brightness information Yc which is modulated by the operator 205 and the color difference information Ui, Vi from the RGB to YUV converter 206 as a variable.

$$Rm=Yc+1.140Vi \quad \text{[Equation 4]}$$

$$Gm=Yc-0.395Ui-0.581Vi \quad \text{[Equation 5]}$$

$$Bm=Yc+2.032Ui \quad \text{[Equation 6]}$$

As described above, the first compensation part according to the present invention increases or decreases the brightness information Yi of n bits, which includes more detailed gray level information because the number of bits are extended, with the first compensation data, thereby minutely adjusting the brightness of the panel defect area of the input data Ri, Gi, Bi.

Figure 24:
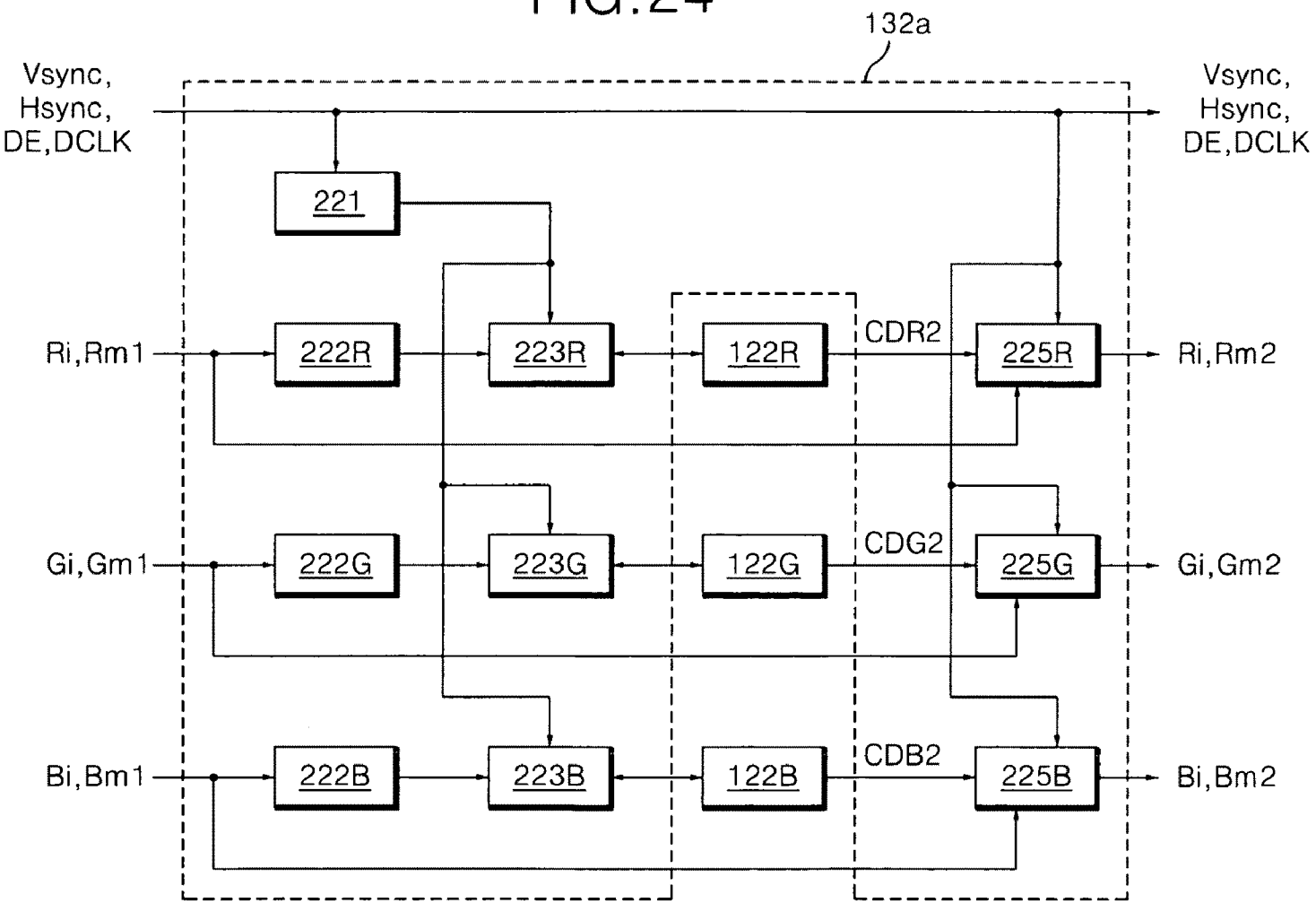
FIG. 24 is a block diagram more specifically illustrating the configuration of a second compensation part shown in FIG. 22.

FIG. 24 is a block diagram more specifically illustrating an example of the second compensation part shown in FIG. 22.

Referring to FIG. 24, the second compensation part 132A modulates the first intermediate correction data Rm1, Gm1, Bm1, which are to be supplied to the boundary part, by a dithering method in use of the second compensation data CDR2, CDG2, CDB2 stored on the EEPROM 122R, 122G, 122B. Herein, to the second compensation part 132A are inputted the un-modulated input data Ri, Gi, Bi as well as the first intermediate correction data Rm1, Gm1, Bm1. The second compensation part 132A includes a location judging part 221, a gray level judging part 222R, 222G, 222B, an address generating part 223R, 223G, 223B, and a dithering controller 225R, 225G, 225B.

The location judging part 221 judges the display location of the first intermediate correction data Rm1, Gm1, Bm1 in use of a vertical/horizontal synchronization signal Vsync, Hsync, a data enable signal DE and a dot clock DCLK.

The gray level judging part 222R, 222G, 222B analyzes the first intermediate correction data Rm1, Gm1, Bm1 or the gray level section inclusive of the gray level of the first intermediate correction data Rm1, Gm1, Bm1.

The address generator 223R, 223G, 223B generates a read address for reading the second compensation data CDR2, CDG2, CDB2 of the EEPROM 122R, 122G, 122B from the location data of the boundary part stored on the EEPROM 122R, 122G, 122B, a location judgment result of the location judging part 221 and a gray level judgment result of the gray level judging part 222R, 222G, 222B, and supplies the read address to the EEPROM 122R, 122G, 122B. The second compensation data CDR2, CDG2, CDB2 outputted from the EEPROM 122R, 122G, 122B in accordance with the read address are supplied to the dithering controller 225R, 225G, 225B.

The dithering controller 225R, 225G, 225B disperses the second compensation data CDR2, CDG2, CDB2 from the EEPROM 122R, 122G, 122B to each of the pixels within the dither pattern, which includes a plurality of pixels, and increases or decreases the first intermediate correction data Rm1, Gm1, Bm1, which are to be displayed at the boundary part, with the dispersed second compensation data CDR2, CDG2, CDB2. The dithering controller 225R, 225G, 225B includes a first dithering controller 225R for correcting red data, a second dithering controller 225G for correcting green data and a third dithering controller 225B for correcting blue data.

Figure 25:
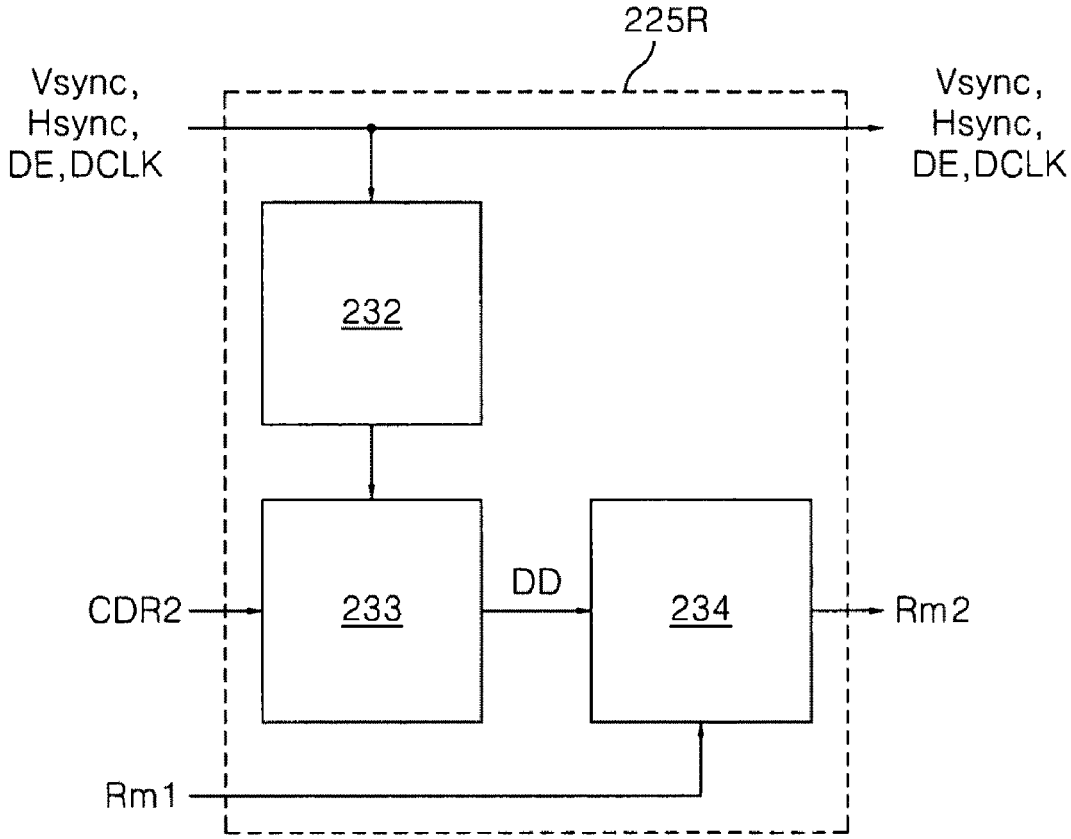
FIG. 25 is a block diagram more specifically illustrating the configuration of a first dithering controller shown in FIG. 24.

FIG. 25 is a block diagram more specifically illustrating the first dithering controller 225R of FIG. 24. Referring to FIG. 25, the first dithering controller 225R includes a pixel location sensing part 231, a compensation value judging part 233 and an operator 234.

The pixel location sensing part 231 senses the pixel location in use of any one or more of a vertical/horizontal synchronization signal Vsync, Hsync, a dot clock DCLK and a data enable signal DE. For example, the pixel location sensing part 231 can sense the pixel location by counting the horizontal synchronization signal Hsync and the dot clock DCLK.

Figure 1:
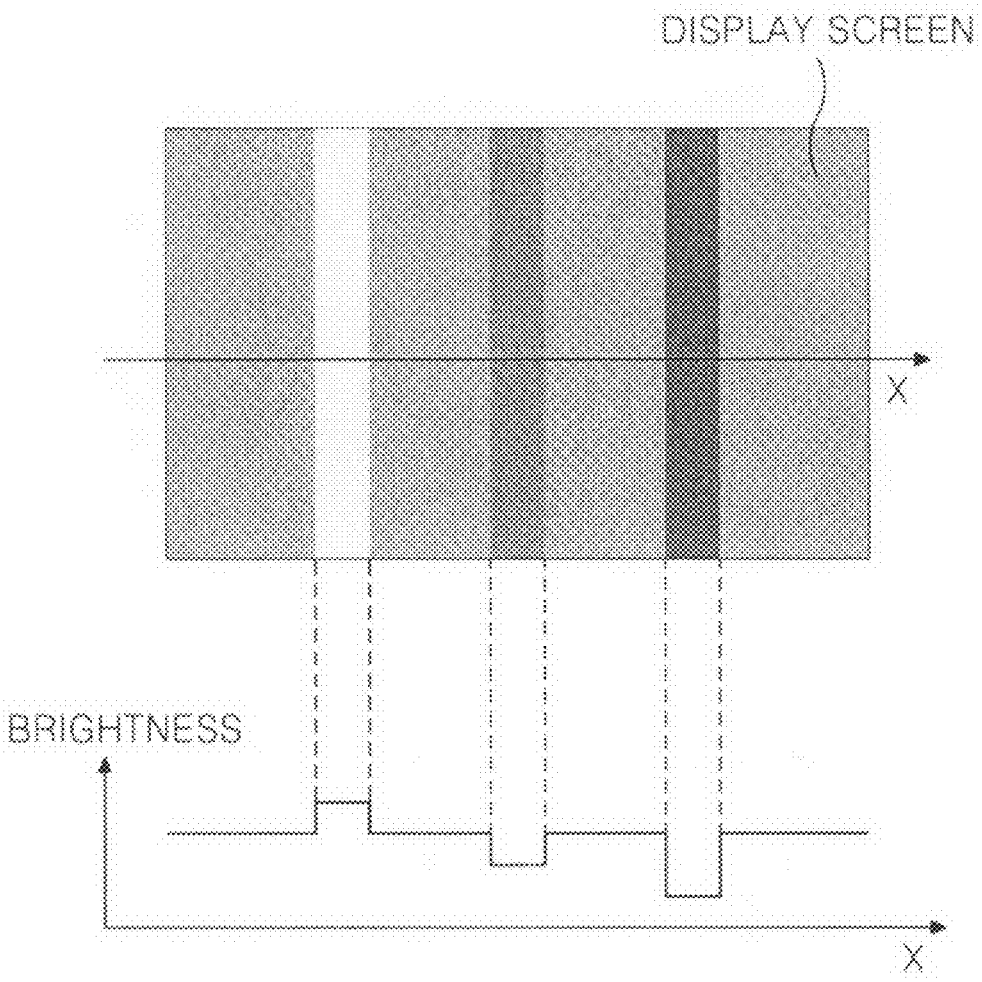
FIG. 1 RELATED ART
FIGS. 1 to 5 are diagrams representing panel defect areas of display panels of various shapes.
Figure 2:
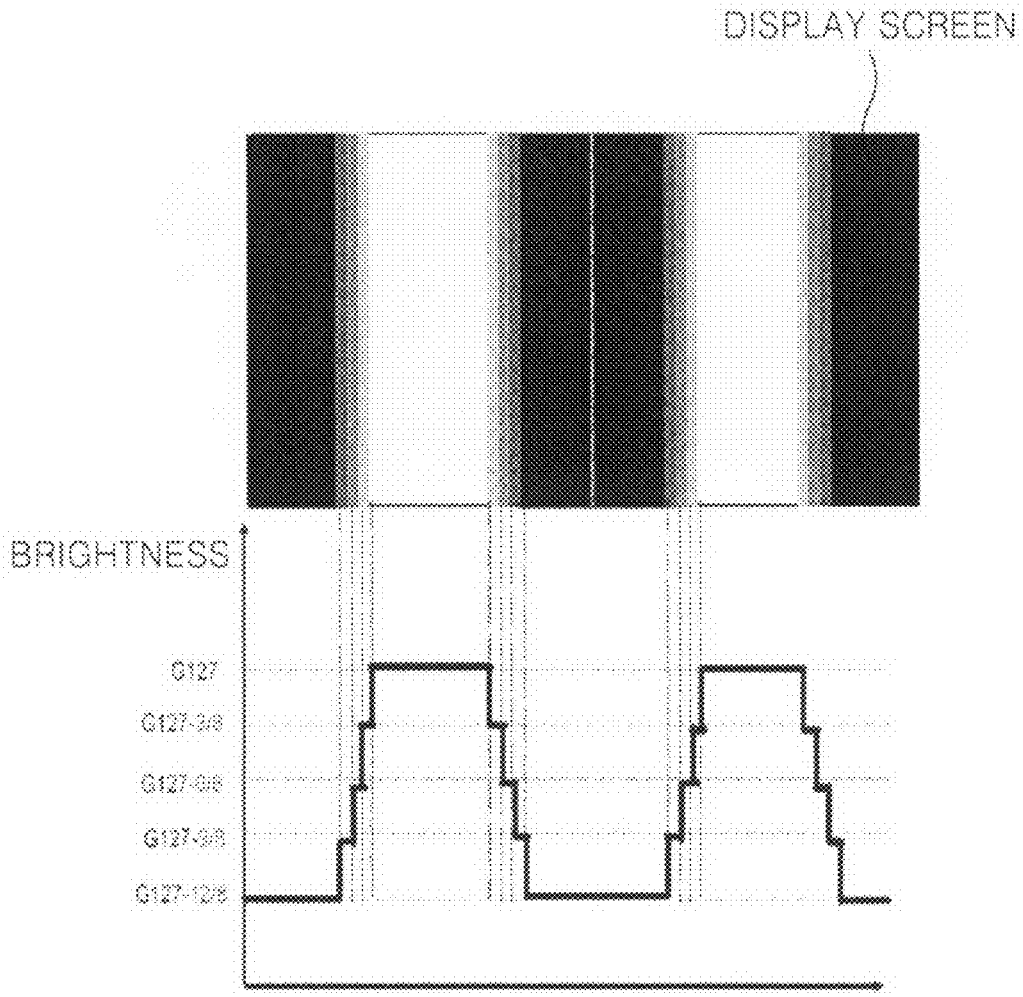
FIG. 2 RELATED ART
Figure 3:
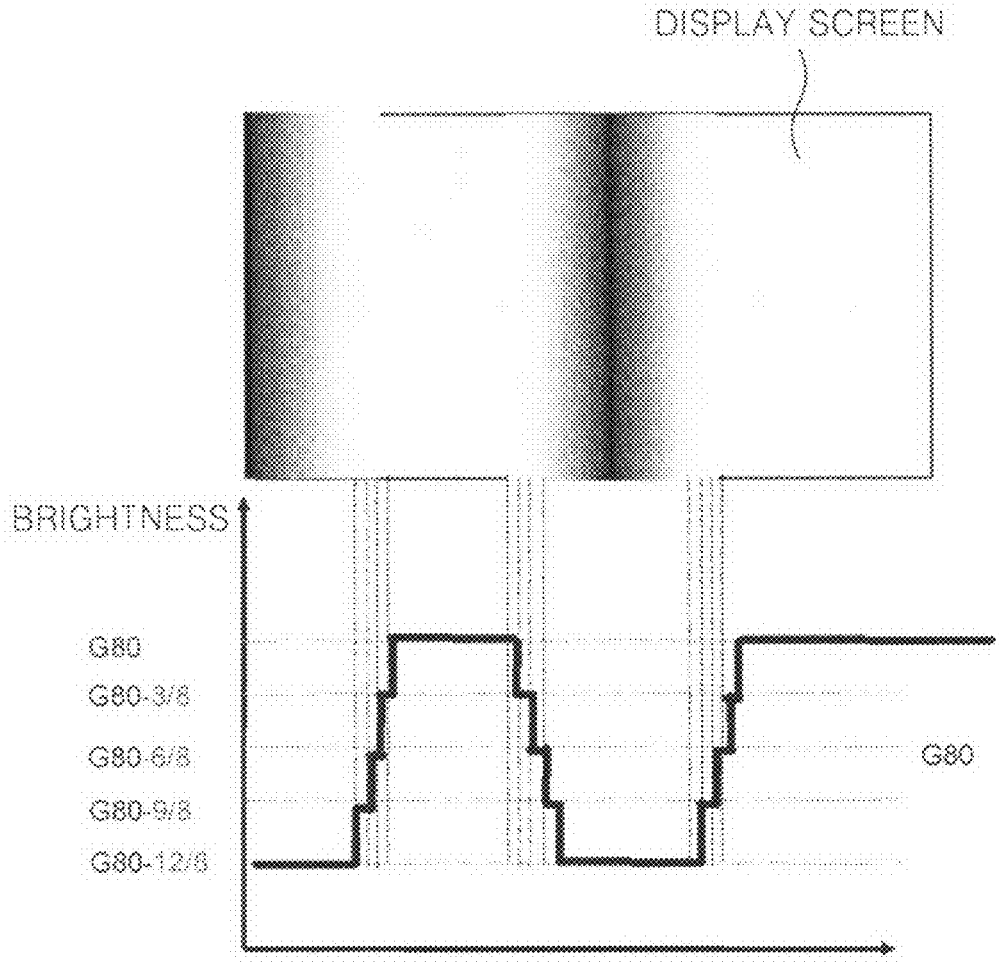
FIG. 3 RELATED ART
Figure 4:
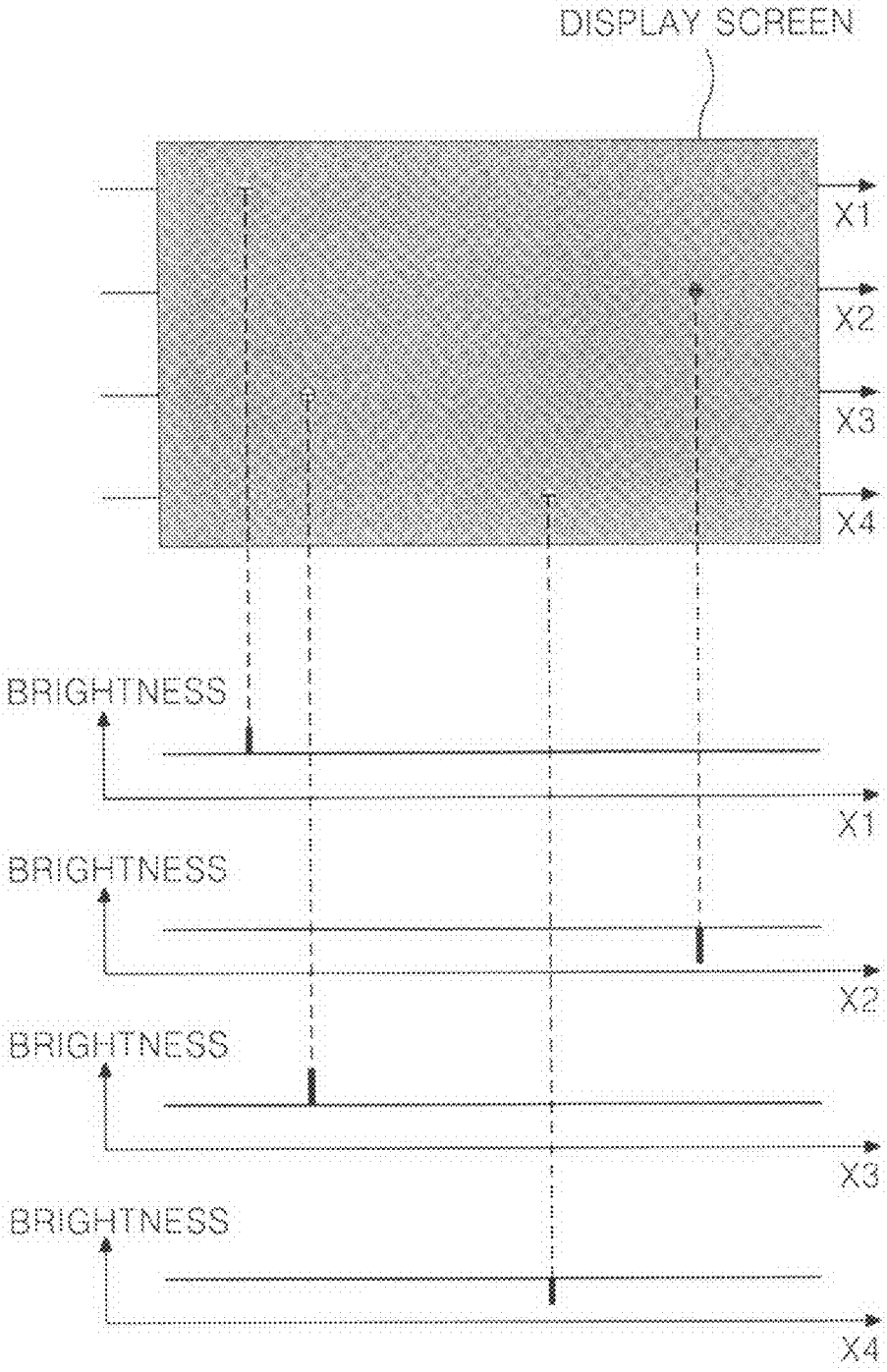
FIG. 4 RELATED ART
Figure 5:
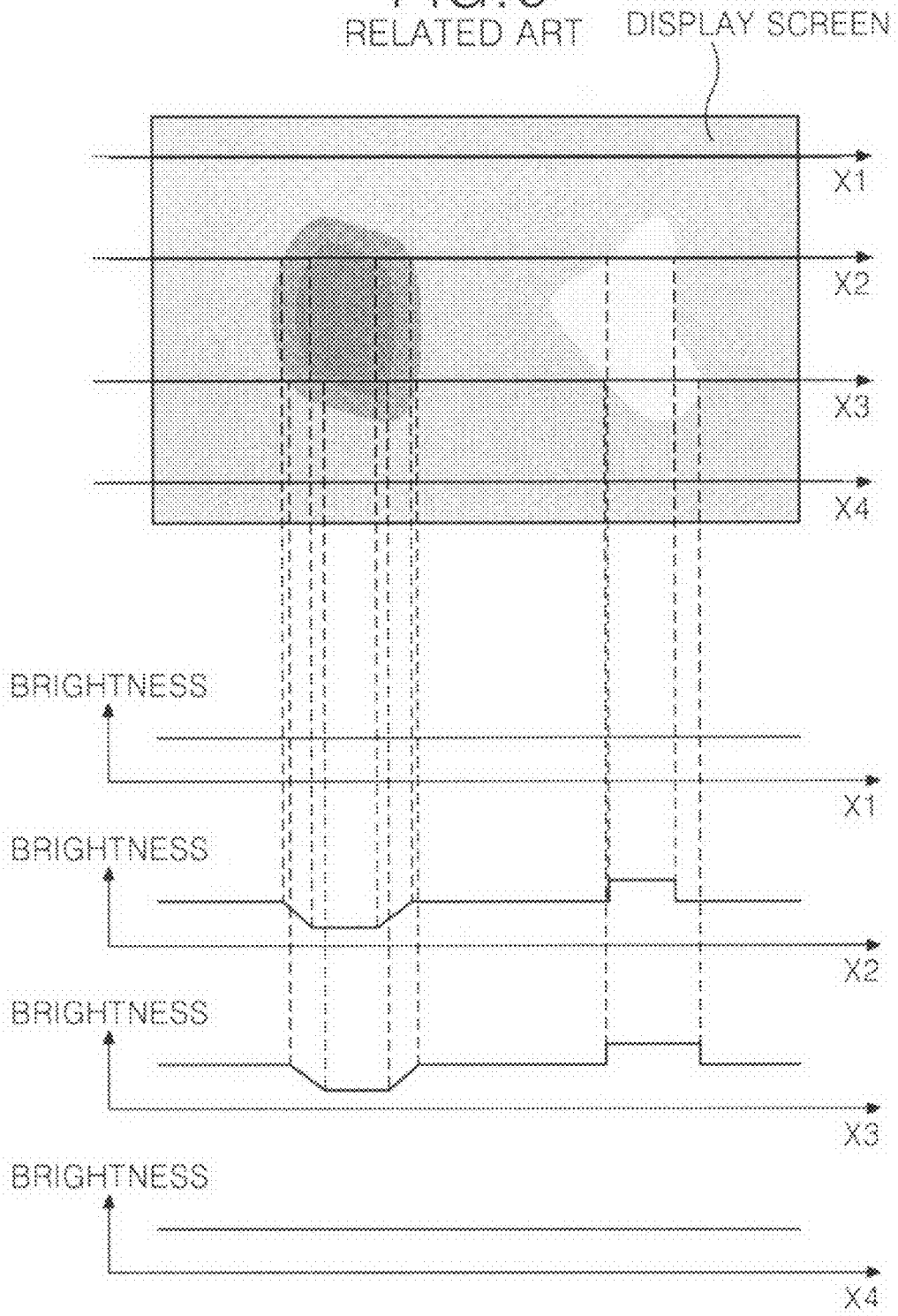
FIG. 5 RELATED ART
Figure 6A:
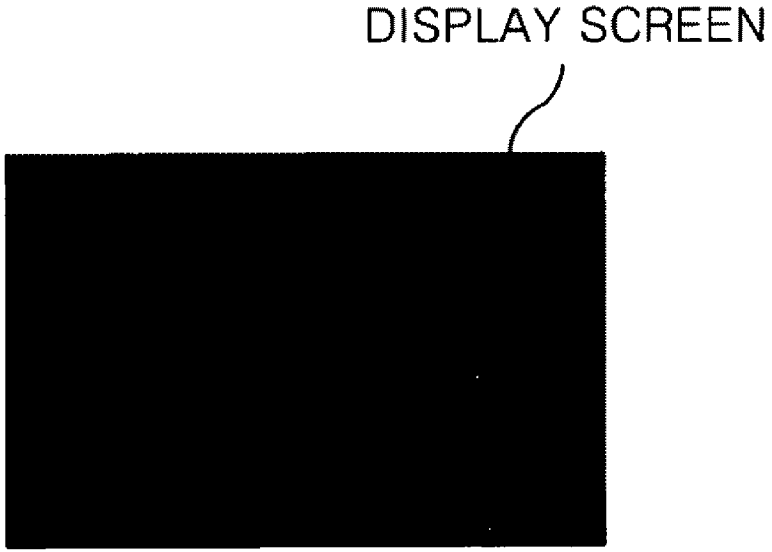
FIG.6A RELATED ART
FIGS. 6A to 6C are diagrams representing the extent of perceiving a defect pixel, which is turned into a dark point, for each gray level.
Figure 6B:
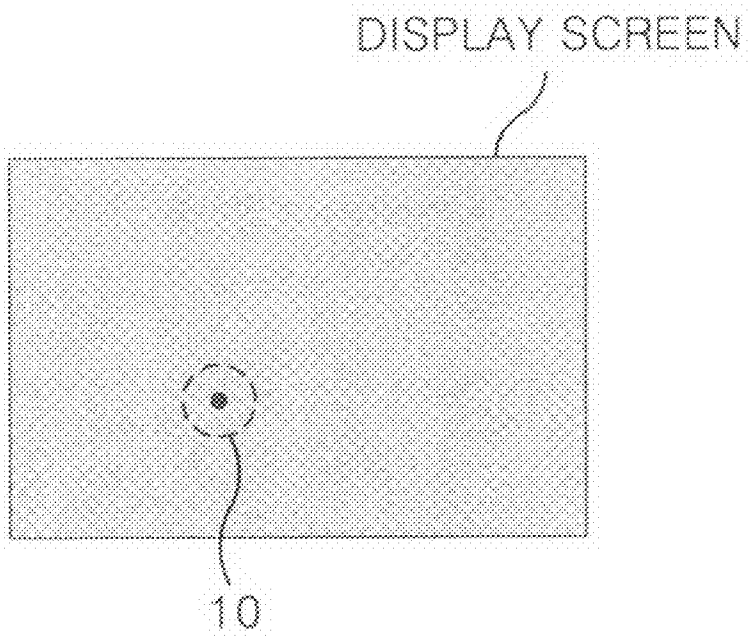
FIG. 6B RELATED ART
Figure 6C:
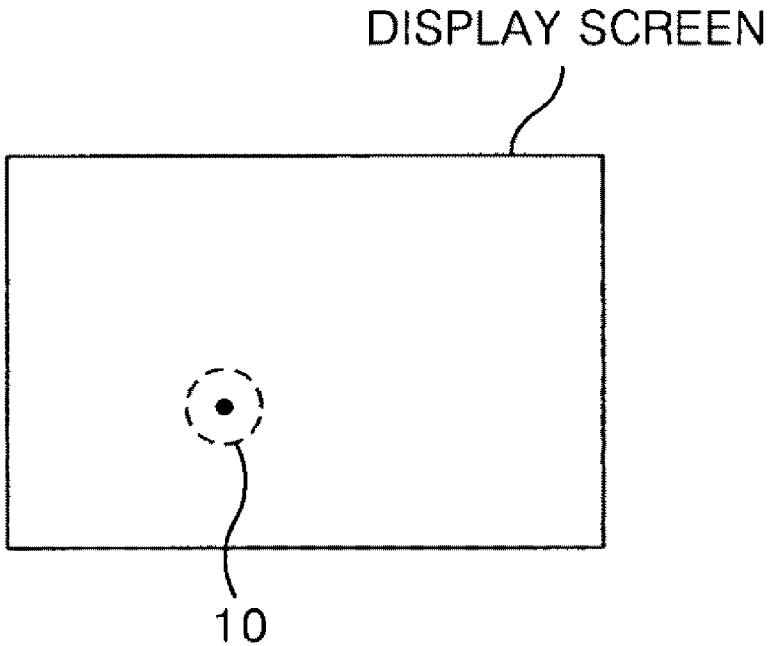
FIG. 6C RELATED ART

The compensation value judging part 233 judges the R compensation value and generates a dithering data DD by taking the compensation value as a value which is to be dispersed to the pixels included within the dither pattern. The compensation value judging part 233 is programmed to automatically output the dithering data DD in accordance with the second R compensation data CDR2. For example, the compensation value judging part 233 is pre-programmed to perceive the second R compensation data CDR2 expressed in binary data as the compensation value for a designated gray level, e.g., the compensation value is for 0 gray level if the second R compensation data CDR2 is '00', for ¼ gray level if the second R compensation data CDR2 is '01', for ½ gray level if the second R compensation data CDR2 is '10' and for ¾ gray level if the second R compensation data CDR2 is '11'. In case that dithering is performed for the dither pattern inclusive of 4 pixels, as shown in FIG. 3, the compensation value judging part 233 generates '1' as the dithering data DD at one pixel location within the dither pattern if the second R compensation data CDR2 of '01' are supplied thereto, but generates '0' as the dithering data DD at the remaining 3 pixel locations, as shown in (a) of FIG. 15B. At this moment, in the compensation value judging part 223, there are determined a plurality of dither patterns which each differently designate the pixel location, to which the second R compensation data CDR2 are to be dispersed within the dither pattern, and the dither pattern where the locations of the pixels, where the brightness is to be compensated, are made different is applied to the dither patterns which are adjacent vertically or horizontally.

The operator 234 increases or decreases the first R intermediate correction data Rm1 with the dithering data, thereby generating the second R intermediate correction data Rm2.

The first R intermediate correction data to be corrected and the R compensation data CDR2 might be respectively supplied to the first dithering controller 225R through different data transmission lines, or the first R intermediate correction data Rm1 to be corrected and the R compensation data CDR2 might be combined to be supplied to the first dithering controller 225R through the same line. For example, if the first R intermediate correction data Rm1 to be corrected is '01000000' of 8 bits and the R compensation data CDR2 is '011' of 3 bits, the '01000000' and '011' can respectively be supplied to the first dithering controller 225R through the different data transmission lines or can be combined to an 11 bit data of '01000000011' to be supplied to the first dithering controller 225R. In case that the first R intermediate correction data Rm1 and the R compensation data CDR2 are combined to the 11 bit data to be supplied to the first dithering controller 225R, the first dithering controller 225R perceives the upper 8 bits out of the 11 bit data as the first R intermediate correction data Rm1 to be corrected and perceives the lower 3 bits as the R compensation data CDR2, thereby performing the dithering control. On the other hand, as an example of the method of generating the data of '01000000011' into which the above '01000000' and '011' are combined, there is a method that a dummy bit '000' is added to the lowest bit of '01000000' to convert them into '01000000000' and '011' is added thereto to generate the data of '01000000011'.

The second and third dithering controllers 225G, 225B substantially have the same circuit configuration as the first dithering controller 225R. Accordingly, a detail explanation for the second and third dithering controllers 225G, 225B will be omitted.

As a result, when assuming that the R, G, B data are each 8 bits, and a dither pattern for dithering is composed of 4 pixels to spatially disperse a compensation value, the second compensation part 132A minutely adjust the data, which are to be displayed at the panel defect area, with the compensation value sub-classified into 1021 gray levels for each of R, G, B, and it is possible to prevent the brightness jump which appears between the dither patterns due to the regular application of the dither pattern.

Figure 26:
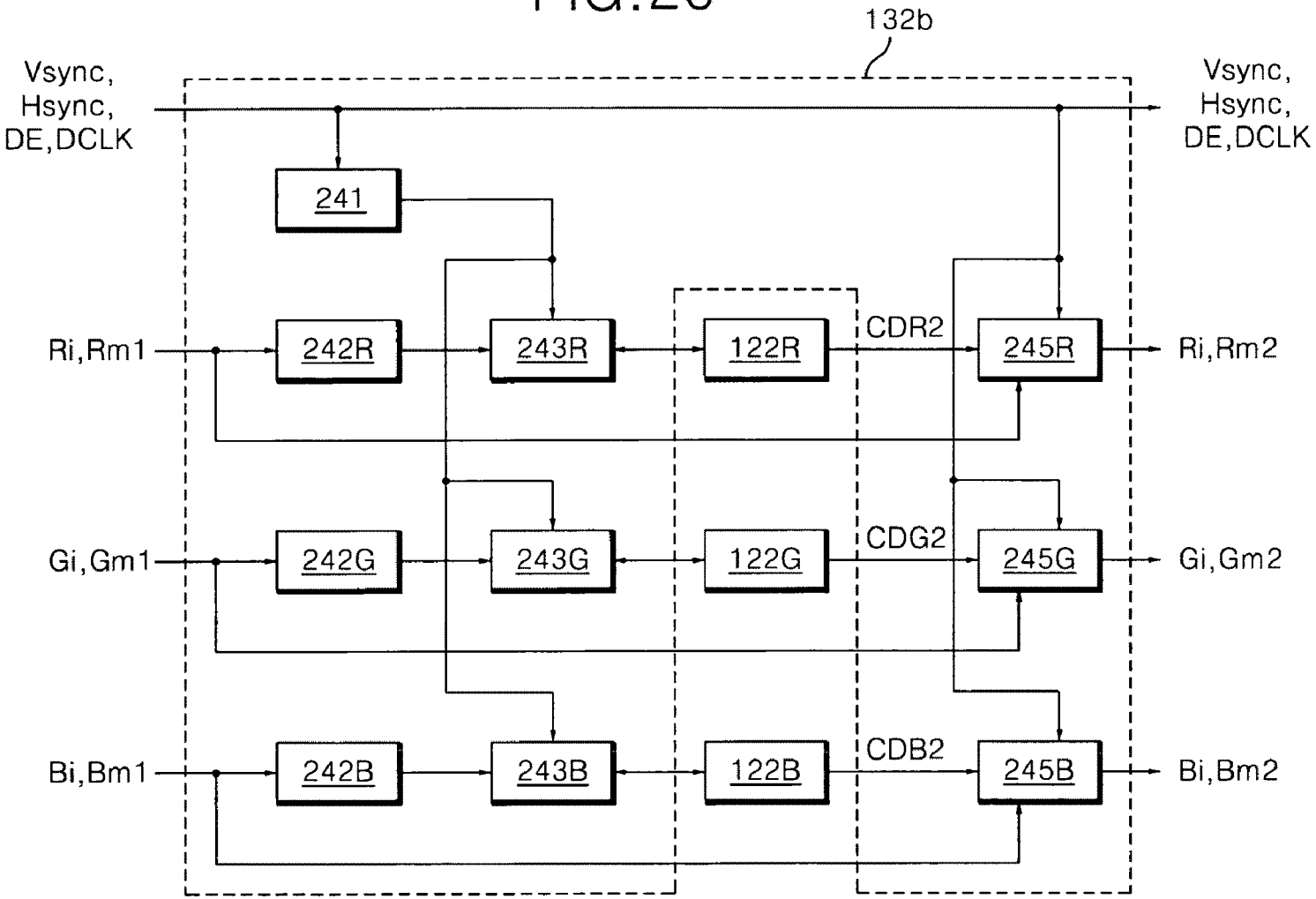
FIG. 26 is a block diagram more specifically illustrating another example of the second compensation part shown in FIG. 22.

FIG. 26 is a block diagram illustrating another example of the second compensation part 132 shown in FIG. 22. Referring to FIG. 26, the second compensation part 132B modulates the first intermediate correction data Rm1, Gm1, Bm1, which are to be supplied to the panel defect area, by a frame rate control and dithering method in use of the second compensation data CDR2, CDG2, CDB2 stored on the EEPROM 122R, 122G, 122B. Herein, to the second compensation part 132B are inputted the un-modulated input data Ri, Gi, Bi as well as the first intermediate correction data Rm1, Gm1, Bm1. The second compensation part 132B includes a location judging part 241, a gray level judging part 242R, 242G, 242B, an address generating part 243R, 243G, 243B, and an FRC/dithering controller 245R, 245G, 245B.

The location judging part 241 judges the display location of the first intermediate correction data Rm1, Gm1, Bm1 in use of a vertical/horizontal synchronization signal Vsync, Hsync, a data enable signal DE and a dot clock DCLK.

The gray level judging part 242R, 242G, 242B analyzes the first intermediate correction data Rm1, Gm1, Bm1 or the gray level section inclusive of the gray level of the first intermediate correction data Rm1, Gm1, Bm1.

The address generator 243R, 243G, 243B generates a read address for reading the second compensation data CDR2, CDG2, CDB2 of the EEPROM 122R, 122G, 122B from the location data of the panel defect area stored on the EEPROM 122R, 122G, 122B, a location judgment result of the location judging part 241 and a gray level judgment result of the gray level judging part 242R, 242G, 242B, and supplies the read address to the EEPROM 122R, 122G, 122B. The second compensation data CDR2, CDG2, CDB2 outputted from the EEPROM 122R, 122G, 122B in accordance with the read address are supplied to the FRC/dithering controller 245R, 245G, 245B.

The FRC/dithering controller 245R, 245G, 245B disperses the second compensation data CDR2, CDG2, CDB2 from the EEPROM 122R, 122G, 122B to each of the pixels within the dither pattern, which includes a plurality of pixels, and increases or decreases the input data Ri/Gi/Bi, which are to be displayed at the panel defect area, with the dispersed second compensation data CDR2, CDG2, CDB2. The FRC/dithering controller 245R, 245G, 245B includes a first FRC/dithering controller 245R for correcting red data, a second FRC/dithering controller 245G for correcting green data and a third FRC/dithering controller 245B for correcting blue data.

Figure 27:
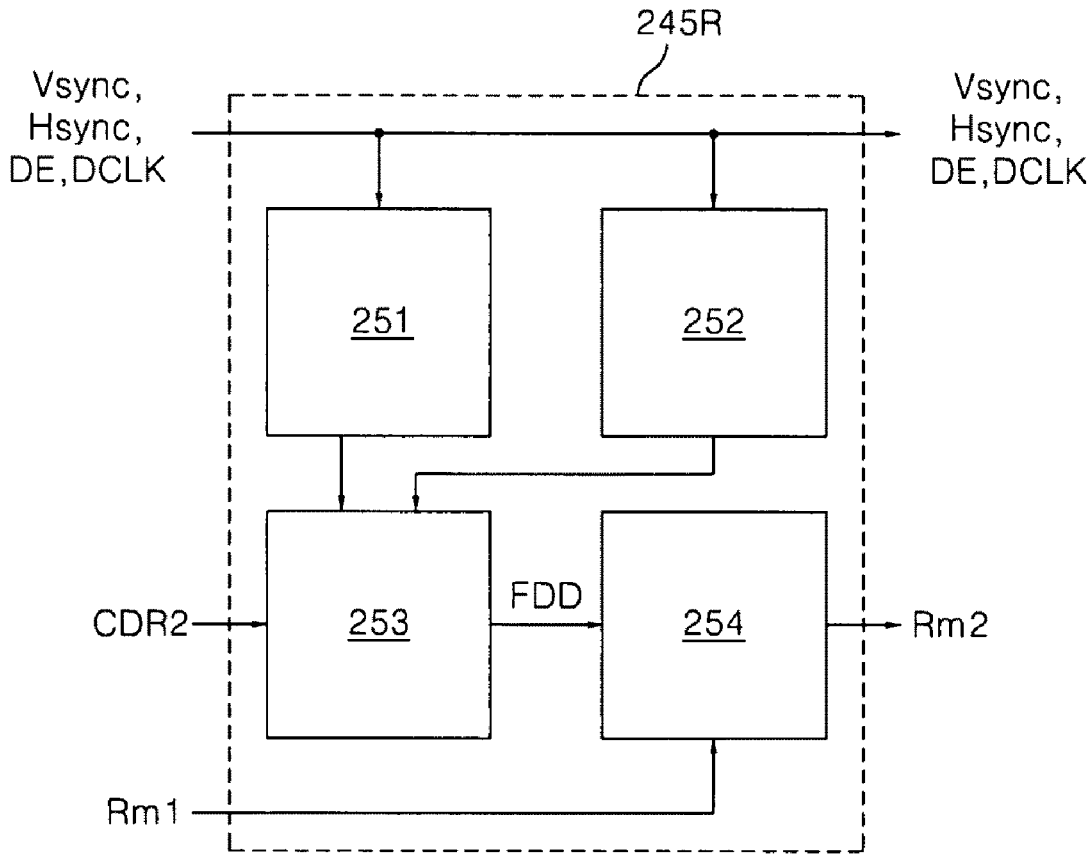
FIG. 27 is a block diagram more specifically illustrating the configuration of a first FRC/dithering controller shown in FIG. 26.

FIG. 27 is a block diagram more specifically illustrating the first FRC/dithering controller 245R of FIG. 26. Referring to FIG. 27, the first FRC/dithering controller 245R includes a frame number sensing part 251, a pixel location sensing part 252, a compensation value judging part 253 and an operator 254.

The frame number sensing part 251 senses the number of frames in use of at least any one of a vertical/horizontal synchronization signal Vsync, Hsync, a dot clock DCLK and a data enable signal DE. For example, the frame number sensing part 251 can sense the number of frames by counting the vertical synchronization signal Vsync.

The pixel location sensing part 252 senses the pixel location in use of any one or more of a vertical/horizontal synchronization signal Vsync, Hsync, a dot clock DCLK and a data enable signal DE. For example, the pixel location sensing part 252 can sense the pixel location by counting the horizontal synchronization signal Hsync and the dot clock DCLK.

The compensation value judging part 253 judges the R compensation value and generates an FRC/dithering data FDD by calculating the pixels within the dither pattern, to which the compensation value is applied, and a dispersion value, which is applied for a plurality of frame periods, thereby generating the FRC/dithering data FDD. The compensation value judging part 253 is programmed to automatically output the FRC/dithering data FDD in accordance with the second R compensation data CDR2. For example, the compensation value judging part 253 is pre-programmed to perceive the second R compensation data CDR2 expressed in binary data as the compensation value for a designated gray level, e.g., the compensation value is for 0 gray level if the second R compensation data CDR2 is '00', for ¼ gray level if the second R compensation data CDR2 is '01', for ½ gray level if the second R compensation data CDR2 is '10' and for ¾ gray level if the second R compensation data CDR2 is '11'. In case of performing the frame rate control and dithering by taking a unit frame inclusive of 4 frames as a frame rate control unit and by taking a dither pattern inclusive of 4 pixels as a dither pattern, if the second R compensation data CDR2 of '01' are supplied thereto, the compensation value judging part 253 generates '1' as the FRC/dithering data FDD at one pixel location within the dither pattern for 4 frame periods, generates '0' as the FRC/dithering data FDD at the remaining 3 pixel locations, and changes the location of the pixel, where '1' is generated, for each frame. At this moment, the compensation value judging part 253 determines a plurality of dither patterns which each differently designate the pixel location, to which the second R compensation data CDR2 are to be dispersed within the dither pattern, and a plurality of FRC patterns which each differently designate the frame, to which the second R compensation data CDR2 are to be dispersed. Further, the dither pattern where the locations of the pixels, where the brightness is to be compensated, are made different is applied to the dither patterns which are adjacent vertically or horizontally.

The operator 254 increases or decreases the first R intermediate correction data Rm1 with the FRC/dithering data RDD, thereby generating the second R intermediate correction data Rm2.

On the other hand, the first R intermediate correction data to be corrected and the second R compensation data CDR2 might be respectively supplied to the first FRC/dithering controller 245R through different data transmission lines, or the first R intermediate correction data Rm1 to be corrected and the second R compensation data CDR2 might be combined to be supplied to the first FRC/dithering controller 245R through the same line. For example, if the first R intermediate correction data Rm1 to be corrected is '01000000' of 8 bits and the second R compensation data CDR2 is '011' of 3 bits, the '01000000' and '011' can respectively be supplied to the first FRC/dithering controller 245R through the different data transmission lines or can be combined to an 11 bit data of '01000000011' to be supplied to the first FRC/dithering controller 245R. In case that the first R intermediate correction data Rm1 and the second R compensation data CDR2 are combined to the 11 bit data to be supplied to the first FRC/dithering controller 245R, the first FRC/dithering controller 245R perceives the upper 8 bits out of the 11 bit data as the first R intermediate correction data Rm1 to be corrected and perceives the lower 3 bits as the second R compensation data CDR2, thereby performing the FRC/dithering control. On the other hand, as an example of the method of generating the data of '01000000011' into which the above '01000000' and '011' are combined, there is a method that a dummy bit '000' is added to the lowest bit of '01000000' to convert them into '01000000000' and '011' is added thereto to generate the data of '01000000011'.

The second and third FRC/dithering controllers 245G, 245B substantially have the same circuit configuration as the first FRC/dithering controller 245R. Accordingly, a detail explanation for the second and third FRC/dithering controllers 245G, 245B will be omitted.

As described above, the second compensation part 132B might temporally and spatially disperse the compensation value by making a configuration that the R, G, B data are each 8 bits, the 4 frames are a unit frame of the frame rate control, and a dither pattern for dithering is composed of 4 pixels. Accordingly, the data, which are to be displayed at the panel defect area, can be minutely adjusted with the compensation value sub-classified into 1021 gray levels for each of R, G, B with almost no flicker and resolution deterioration, and it is possible to prevent the brightness jump which appears between the dither patterns due to the regular application of the dither pattern.

Figure 28:
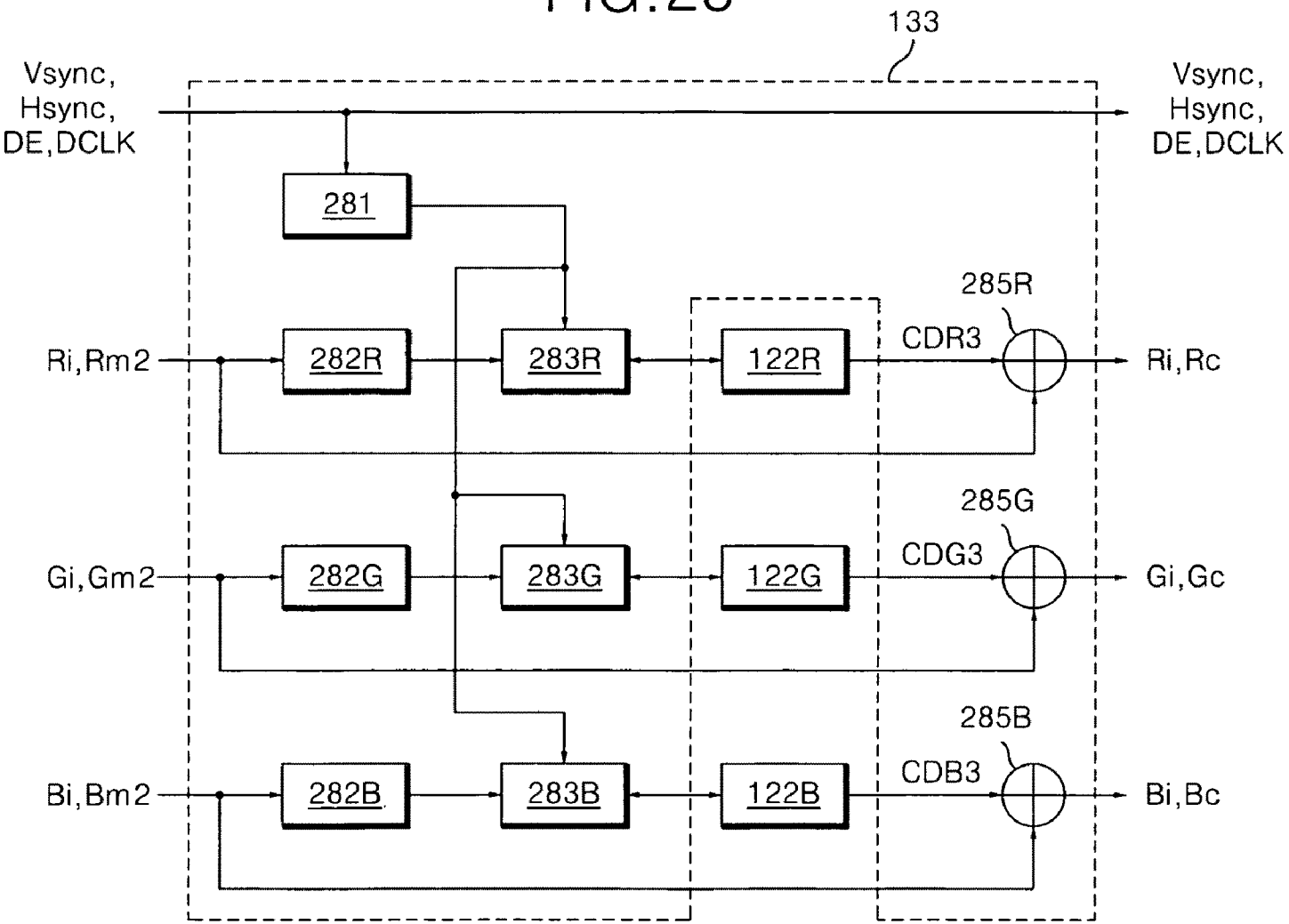
FIG. 28 is a block diagram more specifically illustrating a configuration example of a third compensation part shown in FIG. 22.

FIG. 28 is a block diagram more specifically illustrating the configuration of the third compensation part 133 shown in FIG. 22.

Referring to FIG. 28, the third compensation part 133 increases or decreases to modulate the second intermediate correction data Rm2, Gm2, Bm2, which are to be displayed at the link pixel, in use of the third compensation data CDR3, CDG3, CDB3 stored on the EEPROM 122R, 122G, 122B. Herein, to the third compensation part 133 are inputted the un-modulated input data Ri, Gi, Bi and the data Rm2, Gm2, Bm2 which are modulated through the first and second compensation parts 131, 132. The third compensation part 133 includes a location judging part 281, a gray level judging part 282R, 282G, 282B, an address generating part 283R, 283G, 283B, and an operator 285R, 285G, 285B.

The location judging part 281 judges the display location of the second intermediate correction data Rm2, Gm2, Bm2 in use of a vertical/horizontal synchronization signal Vsync, Hsync, a data enable signal DE and a dot clock DCLK.

The gray level judging part 282R, 282G, 282B analyzes the second intermediate correction data Rm2, Gm2, Bm2 or the gray level section inclusive of the gray level of the second intermediate correction data Rm2, Gm2, Bm2.

The address generator 283R, 283G, 283B generates a read address for reading the third compensation data CDR3, CDG3, CDB3 of the EEPROM 122R, 122G, 122B from the location data of the link pixel stored on the EEPROM 122R, 122G, 122B, a location judgment result of the location judging part 281 and a gray level judgment result of the gray level judging part 282R, 282G, 282B, and supplies the read address to the EEPROM 122R, 122G, 122B. The third compensation data CDR3, CDG3, CDB3 outputted from the EEPROM 122R, 122G, 122B in accordance with the read address are supplied to the operator 285R, 285G, 285B.

The operator 285R, 285G, 285B increases or decreases the second R intermediate correction data Rm2, Gm2, Bm2 in use of the third compensation data CDR3, CDG3, CDB3, thereby generating the corrected data Rc, Gc, Bc. On the other hand, the operator 285R, 285G, 285B includes a multiplier or a divider for multiplying or dividing the second intermediate correction data Rm2, Gm2, Bm2 by the third compensation data besides the adder and subtractor.

The data Rc, Gc, Bc corrected by the foregoing first to third compensation parts 131, 132, 133 are supplied to the liquid crystal display panel 103 through the timing controller 104 and the data drive circuit 101, thereby displaying the picture of which the picture quality is corrected.

On the other hand, the flat panel display device and the picture quality controlling method thereof according to the embodiment of the present invention are explained centering on the liquid crystal display device, but can similarly be applied to other flat panel display devices such as an active matrix organic light emitting diode OLED.

As described above, the flat panel display device and the picture quality controlling method thereof according to the embodiment of the present invention extends the number of bits of the brightness and color difference information calculated from the red, green and blue information of the data which are to be supplied to the panel defect area of the display panel, and adjusts the brightness information of which the number of bits are extended, thereby minutely adjusting the brightness of the panel defect area.

Further, the flat panel display device and the picture quality controlling method thereof according to the embodiment of the present invention performs an electrical compensation by the picture quality control method, e.g., dithering and frame rate control, with which a minute adjustment is possible, for the boundary part of the non-defect area and the panel defect area.

Particularly, the flat panel display device and the picture quality controlling method thereof according to the embodiment of the present invention can prevent the brightness jump between the dither patterns of the boundary part by applying the irregularity of the dither pattern to the dither patterns which are arranged in parallel when performing the dithering.

Further, the flat panel display device and the picture quality controlling method thereof according to the embodiment of the present invention performs the electrical compensation for the link pixel, which is formed by the repair process and links the defect pixel and the normal pixel, to definitely reduce the extent of perceiving the defect pixel, thereby having an effect that the panel defect can be perfectly compensated.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A flat panel display device, comprising:

a display panel which has a non-defect area and a panel defect area and has at least one link pixel where adjacent pixels are linked to each other;

a memory which stores a first compensation data for compensating data to be displayed at the panel defect area, a second compensation data for compensating data to be displayed at a boundary part between the panel defect area and the non-defect area, and a third compensation data for compensating data to be displayed at the link pixel;

a first compensation part which calculates brightness information from red, green and blue data included in the data to be displayed at the panel defect area, and modulates the brightness information with the first compensation data, thereby modulating the data to be displayed at the panel defect area;

a second compensation part which disperses the second compensation data to the boundary part to modulate the data to be displayed at the boundary part;

a third compensation part which modulates the data to be displayed at the link pixel with the third compensation data; and a driver for driving the display panel in use of the data modulated by the first to third compensation parts.

2. The flat panel display device according to claim 1, wherein the first compensation part calculates n bits brightness information and color difference information from m bits red data, green data and blue data to be displayed at the panel defect area; modulates the n bits brightness information with the first compensation data to generate n bits modulated brightness information, wherein m is an positive integer and n is an integer larger than m); and generates m bits modulated red data, green data and blue data from the un-modulated color difference information and the n bits modulated brightness information.

3. The flat panel display device according to claim 1, wherein the second compensation part includes a plurality of pixels; and maps dither patterns, in which the locations and the number of pixels to which the compensation data are to be dispersed are differently designated, to the pixels of the boundary part thereby dispersing the second compensation data to the pixels of the boundary part.

4. The flat panel display device according to claim 3, wherein the locations of the pixels to which the second compensation data are dispersed are differently designated in the dither patterns which are adjacent vertically or horizontally.

5. The flat panel display device according to claim 3, wherein the second compensation part disperses the second compensation data to the pixels of the boundary part for a plurality of frame periods.

6. The flat panel display device according to claim 5, wherein each of the dither patterns includes a plurality of sub-dither patterns; and the dither pattern has the same compensation value as each of the sub-dither patterns arranged within the dither pattern, and the sub-dither patterns arranged within the dither pattern are different from locations of compensation pixels each other.

7. The flat panel display device according to claim 6, wherein assuming that the compensation value is 'I' and the number of the sub-dither patterns is 'J', the dither pattern of which the compensation value is I includes J number of sub-dither patterns of which the compensation value is I and where the locations of the compensation pixels are different from each other, and the arrangement of the sub-dither patterns is different in each J frame periods.

8. The flat panel display device according to claim 7, wherein the arrangement of the sub-dither patterns of the dither pattern is made identical for each J+1 frame periods.

9. The flat panel display device according to claim 5, wherein each of the dither pattern has a size of 8(pixels)×32 (pixels) or more.

10. The flat panel display device according to claim 5, wherein the compensation value of the dither pattern is different in accordance with a gray level value of the data to be displayed at the boundary part.

11. The flat panel display device according to claim 1, wherein the third compensation part increases or decreases the data to be displayed at the link pixel, in use of the third compensation data.

12. The flat panel display device according to claim 1, wherein the memory includes any one of EEPROM and EDID ROM.

13. The flat panel display device according to claim 1, wherein the compensation value of the first compensation data is different in accordance with the gray level of the data to be displayed at the panel defect area, and the display location of the panel defect area.

14. The flat panel display device according to claim 1, wherein the compensation value of the second compensation data is different in accordance with the gray level of the data to be displayed at the boundary part, and the pixel location of the boundary part.

15. The flat panel display device according to claim 1, wherein the compensation value of the third compensation data is different in accordance with the gray level of the data to be displayed at the link pixel, and the location of the link pixel.

16. The flat panel display device according to claim 1, wherein the link pixel includes a defect pixel and a normal pixel electrically linked to the defect pixel.

17. A picture quality controlling method of a flat panel display device, comprising the steps of:

determining a first compensation data for compensating data to be displayed at a panel defect area of a display panel, a second compensation data for compensating data to be displayed at a boundary part between the panel defect area and the non-defect area of the display panel, and a third compensation data for compensating data to be displayed at a link pixel where adjacent pixels are linked to each other in the display panel, by an inspection process and a repair process of the display panel;

storing the first to third compensation data on a memory;

modulating brightness information calculated from red, green and blue data to be displayed at the panel defect area, with the first compensation data, thereby modulating the data to be displayed at the panel defect area;

dispersing the second compensation data to the boundary part to modulate the data to be displayed at the boundary part, with the second compensation data;

modulating the data to be displayed at the link pixel, with the third compensation data; and driving the display panel in use of the data modulated by the compensation data.

18. The picture quality controlling method according to claim 17, wherein modulating the data which are to be displayed at the panel defect area includes the steps of:

calculating n bits the brightness information and color difference information from m bits red data, green data and blue data to be displayed at the panel defect area, wherein m is a positive integer and n is an integer larger than m;

modulating the n bits brightness information with the first compensation data to generate n bits modulated brightness information; and generating m bits modulated red data, green data and blue data from the un-modulated color difference information and the n bits modulated brightness information.

19. The picture quality controlling method according to claim 17, wherein modulating the data, which are to be displayed at the boundary part, with the second compensation data includes the steps of:

mapping dither patterns, in which the locations and the number of pixels to which the compensation data are to be dispersed are differently designated, to the pixels of the boundary part thereby dispersing the second compensation data to the pixels of the boundary part.

20. The picture quality controlling method according to claim 19, wherein the locations of the pixels to which the second compensation data are dispersed are differently designated in the dither patterns which are adjacent vertically or horizontally.

21. The picture quality controlling method according to claim 19, wherein the second compensation step disperses the second compensation data to the pixels of the boundary part and for a plurality of frame periods.

22. The picture quality controlling method according to claim 21, wherein each of the dither patterns includes a plurality of sub-dither patterns; and the dither pattern has the same compensation value as each of the sub-dither patterns arranged within the dither pattern, and the sub-dither patterns arranged within the dither pattern are different from locations of compensation pixels each other.

23. The picture quality controlling method according to claim 22, wherein assuming that the compensation value is 'I' and the number of the sub-dither patterns is 'J', the dither pattern of which the compensation value is I includes J number of sub-dither patterns of which the compensation value is I and where the locations of the compensation pixels are different from each other, and the arrangement of the sub-dither patterns is different in each J frame periods.

24. The picture quality controlling method according to claim 23, wherein the arrangement of the sub-dither patterns of the dither pattern is made identical for each J+1 frame periods.

25. The picture quality controlling method according to claim 21, wherein each of the dither pattern has a size of 8(pixels)×32(pixels) or more.

26. The picture quality controlling method according to claim 17, wherein the third compensation step increases or decreases the data to be displayed at the link pixel, in use of the third compensation data.

27. The picture quality controlling method according to claim 17, wherein the compensation value of the first compensation data is different in accordance with the gray level of the data to be displayed at the panel defect area, and the location of the panel defect area.

28. The picture quality controlling method according to claim 17, wherein the compensation value of the second compensation data is different in accordance with the gray level of the data to be displayed at the boundary part, and the pixel location of the boundary part.

29. The picture quality controlling method according to claim 17, wherein the compensation value of the third compensation data is different in accordance with the gray level of the data to be displayed at the link pixel, and the location of the link pixel.

* * * * *